US006722174B1

(12) United States Patent
Nishii et al.

(10) Patent No.: US 6,722,174 B1
(45) Date of Patent: Apr. 20, 2004

(54) DEVICE AND METHOD FOR MANUFACTURING HOT-ROLLED SHEET STEEL AND DEVICE AND METHOD FOR SHEET THICKNESS PRESSING USED FOR THE DEVICE AND METHOD

(75) Inventors: Takashi Nishii, Yokohama (JP); Masao Mikami, Fujisawa (JP); Hajime Ishii, Yokohama (JP); Kenichi Ide, Yokohama (JP); Toshio Iwanami, Yokohama (JP); Shirou Osada, Yokohama (JP); Satoshi Murata, Tokyo (JP); Sadakazu Masuda, Tokyo (JP)

(73) Assignees: NKK Corporation, Tokyo (JP); Ishikawajima-Harima Heavy Industries Co., Ltd., Tokyo (JP)

( * ) Notice: Subject to any disclaimer, the term of this patent is extended or adjusted under 35 U.S.C. 154(b) by 0 days.

(21) Appl. No.: 09/763,708

(22) PCT Filed: Mar. 1, 2000

(86) PCT No.: PCT/JP00/01195

§ 371 (c)(1),
(2), (4) Date: Feb. 26, 2001

(87) PCT Pub. No.: WO00/53349

PCT Pub. Date: Sep. 14, 2000

(30) Foreign Application Priority Data

| | | |
|---|---|---|
| Mar. 10, 1999 | (JP) | 11-063543 |
| Mar. 10, 1999 | (JP) | 11-063544 |
| Mar. 10, 1999 | (JP) | 11-063545 |
| Mar. 10, 1999 | (JP) | 11-063546 |
| Mar. 10, 1999 | (JP) | 11-063547 |
| Mar. 10, 1999 | (JP) | 11-063552 |
| Mar. 10, 1999 | (JP) | 11-063904 |
| Jun. 29, 1999 | (JP) | 11-183071 |

(51) Int. Cl.[7] ..... B21B 1/02; B21B 15/00

(52) U.S. Cl. ..... 72/41; 72/200; 72/206; 72/403; 72/407

(58) Field of Search ..... 72/206, 416, 407, 72/402, 41, 403, 200

(56) References Cited

U.S. PATENT DOCUMENTS

| | | | | |
|---|---|---|---|---|
| 3,333,452 A | | 8/1967 | Sendzimir | |
| 3,921,429 A | * | 11/1975 | Sendzimir | 72/406 |

(List continued on next page.)

FOREIGN PATENT DOCUMENTS

| | | | | |
|---|---|---|---|---|
| DE | 903403 | * | 2/1954 | 72/403 |
| GB | 681986 | * | 11/1952 | 72/403 |

(List continued on next page.)

OTHER PUBLICATIONS

European Search Report corresponding to EP 20700–4544, completed Apr. 16, 2003, and mailed Jul. 2, 2003.

*Primary Examiner*—Daniel C. Crane
(74) *Attorney, Agent, or Firm*—Griffin & Szipl

(57) ABSTRACT

According to an apparatus and a method for manufacturing a hot-rolled steel plate, a roughing process for reducing a thickness of a continuously cast slab is performed to obtain a sheet bar, and a finishing rolling process for rolling the sheet bar is effected to produce a hot-rolled steel plate having a predetermined plate thickness. After cooling down, the hot-rolled steel plate is then wound. A pair of dies 6 each of which has a tapered portion 6*b* on an input side and a parallel portion 6*b* on an output side are used in at least part of the roughing process. Further, before performing plate thickness pressing to a material in a plate thickness direction by using the dies 6, at least one of a front end and a rear end of the material is pressed in a widthwise direction to be pre-formed.

28 Claims, 33 Drawing Sheets

U.S. PATENT DOCUMENTS

| | | | | | |
|---|---|---|---|---|---|
| 4,387,586 | A | * | 6/1983 | Awazuhara | 72/206 |
| 4,407,056 | A | * | 10/1983 | Watanabe et al. | 72/402 |
| 4,578,983 | A | * | 4/1986 | Kimura | 72/407 |
| 4,852,383 | A | * | 8/1989 | Nikaido | 72/407 |
| 4,930,207 | A | * | 6/1990 | Kojima | 72/402 |
| 5,327,767 | A | * | 7/1994 | Narishima | 72/206 |
| 5,699,693 | A | * | 12/1997 | Nogami | 72/407 |
| 5,735,164 | A | * | 4/1998 | Heitze | 72/407 |
| 6,094,962 | A | * | 8/2000 | Eisentraut et al. | 72/403 |

FOREIGN PATENT DOCUMENTS

| | | | | | |
|---|---|---|---|---|---|
| GB | 844219 | | * | 8/1969 | 72/403 |
| JP | 57-106403 | A | | 7/1982 | |
| JP | 135702 | | * | 8/1983 | 72/206 |
| JP | 59-085305 | A | | 5/1984 | |
| JP | 59-092103 | A | | 5/1984 | |
| JP | 141301 | | * | 7/1985 | 72/206 |
| JP | 61-235002 | A | | 10/1986 | |
| JP | 61-238401 | A | | 10/1986 | |
| JP | 62-006745 | A | | 1/1987 | |
| JP | 84801 | | * | 4/1987 | 72/206 |
| JP | 2-175011 | | | 7/1990 | |
| JP | 02-274305 | A | | 11/1990 | |
| JP | 03-059761 | A | | 9/1991 | |
| JP | 04-089109 | A | | 3/1992 | |
| JP | 05-005201 | A | | 1/1993 | |
| JP | 09-122706 | A | | 5/1997 | |
| JP | 11-077113 | A | | 3/1999 | |
| JP | 11-090502 | A | | 4/1999 | |

* cited by examiner

| No | WIDTH ROLLING AMOUNT | BOARD THICKNESS PRESS PROCESS REDUCTION RATIO (PLATE WIDTH CENTER) | INTERNAL DEFECT (WIDTH CENTER) | INTERNAL DEFECT (WIDTH END) | REMARKS |
|---|---|---|---|---|---|
| 1 | 70 | 20% | × | × | COMPARATIVE EXAMPLE |
| 2 | 50 | 30% | ○ | × | COMPARATIVE EXAMPLE |
| 3 | 70 | 30% | ○ | ○ | PRESENT INVENTION |
| 4 | 0 | 33% | ○ | × | COMPARATIVE EXAMPLE |
| 5 | 30 | 33% | ○ | × | COMPARATIVE EXAMPLE |
| 6 | 35 | 33% | ○ | ○ | PRESENT INVENTION |
| 7 | 50 | 33% | ○ | ○ | PRESENT INVENTION |
| 8 | 0 | 36% | ○ | ○ | PRESENT INVENTION |

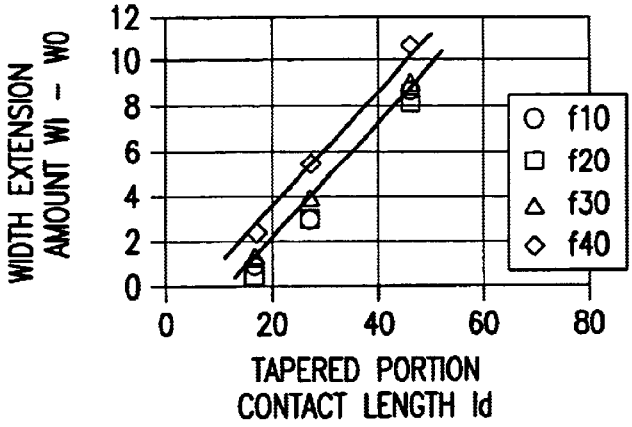
FIG.40
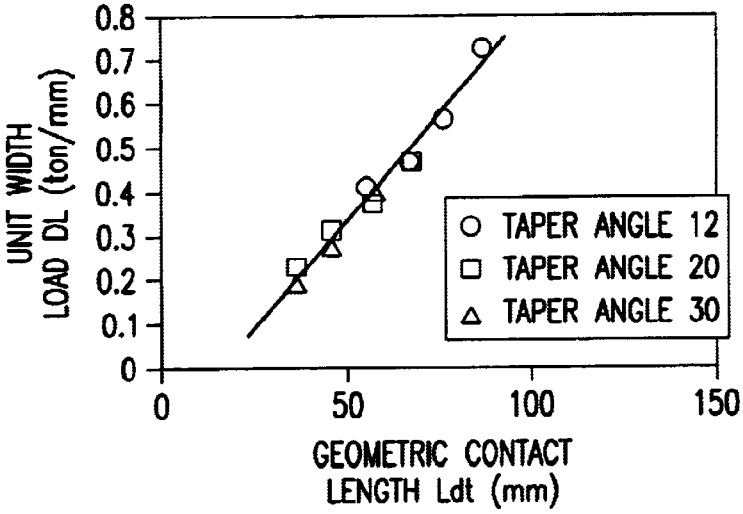
FIG.41
| TAPER ANGLE | SMALL | LARGE |
|---|---|---|
| V | SMALL | LARGE |
| WIDTH DISTRIBUTION | SMALL | LARGE |
| ld | LARGE | SMALL |
| WIDTH EXTENSION | LARGE | SMALL |
| ldt | LARGE | SMALL |
| UNIT WIDTH LOAD | LARGE | SMALL |
FIG.42

| DIE | GEOMETRIC TAPERED PORTION CONTACT LENGTH ld | ANGLE CORRESPONDING TO ONE-STAGE TAPER |
|---|---|---|
| A (COMPARATIVE EXAMPLE) | 35.8 | 15.2 |
| B (COMPARATIVE EXAMPLE) | 30.8 | 17.6 |
| C (COMPARATIVE EXAMPLE) | 32.1 | 16.9 |
| 12 TAPER (REFERENCE) | 45.9 | (12) |
| 20 TAPER (REFERENCE) | 26.8 | (20) |
| 30 TAPER (REFERENCE) | 16.9 | (30) |

FIG.54

DEVICE AND METHOD FOR MANUFACTURING HOT-ROLLED SHEET STEEL AND DEVICE AND METHOD FOR SHEET THICKNESS PRESSING USED FOR THE DEVICE AND METHOD

BACKGROUND OF THE INVENTION

1. Technical Field of the Invention

The present invention relates to a hot-rolled steel plate manufacturing apparatus and method for pressing a long material such as a continuously cast slab in a plate thickness direction, and to a plate thickness press apparatus and method used for the apparatus and the method.

2. Description of the Related Art

1. In hot rolling of a thin plate such as a hot-rolled steel plate, a slab 20 is typically rolled by a roughing mill 7 so as to obtain an intermediate thickness (a rolled material in this state is referred to as a sheet bar), and it is thereafter rolled by a finishing mill 3 so as to have a thickness of a final product. Here, as to the dimension of the slab 20, the dimension of a heating furnace 13 for heating the slab 20 is an upper limit. As a result, the steel whose amount corresponds to one steel converter is usually divided into ten or more slabs 20. It is to be noted that the slab is referred to as a hot slab or simply referred to as a material according to needs.

A sheet bar 20A outputted from the roughing mill 7 has a defect of shape called a tongue or a fishtail necessarily produced at front and rear ends in greater or lesser degrees, similarly as in rolling of a regular plate. Incidentally, the "tongue" means a defect of shape that a central portion at the end in the plate width direction protrudes in the tongue-like form. The "fishtail" means a defect of shape that the both edges at the end in the plate width direction protrude in the fishtail-like form. Since both the tongue and the fishtail have the width narrower than that of a normal portion, they are apt to be easily deformed.

If these defects of shape are left as they stand, the deformation is further advanced by the finishing mill 3 in the next step, which may cause rolling trouble. The defects of shape are, therefore, cut and removed at the stage of the sheet bar 20A. The product yield is reduced as the cut and removed portion (which will be referred to as a "crop" hereinafter) becomes longer.

The finishing mill 3 is a continuous rolling mill generally composed of several stands and performs rolling to a steel tape having a thin thickness with tensile force applied thereto. A portion distanced from a front end of the hot-rolled steel plate by approximately 100 meters which has been subjected to finishing rolling is, however, rolled with no tensile force acting thereon until the front end reaches coilers 5*a* and 5*b*. Further, in this period, since traveling of the front end becomes unstable due to lifting and the like caused by collision with a carrier roll or a wind blast, rolling must be carried out by reducing a rolling speed to approximately half of that in the steady state (after reaching the coilers) in general.

Further, a shape of a rear end is also degraded because the tensile force becomes zero after it moves out from a final stand of the finishing mill 3. Such a non-steady portion is typically inferior to a steady portion in material and shape because cooling becomes uneven due to reduction in a temperature in conveyance or a defect of shape. Since rolling trouble caused due to such a defect of material and shape or meandering involved by the defect of shape lowers the capacity utilization ratio, this can be a serious adverse factor for reduction in the yield.

For improvement in the yield in finishing rolling, a method for connecting multiple sheet bars to each other to perform finishing rolling has been developed. For example, Japanese Patent Application Laid-open No. 84109-1992 proposes a method by which the front end of a sheet bar is sequentially coupled to the rear end of a preceding sheet bar so that finishing rolling is continuously performed to multiple sheet bars.

With this prior art technique, since rolling similar to that in the steady state is possible with respect to the coupled front and rear ends, the yield of the front and rear ends (non-steady portions) can be improved. Further, as to the front end portion, rolling can be performed at the same rolling speed as that in the steady state (after reaching the coilers), thereby improving the rolling efficiency. Furthermore, since a plurality of sheet bars are connected to each other to be rolled, the rolling efficiency can be more improved as compared with intermittent rolling.

Besides, there are also proposed other methods for manufacturing a long sheet bar such as a method for coupling multiple slabs or a method for directly rolling a continuously cast slab. As the method for coupling multiple slabs, Japanese Patent Application Laid-open No. 106403-1982 proposes a method by which a front end of a slab is sequentially coupled to a rear end of a preceding slab and the coupled multiple slabs are continuously rolled into a sheet bar by a planetary mill group.

Moreover, Japanese Patent Application Laid-open No. 92103-1984 proposes a method by which a slab whose amount corresponds to one steel converter is turned into a sheet bar by a rolling mill having a large thickness reduction amount to be wound around a coil as it is, and the coil of this sheet bar is then rewound to perform finishing rolling. Similarly, Japanese Patent Application Laid-open No. 85305-1984 proposes a method by which a slab cast by a special continuous casting machine (which is referred to as a rotary caster) at a high speed is turned into a sheet bar by rolling, it is once taken up to be wound in a rewinding machine and finishing rolling is thereafter carried out.

According to these conventional methods, crop cutting only at the front and rear ends of the long sheet bar can suffice, and the crop does not occur for each slab. The yield can be thus improved. Additionally, according to these methods, finishing rolling can obtain advantages similar to those in the method by which multiple sheet bars are connected to each other to perform finishing rolling.

These prior art techniques, however, have the following problems.

At first, in the method disclosed in Japanese Patent Application Laid-open No. 89109-1992, a part having a defective shape at the front and rear ends of the sheet bar must be cut off in order to connect the multiple sheet bars. The problem of reduction in the yield due to generation of the crop, therefore, remains. Further, a connected portion of the sheet bars has the strength lower than that of any other portion, and fracture at the connected portion in the middle of finishing rolling may force stoppage of the line. Furthermore, since the sheet bars are actually connected by welding, the structure of the connected portion becomes rough and large, which may possibly lead to generation of a defect of material or of a surface crack.

Moreover, in the method for coupling multiple slabs disclosed in Japanese Patent Application Laid-open No.

106403-1982, since the plate thickness of the slab to be coupled is large, it is difficult to completely couple the slabs in a short period of time. In addition, even if they are coupled in a short period of time, a hydrostatic pressure component as well as tensile stress may act on the coupled portion to cause peeling of the coupled surface when finishing rolling is conducted with a large thickness reduction amount. Therefore, the reduction amount must be decreased, and the efficiency of roughing rolling lowers.

Additionally, in the method for directly rolling a continuously cast slab disclosed in Japanese Patent Applications Laid-open Nos. 92103-1984 and 85305-1984, there is a problem that the efficiency of rolling is reduced due to limitation in a casting speed. According to the latter patent application, it is determined that the casting speed of 10 mpm is possible as the casting ability (weight per unit time), but there is actually no example reporting casting at such a high speed has achieved success in light of the operation and the quality.

As similar to the conventional techniques, in the method for directly rolling a continuously cast slab, a rolling speed of the roughing rolling mill at an initial stage is decreased to approximately several m/min at most owing to restriction in the casting speed. When this speed is converted into a number of roll revolutions of the rolling mill, it becomes approximately 1 rpm (1 $min^{-1}$), which is rolling at a very low speed. As a result, a roll of the rolling mill comes into contact with a material having a high temperature of approximately 1200° C. for a long period of time (several seconds). Therefore, surface cracking, deformation or seizure of the roll may disadvantageously occur. Therefore, aside from a small facility, the above method can not be realized in a facility which has a large scale for manufacturing a hot-rolled steel plate and the like and deals with a high-temperature material.

Additionally, if the method for winding the sheet bar around the coil is applied to a regular hot rolling factory for a thin plate, a size of the coil for sheet bars is assumed to be comparable to several product coils, which results in a huge coil whose weight is approximately 100 tons. As a result, the coiling facility such as a winding machine and the like can not help becoming large, which is a problem in light of the facility cost, a space in the factory and others.

2. In a hot-rolled steel plate manufacturing line (a hot strip mill) or a continuously cast and directly rolled steel plate manufacturing line, a plate thickness press apparatus for pressing and forging the slab in the plate thickness direction is provided between the heating furnace or the continuous casting machine and the roughing mill. As a result, the hot slab is pressed in the plate thickness direction by the plate thickness press apparatus so as to obtain a target plate thickness size, and it is subsequently roughing-rolled. Then, finishing rolling is applied to the slab. Such a plate thickness press apparatus and method are disclosed in, for example, Japanese Patent Application Laid-open No. 238401-1986 or 274305-1990.

In plate thickness pressing disclosed in Japanese Patent Application Laid-open No 238401-1986, however, plate thickness pressing is carried out after the slab is subjected to width reduction rolling, and the slab subjected to width reduction rolling has such an advantage as that the width hardly returns to an original value at the time of plate thickness pressing. This plate thickness pressing, however, does not specify a type of width reduction which is applied to the front and rear ends of the material. When the slab is simply subjected to width reduction rolling from the front end to the rear end and subsequently pressed along the plate thickness direction, the front end and the rear end of the slab transform into flare shapes as shown in FIG. 1(*b*), and these parts must be cut and removed in the post-step, thereby reducing the yield. Further, in the former plate thickness pressing, even if rolling in the width direction is carried out before plate thickness pressing, the high reduction ratio at the time of plate thickness pressing causes a fluctuation in the width of the stationary portion after plate thickness pressing irrespective of execution/omission of width rolling. Furthermore, a lap (two-fold) or a bulge such as shown in FIG. 1(*c*) is generated on the cross section at the front end corner portion in the longitudinal direction irrespective of execution/omission of width rolling.

On the other hand, in plate thickness pressing disclosed in Japanese Patent Application Laid-open No. 274305-1990, although plate thickness pressing is conducted after the slab is subjected to width reduction pressing, the reduction speed of plate width and plate thickness pressing is very much slower than that of rolling. Therefore, reduction in a temperature of the slab is large, and plate thickness pressing is not therefore practical.

Moreover, according to the conventional plate thickness pressing method for the hot slab, when the hot slab is pressed in the plate thickness direction by a die 6 as shown in FIGS. 2(*a*) to 2(*d*), the slab 20 is fed by a fixed feed amount f, and a following portion is subjected to plate thickness pressing by the die 6. This is further fed by a fixed feed amount f. This process is repeated. A press working surface of the die 6 is constituted by a parallel portion 6*a* and a tapered portion 6*b*. A one-stage taper is usually adopted. The die 6 having a taper angle θ of 10° to 15° (the taper angle is typically 12°) is often used. When the slab 20 is subjected to plate thickness pressing by the pressing apparatus having such a die 6, there occur forward elongation and backward elongation that the slab 20 is elongated forwards and backwards in the longitudinal direction as shown in FIG. 2(*b*). In the slab having such forward elongation and backward elongation generated, widthwise extension occurs in the non-steady portion in the flare form, and width distribution occurs at the steady portion in the wave-like form due to intermittent processes.

In the conventional plate thickness pressing method, if the taper angle θ is small, a widthwise extension quantity becomes large, and a load also tends to become large. In this case, the width distribution dW (=W'−W) is small. Although suppression of the widthwise extension and of increase in the load is possible by enlarging the taper angle, a slip may disadvantageously occur to the material during pressing depending on increase in the width distribution and pressing conditions.

There is also means for effecting transformation dispersion by using a tandem plate thickness pressing machine having multiple dies to reduce the plate thickness in plural stages, but this leads to a complicated and expensive apparatus.

Additionally, in the prior art, in case of reducing the thickness of the slab, the slab was caused to pass between rolls of a horizontal mill and subjected to thickness reduction by rolling. However, since a thickness which can be reduced by one rolling is small, multiple horizontal mills were provided at plural stages, or reverse rolling for reciprocating one horizontal mill was used. Such a method, however, results in a large-scale facility, a large installation space and large reduction in temperature of the slab which is being rolled. Thus, thickness reduction press for reducing the thickness by pressing at a stroke has been developed. However, when the thickness is largely reduced at a stroke, the reduced volume expands in the widthwise direction of the slab, thereby requiring forming in the widthwise direction.

Japanese Patent Application Laid-open No. 235002-1986 discloses an apparatus which performs width forming by providing vertical rolls on the downstream side of a thickness reduction press. FIG. 3 is a view showing a basic structure of this apparatus. In this drawing, there are provided a thickness reduction press 21 for sandwiching the slab 20 to press vertically arranged dies 21*a* by a cylinder 21*b*, and an edger 22 which is arranged on the downstream side of the thickness reduction press 21, provides rolls 22*a* with a flange on both widthwise ends of the slab 20 in the vertical direction and presses the rolls 22*a* with a flange in the widthwise direction. A regular rolling mill 23 is provided on the downstream side of the edger 22. With this arrangement, the slab 20 is pressed by the thickness reduction press 21 to reduce the thickness and widthwise extension is then corrected by the edger 22. Since the widthwise pressing by the edger 22 generates a dog bone that the width edge portion becomes thick, the dog bone is corrected by the rolling mill 23 arranged on the downstream side of the edger 22.

In the hot rolling facility having plate thickness reduction pressing apparatus provided therein, since an amount of reduction obtained by pressing is larger than that obtained by a rolling mill, a forming material such as a slab flows in the four directions as the thickness of the forming material is reduced. Paying notice to a width end portion in particular, this portion is formed into a corrugated shape larger than that obtained by rolling. When this end portion is rolled by a rolling mill group provided on the downstream side in this state, this corrugated shape is further amplified. In the prior art, therefore, as disclosed in the above patent application, an edger constituted by a vertical roll is arranged on the downstream side of the plate thickness reduction press to correct the corrugated shape of the width end portion. However, when an amount of reduction obtained by the thickness reduction press increases, the corrugated shape generated at the width end portion becomes also large. Even if the capability of the edger is increased, its function exceeds the limit, and the sufficient correction is impossible.

3. Further, the hot-rolled steel plate is generally manufactured from a hot slab by rolling and the like. In recent years, there has been developed a technique for applying forging to the hot slab by a die having a tapered portion in a material input side. As an example, there is a technique for forging from the plate thickness direction as similar to plate thickness pressing.

FIG. 4 shows a side elevation of a part of a general die used for forging the hot slab. It is to be noted that the die is composed of a pair of dies vertically arranged so as to sandwich the hot slab. FIG. 4, however, shows only the die on one side for the sake of convenience.

A side surface of the die 6 is a main processing surface constituted by a parallel portion 6*a* parallel to a material feeding direction, a tapered portion 6*b* inclined toward the input side with respect to the moving side of a material, and a transition area 6*c* between the parallel portion 6*a* and the tapered portion 6*b*. Here, an angle θ of the tapered portion 6*b* relative to the parallel portion 6*a* is generally 10 to 15 degrees.

Description will now be given as to a method for forging the hot slab by using such a die with reference to FIGS. 5(*a*) to (*c*). By this method, the die is moved in the vertical direction with respect to the material longitudinal direction (moving direction), i.e., a gap in the plate thickness direction of the material is periodically changed to then forge the material.

At first, the die 6 is arranged in the vertical direction with respect to the moving direction of the hot slab 20 as shown in FIG. 5(*a*), and the hot slab 20 is then fed toward the die 6 (the n-th pass, before pressing). Then, the hot slab 20 is pressed by the die 6 as shown in FIG. 5(*b*) (the n-th pass, during pressing). Subsequently, the die 6 is departed from the hot slab 20 as shown in FIG. 5(*c*), and the hot slab 20 is then fed by a predetermined amount (the (n+1)th pass, before pressing). It is to be noted that reference character H denotes a plate thickness of the hot slab 20 before pressing and h designates a plate thickness of the hot slab 20 after pressing in FIG. 5(*b*).

Further, besides the method illustrated in FIGS. 5, there is also a method by which the material is continuously moved in the longitudinal direction during pressing as similar to a flying type material and the die moves in the longitudinal direction in order to reduce a relative velocity to the material.

In the above-described forging method, however, a slip may occur during pressing, this is an operational problem. That is, in case of pressing the hot slab 20 from the state before pressing as shown in FIG. 6(A), there occurs a phenomenon such that the hot slab 20 moves backwards without being pressed as shown in FIG. 6(B). When a slip is generated, the hot slab 20 is not subjected to a process for a specified feed amount. A number of times of pressing must be, therefore, increased, which lowers the operation efficiency. Furthermore, a trace of the slip remains on the surface of the hot slab, which may deteriorate the surface quality of a product.

Japanese Utility Model Application Laid-open No. 5201-1993 discloses a pressing die which forms a groove, a protrusion or a bore on its surface coming into contact with the side surface of the slab and increases the friction coefficient to decrease a slip. In case of this utility model, however, the cost for processing the die is high or a frequency of replacement of the die is increased because of unavailability of the die due to abrasion of a worn groove. Moreover, since the groove or the protrusion on the die surface is transferred onto the surface of the material, this can readily cause a trace when forging the material in the plate thickness direction in particular.

Japanese Patent Application Laid-open No. 122706-1997 discloses a slip detection method for sizing press, by which a slip is detected from a press load or a feed amount of a carrier roll and restarts carriage of a material so as to obtain a specified feed amount when slip occurs. However, when forging a material from the plate thickness direction, the present invention has a problem that any damage to the material surface can not be avoided.

Further, as shown in FIGS. 5(*a*) to 5(*c*), in the conventional plate thickness press forging, the gap of the die 6 in a direction (namely, the plate thickness direction of the material) orthogonal to the material longitudinal direction (moving direction) is periodically changed while feeding the hot slab 20, thereby forging the plate thickness of the hot slab 20 to the plate thickness of the product. However, the hot slab 20 of, e.g., the flying type may continuously move in the longitudinal direction even during pressing, and the die 1 may move in the longitudinal direction in order to decrease the relative speed with respect to the hot slab 20.

When the die 6 is used to press the hot slab 20, the hot slab 20 elongates toward the upstream end side (die input side) and the downstream end side (die output side) in the longitudinal direction as shown in FIG. 5(*b*). Quantities of elongation of the material at the both ends are referred to as a backward elongation amount RW and a forward elongation amount FW, respectively.

In the conventional method, in order to reduce the load and uniform transformation in connection with sizing press, a lubricant is supplied to the entire surface of the die from the tapered portion 6*b* to the parallel portion 6*a* so that the friction coefficient of the die 6 with respect to the hot slab 20 can be reduced and the load can be decreased.

In the prior art method, however, a slip occurs between the die 6 and the hot slab 20, and hence the material can not be efficiently pressed. Further, reducing the friction coefficient lowers the forward elongation amount FW, and a number of times of pressing is increased to decrease the production efficiency.

Furthermore, although the above-described conventional method can be used to perform plate thickness pressing with a large reduction amount so that the plate thickness distortion across the plate width of the material becomes not less than 0.5, the excessive load is applied to the rolling mill at the time of plate thickness pressing. For example, according to provisional calculations by the present inventors in case of forging a soft steel slab with the plate thickness of 250 mm (or 256 mm) to 100 mm, the excessive load of approximately 5 ton is applied to the rolling mill in terms of a load (width load) per unit width (1 mm). When this is applied to the hot-rolled slab to perform conversion, the load of approximately 5000 ton is generated. Therefore, a very large load is applied on the press rolling mill. When the press rolling mill is used under such an excessive load, a frequency of occurrence of faults of the press rolling mill becomes high, thereby reducing the duration of life.

SUMMARY OF THE INVENTION

1. The present invention intends to solve the above-described various problems. That is, it is a first object of the present invention to provide a method and an apparatus for manufacturing a hot-rolled steel plate by plate thickness pressing capable of manufacturing a long sheet bar without joining sheet bars or slabs.

To achieve the first object, according to a preferred first apparatus embodiment of the present invention, there is provided an apparatus for manufacturing a hot-rolled steel plate by plate thickness pressing, comprising: a rough processing facility for performing a thickness reduction process to a hot slab cast by, for example, a continuous casting facility in order to obtain a sheet bar; a finishing mill group for rolling the sheet bar obtained by the rough processing facility to acquire a hot-rolled steel plate having a predetermined plate thickness; and a coiler for winding the hot-rolled steel plate, these members being arranged in the mentioned order, wherein the rough processing facility includes forging means using a pair of dies each of which includes an inclined portion on an input side and a flat portion on an output side as at least a part of the thickness reduction processing means, and width reducing means is provided on the upstream side of the thickness reduction forging means.

Further, according to a preferred first method embodiment of the present invention, there is provided a method for manufacturing a hot-rolled steel plate by plate thickness pressing, comprising: a rough processing step for performing a thickness reduction process to a continuously cast slab having a plate thickness H to obtain a sheet bar; a finishing rolling processing step for rolling the sheet bar to obtain a hot-rolled steel plate having a predetermined plate thickness; and a winding step for winding the hot-rolled steel plate after cooling, wherein the rough processing step at least partly includes a plate thickness press processing step by which a pair of dies each of which includes an inclined portion on an input side and a flat portion on an output side and a plate thickness reduction ratio r is not less than 30%, and width reduction whose amount is not less than a width reduction amount determined by the following expression is applied to a material before the plate thickness press processing:

$$\text{Width reduction quantity}=fn(r;\ H)$$

The present invention presses a continuously cast slab in the plate thickness direction in place of performing rolling as a preliminary stage of roughing rolling. In this case, the plate thickness direction reduction ratio r is determined as not more than 0.3 in view of a generation ratio of internal defects such as a casting defect.

Subsequently a pair of vertical dies 6 each of which has a tapered portion 6*b* on an input side and a parallel portion 6*a* on an output side shown in FIG. 4 are used to perform the plate thickness pressing process. The tapered portion 6*b* is provided on the input side of the die 6 so as not to generate a step on the surface of a material at the end of the die 6. A material which comes into contact with the tapered portion 6*b* on the input side of the die has a reduction ratio r which continuously varies. This ratio is not less than 0.3 in the parallel portion 6*a* and becomes zero (r=0) in a non-contact portion. A trouble such as cracks on the surface due to generation of a step can be, therefore, avoided.

When the thickness of the material is reduced by the plate thickness pressing process, the reduction strain is distributed in the plate thickness direction of the material. The distribution becomes large in the plate width central portion where the plane strain can be observed, whilst the distribution is small in the plate end portion where the plane strain causing the widthwise deformation can be observed. Accordingly, evaluating the internal quality improvement effect by using a maximum value of the reduction strain distribution, the internal quality improvement effect is small at the plate end portion.

Therefore, reduction in the widthwise direction is carried out before the plate thickness pressing process, and a large plate thickness called a dog bone is formed at the plate end portion. Moreover, the plate thickness press processing is effected after increasing the plate thickness of the plate end portion. As a result, the reduction strain at the plate end portion can be increased to impart the internal quality improvement effect equivalent to that at the plate central portion.

Additionally, according to a preferred second method embodiment of the present invention, there is provided a method for manufacturing a hot-rolled steel plate by plate thickness pressing, wherein when a pair of dies each of which includes an inclined portion on an input side and a parallel portion on an outlet side are used to perform a plate thickness pressing process with a reduction ratio in a plate thickness direction of not less than 30% with respect to a continuously cast slab, a contact length L of the parallel portion of the die in a longitudinal direction falls within a range of 0.2 to 0.4 fold of the plate thickness of the slab on the inlet side at a front end of the slab, and continuous roughing rolling and subsequent finishing rolling are applied to the slab which has been subjected to the plate thickness press process, thereby obtaining a hot-rolled steel plate.

In the present invention, the continuously cast slab is pressed in the plate thickness direction instead of being subjected to rolling as a preliminary stage of roughing rolling. The reduction ratio of the plate thickness pressing is determined to be not less than 30% in view of a generation ratio of internal defects such as a casting defect. When the reduction ratio is determined to be not less than 30% in this manner, the generation ratio of internal defects can be decreased to 0.01% or lower.

As similar to the rolling process, the plate thickness pressing process causes the plate thickness central portion to protrude forwards from the both sides (generation of a bulge 28) or cave at an end portion of the material or, in particular, at the front end so that the outer surfaces overlap each other at the end portion (generation of a lap 27). The thus deformed portion must be cut and removed as a crop at a stage of a sheet bar after roughing rolling. In particular, as shown in FIG. 16(*a*), when the lap 27 is generated at the front end of the hot slab 20, this lap may cause a folded plate. The lap must be, therefore, completely removed.

The present inventors have eagerly studied about deformation of the hot slab at the front end and discovered that the deformation behavior of the front end varies depending on the plate thickness pressing process conditions. First of all, as a tendency as a whole, when the tapered portion 6*b* of the die comes into contact with the front end of the slab, the generation ratio of the lap 27 shown in FIG. 16(*a*) increases. When the parallel portion 6*a* of the die is brought into contact with the front end of the slab, both the lap 27 and the bulge 28 may occur as shown in FIG. 16(*c*).

As a result of the study, the present inventors have found that both a size of the lap 27 (length in the slab longitudinal direction) and a size of the bulge 28 can be adjusted by using a length L (which will be referred to as a "contact length L" hereinafter) of the front end of the slab which comes into contact with the parallel portion 6*a* of the die shown in FIG. 15. That is, as shown in FIG. 17, the lap 27 is readily generated in an area in which the contact length L is short. The generation frequency and the size of the lap 27 are decreased as the contact length L becomes long. On the contrary, the generation frequency and the size of the bulge 28 are increased as the contact length L becomes long. Therefore, by appropriately setting the contact length L, the generation frequencies of the lap 27 and the bulge 28 can be decreased to a low level. In addition, sizes of these non-steady deformation portions (length in a pass line direction) can be decreased.

Moreover, as a result of the strenuous study, the present inventors have unveiled that deformation of the front end of the slab largely depends on the plate thickness H of the hot slab 20 as well as the contact length L. Based on such information, the present inventors have completed the method according to the present invention, by which the contact length L and the plate thickness H are used to estimate a size of deformation at the front end of the slab (the lap 27 and the bulge 28).

FIG. 17 shows its result. In FIG. 17, a horizontal axis shows a ratio L/H of the contact length and the plate thickness, and a vertical axis illustrates a lap length L1 and a bulge length L2. FIG. 17 is a characteristic diagram showing a result of examining the influence of the contact length L and the plate thickness H on the lap length L1 and the bulge length L2. In the figure, a white triangle indicates generation of the lap 27, while a white square indicates generation of the bulge 28. Further, in the figure, a curve E corresponds to a characteristic line obtained by integrating areas in which the bulge 27 frequently occurs by the least squares method, and a curve F corresponds to a characteristic line obtained by integrating areas in which the lap 27 frequently occurs by the least squares method.

As apparent from FIG. 17, the dimension L1 of the lap 27 becomes long as the ratio L/H of the contact length L to the plate thickness H becomes smaller. On the contrary, the dimension L2 of the bulge 28 becomes long as the ratio L/H becomes large. In an intermediate area, although the lap 27 or the bulge 28 is generated, it is considered that this generation is caused due to irregularities in the temperature distribution.

When a range in which the generation frequencies of both the lap 27 and the bulge 28 lowers in the intermediate area is obtained from FIG. 17, the ratio L/H is not less than 0.2 and not more than 0.4 in that range. Based on this, the manufacturing method according to the present invention controls the plate thickness press processing of the front end of the slab in such a manner that the ratio L/H falls within the range of 0.2 to 0.4.

Further, if the ratio L/H is zero, i.e., if the front end of the slab 20 does not abut with the parallel portion 6*a* of the die but comes into contact with the tapered portion 6*b*, the generation frequency of the lap 27 is increased. In the actual operation, if the front end of the slab comes into contact with the inclined portion of the die, the hot slab 20 slips similarly as in the case of a nipping defect in the rolling process. This is not preferable because the pressing operation does not smoothly proceeds. As in the method according to the present invention, setting the ratio L/H in the range of 0.2 to 0.4 in light of the working property can obtain preferable results.

Further, in the present invention, since deformation of the front end of the slab can be controlled by pressing conditions, an excellent shape can be expected by roughing rolling. In general, the shape of the front end of the slab after rolling largely varies due to a temperature distribution of the slab, and the lap 27 occurs when a corner portion of the slab is excessively heated. On the contrary, when a surface temperature of the slab is lowered, generation of the bulge 28 can not be avoided. Accordingly, in the present invention, if the corner portion of the slab 20 is overheated, the contact length L is set longer to suppress generation of the lap 27 and minimize the lap size L1. On the other hand, when the surface temperature of the slab 20 is lowered, the contact length L is set shorter to suppress generation of the bulge 28 and minimize the bulge size L2.

Moreover, according to the present invention defined in a preferred third method embodiment, there is provided a method for manufacturing a hot-rolled steel plate by plate thickness pressing, wherein a pressing process with a reduction ratio of not less than 0.5 is applied to a continuously cast slab in a plate thickness direction by using a pair of dies each of which includes an inclined portion on an input side and a flat portion on an output side, pressing process conditions at this time are set in a range satisfying the following inequality represented by a contact length L of the inclined portion of the die and a material in a longitudinal direction, a feed quantity f, a plate width W before processing, a volume V to be processed by the parallel portion of the die, a plate width on the output side h, and a reduction strain $\epsilon$, roughing rolling is continuously applied to the slab after pressing process, and finishing rolling is subsequently applied to the same to obtain a hot-rolled steel plate:

$$\epsilon L/W < A \quad (1)$$

$$V\epsilon/(Wfh) < B \quad (2)$$

where A and B are constants.

The present invention performs pressing to a continuously cast slab in the plate width direction instead of carrying out rolling as a preliminary stage of roughing rolling. In this case, the reduction ratio is determined to be not less than 0.5 in light of a generation ratio of internal defects such as a casting defect. As will be described later, it is desirable that the generation ratio of internal defects is set to 0.001% or lower in order to obtain the high quality. In the present invention, setting the reduction ratio to not less than 0.5 suppresses the generation ratio of internal defects to 0.001% or lower.

Although a pair of dies each of which has an inclined portion on an input side and a flat portion on an output side are then used to conduct pressing process. The inclined portion is provided on the input side of the die in order to prevent a step from being formed on the material at an end of the die. At the portion which has come into contact with the inclined portion of the die on the input side, the reduction ratio continuously changes from 0.5 or above in the flat portion to 0 in the non-contact portion, and a trouble such as a crack on the surface due to generation of a step can be hence avoided.

In the meanwhile, since the plate width of a material is increased by the pressing process, it is desirable to suppress its increasing amount as much as possible. As a result of earnestly examining factors influencing an increasing amount of the plate width, it was found that an aspect ratio of the material coming into contact with the inclined portion of the die, i.e., a ratio L/W of the contact length L in the longitudinal direction and the plate width W largely influences. It was discovered that an increasing amount of the plate width can be substantially adjusted by a product of this ratio L/W and the reduction strain $\epsilon$ as will be described later. Consequently, setting the value $\epsilon L/W$ to a fixed value A or lower can suffice suppression of an increasing amount of the plate width to a predetermined value. When representing this by a formula, the above-described expression (1) is obtained.

As to the plate width in the longitudinal direction, it was unveiled that it slightly fluctuates due to a difference in a position where the material is brought into contact with the die. As a result of examining factors influencing this fluctuation of the plate width, it was found that the fluctuation relates to the processing status obtained from the flat portion of the die. It was consequently discovered that the fluctuation of the plate width is in proportion to the reduction strain obtained by only the flat portion and the overall reduction strain.

The processing strain obtained by only the flat portion can be estimated by a processing amount of a portion processed by the flat portion and the plate width h after processing. This processing amount can be expressed as a mean value using a ratio of a volume V and an area of the portion processed by the flat portion. Since an area of a portion processed by the flat portion is a product of the plate width W and a feed amount f, a processing amount of the portion processed by the flat portion can be expressed as V/(Wf).

As a result, the processing strain caused by only the flat portion is V/(Wf)/h or V/(Wfh). It was discovered that a fluctuation amount of the plate width can be substantially adjusted-by a product $V\epsilon/(Wfh)$ of the ratio V/(Wfh) and the reduction strain $\epsilon$, as will be described later. After all, setting the value $V\epsilon/(Wfh)$ to a fixed value B or lower can suffice suppression of a fluctuation amount of the plate width to a predetermined value. When this is expressed by a formula, the above-described expression (2) is obtained.

2. It is a second object of the present invention to provide a plate width pressing apparatus and method capable of: (1) effectively preventing a flare from being produced at front and rear ends, preventing a steady portion width distribution, and effectively preventing a lap (two-fold) at a front end corner portion of a material; (2) minimizing a width distribution dw and suppressing increase in a load during pressing even if the material is pressed with a high reduction amount; and (3) modifying extension of a slab in a widthwise direction even if pressing with large reduction in thickness is used.

When the slab 20 shown in FIG. 1(*a*) is subjected to plate thickness pressing, an intermittent process by which the thickness is reduced in accordance with each fixed segment is carried out. Therefore, front and rear ends 20*a* of the slab are deformed in the flare shape as shown in FIG. 1(*b*). Further, a bulge or a lap (two-fold) is formed at the width central portion in the longitudinal cross section of the slab front end depending on pressing conditions. Prevention for such deformation is possible to some degree by adjusting the pressing conditions. However, the lap is formed at a corner portion of the front and rear ends as shown in the right-hand side of FIG. 1(*c*) irrespective of pressing conditions, and the lap must be cut and removed in the post-step.

As a countermeasure, the present inventors have eagerly studied about a deformation generation mechanism in a non-steady portion and consequently completed the present invention described below.

That is, to achieve the second object, according to the present invention defined in a preferred fourth method embodiment, there is provided a plate thickness pressing method for pressing a substantially rectangular material in a widthwise direction to adjust the width before performing plate thickness pressing to the substantially rectangular material in the plate thickness direction by using a die having a main processing surface consisting of at least an inclined portion on an input side and a parallel portion following the inclined portion with respect to the substantially rectangular material, wherein at least one of a front end and a rear end of the substantially rectangular material is pre-formed.

Further, according to the present invention defined in a preferred fifth method embodiment, in such a case, a non-steady width change quantity $\Delta W$ and a non-steady length $\Delta L$ produced in at least one of the front end and the rear end of the material by plate thickness pressing may be predicted by using the following expressions and the front end of the substantially rectangular material may be previously formed based on this prediction:

$$\Delta WH = f1(W, \epsilon, Ldt),\ \Delta WT = f2(W, \epsilon, Ldt)$$

$$\Delta LH = g1(W, h, Ldt),\ \Delta LT = g2(W, H, Ldt)$$

where, $\Delta WH$ represents a predicted non-steady width change amount generated at the front end in a rectangular material moving direction by plate thickness pressing; $\Delta WT$, a predicted non-steady width change amount generated at the rear end in the rectangular material moving direction by plate thickness pressing; $\Delta LH$, a predicted non-steady length generated at the front end in the rectangular material moving direction by plate thickness pressing; $\Delta LT$, a predicted non-steady length generated at the rear end in the rectangular material moving direction by plate thickness pressing; H, a plate thickness of the substantially rectangular material on a press input side; h, a plate thickness of the substantially rectangular material on a press output side; $\epsilon(=\log(H/h))$, a plate thickness strain; Ldt, a contact length of the material and the press die in the longitudinal direction; and W, a plate thickness of the substantially rectangular material.

Additionally, according to a preferred sixth method embodiment of the present invention, pre-forming may be previously effected to provide a distribution to the plate width of the steady portion of the substantially rectangular material.

Further, according to a preferred seventh method embodiment of the present invention, a steady portion plate width distribution amount dW generated due to plate thickness pressing and its pitch dL may be predicted by using the following expressions and pre-forming may be performed to provide a distribution to the plate width of the substantially rectangular material steady portion based on this prediction. At this time, in the expressions dW=F(V, W, h, f, ϵ) and dL=G(H, h, f), H represents a plate thickness of the substantially rectangular material on the press input side; h, a plate thickness of the substantially rectangular material on the press output side; ϵ(=log(H/h)), a plate thickness strain; W, a plate width of the substantially rectangular material; f, a feed amount of the substantially rectangular material at the time of plate thickness pressing; and V, a reduction volume of the parallel portion of the die.

Moreover, according to a preferred eighth method embodiment of the present invention, the front end and the rear end of the substantially rectangular material may be previously formed in advance and pre-forming may be conducted to provide a distribution of the plate width of the steady portion of the substantially rectangular material.

Furthermore, according to a preferred ninth method embodiment of the present invention, a non-steady width change amount ΔW and a non-steady length ΔL generated in at least one of the front end and the rear end of the substantially rectangular material by the plate thickness pressing, a width distribution dW of the steady portion and its pitch dL may be predicted by using the following expressions, the front end and the rear end of the substantially rectangular material are pre-formed based on the prediction, and pre-forming may be performed to provide a plate width distribution of the substantially rectangular material steady portion:

where, $\Delta WH=f1(W,\epsilon,Ldt)$, $\Delta WT=f2(W,\epsilon,Ldt)$ $\Delta LH=g1(W,h,Ldt)$, $\Delta LT=g2(W,H,Ldt)$ $dW=F(V,W,h,f,\epsilon)$ $dL=G(H,h,f)$, and ΔWH represents a predicted non-steady width change amount generated at the front end in the rectangular material moving direction by plate width pressing; ΔWT, a predicted non-steady width change amount generated at the rear end in the rectangular material moving direction by plate thickness pressing; ΔLH, a predicted non-steady length generated at the front end in the rectangular material moving direction by plate thickness pressing; ΔLT, a predicted non-steady length generated at the rear end in the rectangular material moving direction by plate thickness pressing; H, a plate thickness of the substantially rectangular material on the press input side; h, a plate thickness of the substantially rectangular material on the press output side; ϵ(=log(H/h)), a plate thickness strain; W, a plate width of the substantially rectangular material; f, a feed amount of the substantially rectangular material at the time of plate thickness pressing; V, a reduction volume of the parallel portion of the die; Ldt, a contact length of the substantially rectangular material and the press die in the longitudinal direction; H, a plate thickness on the material input side; and h, a plate thickness on the material output side.

According to preferred tenth and eleventh method embodiments of the present invention, the above-described width adjustment can be performed by a vertical rolling mill capable of changing an opening during processing. In this case, it is preferable to use a caliber roll.

According to a preferred twelfth method embodiment of the present invention, the above-described width adjustment can be carried out by a widthwise pressing machine which can be tandem with the plate thickness press. In this case, plate thickness forming and plate width forming can be sequentially performed.

According to the present invention defined in a preferred second apparatus embodiment, there is provided a plate thickness press apparatus comprising: a die having a main processing surface consisting of at least an inclined portion on an input side and a parallel portion following the inclined portion with respect to a substantially rectangular material; means for feeding the substantially rectangular material to the die; a plate thickness pressing device for driving the die to press in a plate thickness direction of the substantially rectangular material; and a vertical rolling mill which is provided on the pass line upstream side away from the plate thickness pressing device and can change an opening during processing.

Further, according to the present invention defined in a preferred third apparatus embodiment, there is provided a plate thickness press apparatus comprising: a die having a main processing surface consisting of at least an inclined portion on an input side and a parallel portion following the inclined portion with respect to the substantially rectangular material; means for feeding the substantially rectangular material to the die; a plate thickness pressing device for driving the die to press in a plate thickness direction of the substantially rectangular material; and a widthwise direction pressing device which is provided on a pass line upstream side away from the plate thickness pressing device and arranged at a possible where it can be tandem with the plate thickness pressing device.

Moreover, according to the present invention defined in a preferred thirteenth method embodiment, there is provided a plate thickness pressing method for performing cast and reduction in thickness while sequentially feeding a plate thickness of a substantially rectangular hot slab in a longitudinal direction, comprising: a main processing step for reducing a plate thickness H of the hot slab before pressing to a plate thickness h after pressing by a die having a main processing surface consisting of at least an input side tapered portion and a parallel portion; and a sub processing step for performing thickness reduction pressing in the plate width direction to a portion which is to be pressed by a transition portion corresponding to a boundary between the tapered portion and the parallel portion of the die having the main processing surface and a portion in the vicinity of the former portion before the main processing step.

Incidentally, according to a preferred fourteenth method embodiment of the present invention, assuming that a feed amount of the material is f and a material backward elongation amount at the time of pressing is BW in the sub processing step, it is preferable to press in the plate thickness direction a portion which is positioned on the upstream side away from the portion to be pressed by the transition portion by a distance determined by the following expression:

$$(0.9 \text{ to } 1.1)\times f+(f-BW)\times n$$

where n is a positive integer.

Furthermore, according to a preferred fifteenth method embodiment of the invention, assuming that a feed amount of the material is f, the portion to be subjected to thickness reduction pressing in the sub processing step is a portion positioned on the upstream side away from the transition portion by a distance of (0.9 to 1.1)×f, and it is preferable to alternately perform the sub process and the main process.

In addition, according to a preferred sixteenth method embodiment of the present invention, assuming that a ratio of a thickness reduction amount by the sub process to a thickness reduction amount by the main process is r, it is preferable to set the thickness reduction amount by the sub process to be equal to or above $(H-h)\times r(r\geqq 0.025)$.

Further, according to a preferred seventeenth method embodiment of the present invention, assuming that a ratio of a thickness reduction amount by the sub process to a thickness reduction amount by the main process is r, it is desirable that the sub process is started when the thickness reduction amount by the main process exceeds $(H-h)\times(1-r)$. Furthermore, according to a preferred eighteenth method embodiment of the present invention, the main process and the sub process are simultaneously executed by using the same die. As a result, a number of dies can be reduced.

Moreover, to achieve the second object, according to the present invention defined in a preferred nineteenth method embodiment of the invention, a thickness of a slab is reduced by a thickness reduction press, and a width of the same is reduced by a width reduction press after releasing the thickness reduction press.

The thickness reduction press is used to reduce the thickness of the slab, and the width reduction press is then used to reduce the width of the slab. Since the width reduction press can increase the reduction capability, correction is enabled even if corrugated expansion deformation is large in the widthwise direction. Additionally, by operating the width reduction press when reduction is not carried out by the thickness reduction press, capacities of power sources of the both presses can be equal to a capacity of the thickness reduction press which is larger than that of the other press.

In addition, according to the present invention defined in a preferred fourth apparatus embodiment, there are comprised: a thickness reduction press for reducing a thickness of a slab; a width reduction press which is provided on the downstream side of the thickness reduction press and reduces a width of the slab; and a controller for operating the width reduction press when the thickness reduction press is released.

The thickness reduction press is first used to press the slab in order to reduce the thickness of the slab. A volume of the slab flows in four directions due to this thickness reduction, and corrugated expansion deformation is generated in the widthwise direction. The deformed portion is straightened and pressed by the thickness reduction press so as to obtain a predetermined width. The controller alternately operates the thickness reduction press and the width reduction press in such a manner that the both presses are not operated at the same time. Thus, capacities of power sources of the both presses can be reduced.

According to the present invention defined in a preferred fifth apparatus embodiment, a width measuring instrument for measuring a slab width is provided on the downstream side of the width reduction press, and the controller adjusts an opening of the width reduction press so that a measured value of the width measuring instrument becomes a predetermined value.

Although the controller sets an opening indicating a gap between dies of the width reduction press in order to control the width reduction press, the set value is constantly corrected based on the measured value of the width of the slab subjected to width reduction so as to obtain a predetermined slab width. The width of the slab expands beyond the gap between the dies when being pressed. Since this expansion amount varies depending on a temperature or a substance of the slab, a width of the slab before slab thickness reduction, a thickness reduction amount and others, such an opening as that a predetermined slab width can be obtained is predicted based on these conditions and the slab width measured value, and a direction is given to the width reduction press. In case of performing such prediction, the controller uses a learning calculation function for learning and predicting the relationship between the previous prediction and the measured value.

3. Moreover, it is a third object of the present invention to provide a plate thickness pressing method capable of: (1) preventing a slip from occurring at the time of pressing by forging a contact start surface between a hot slab and a die as a transition area between a tapered portion and a parallel portion and a part of the parallel portion without a need of a special forming process; (2) assuring a desired forward elongation amount in forging of a hot slab by using a die having a main processing surface consisting of a tapered portion on an input side and a substantially parallel portion such as a plate thickness press, reducing a generation frequency of slips between the die and a material, and decreasing a load applied to a press rolling mill.

To achieve the third object, according to the present invention defined in a preferred twentieth method embodiment, there is provided a hot slab manufacturing method for forging a hot slab by using a die having a main processing surface consisting of a tapered portion inclined in an input side direction with respect to a moving direction of the hot slab and a parallel portion which follows the tapered portion and is parallel to the moving direction, wherein a contact start surface of the hot slab and the die is a transition area between the tapered portion and the parallel portion and a part of the parallel portion.

Further, according to the present invention defined in a preferred twenty-first method embodiment, it is preferable to apply a lubricant on at least the contact surface relative to the hot slab in the main processing surface of the die.

This is based on the fact that use of the lubricant is very effective for reducing the load because a slip does not occur even if the friction coefficient is lowered in case of abutting from the parallel portion of the die. Here, as the lubricant, any kind of material can be used as long as it is a hot lubricant which acts to lower the friction coefficient, such as a mixture of a mineral oil (grease) and a solid lubricant, e.g., black lead, molybdenum disulfide or graphite, or solo use of the mineral oil. As to a position on which the lubricant is applied, although the lubricant is applied on at least the contact surface relative to the hot slab in the main processing surface of the die, the lubricant may be applied on a part of the die along the longitudinal direction and/or the widthwise direction or on the entire surface. Incidentally, changing the friction coefficient by processing a groove and the like on the surface of the die is not desirable since the surface of the die is transferred onto a material, which may cause a scratch.

In addition, as a method for applying the lubricant to the tapered portion of the die for example, a material is forged and a gap of the die is opened once. The lubricant is then sprayed toward the tapered portion of the die from the material input side direction by a nozzle while moving the material by a specified amount for forging of the next pass. On the other hand, the lubricant is similarly applied to the parallel portion of the die from the material output side. In the similar manner, spraying the lubricant from an end of the die in the widthwise direction enables the lubricant to be applied on both the tapered portion and the parallel portion of the die.

In the present invention, since the forged material extends in the input and output side directions, it is desirable that the parallel portion of the die has a length equal to or above a feed amount at the time of pressing. In addition, if the present invention is used for the steady portion in particular for pressing the front end to the rear end of the hot slab through the steady portion, a slip can be avoided, which is effective.

Further, according to the present invention defined in a preferred twenty-second method embodiment, there is provided a plate thickness pressing method, wherein when forging a hot slab by using a die having a main processing surface consisting of at least an input side tapered portion and a parallel portion, a lubricant is supplied only to the parallel portion of the die to decrease the friction coefficient between the hot slab and the die.

If a forward elongation amount FW is large when subjecting the hot slab 20 to plate thickness pressing, a number of times of pressing is reduced, which is further effective. The forward elongation amount FW largely depends on the friction coefficient between the die 6 and the hot slab 20. Since the lubricant is supplied only to the parallel portion 6*a* of the die in the present invention, necessary frictional force is generated in the tapered portion 6*b*, and the forward elongation amount FW is increased without causing a slip in the hot slab 20.

Other objects and advantageous features of the present invention will be apparent from the following description with reference to the accompanying drawings.

BRIEF DESCRIPTION OF THE DRAWINGS

FIG. 40 is a characteristic diagram for illustrating results and advantages of the present invention;

FIG. 41 is a characteristic diagram for illustrating results and advantages of the present invention;

FIG. 42 is a view for illustrating results and advantages of the present invention;

FIG. 54 is a view for illustrating results and advantages of the present invention;

DETAILED DESCRIPTION OF THE PREFERRED EMBODIMENTS

Preferred embodiments according to the present invention will now be described hereinafter with reference to the accompanying drawings.

(First Group of Embodiments)

Figure 9:
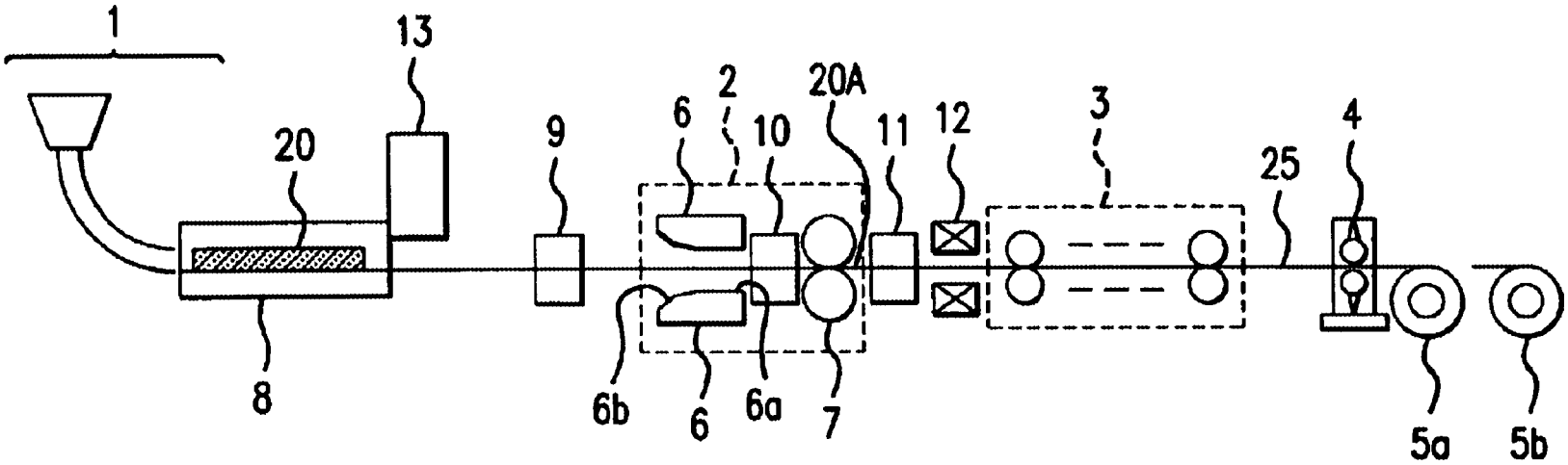
FIG. 9 is a view showing an outline of an apparatus for manufacturing a hot-rolled steel plate by plate thickness pressing according to a first preferred apparatus embodiment of the present invention.

FIG. 9 is a view schematically showing an apparatus for manufacturing a hot-rolled steel plate by plate thickness pressing according to a preferred first apparatus embodiment of the present invention. A slab 20 continuously cast by a continuous casting machine 1 is heated in a target temperature zone by a heater 13 and subjected to width reduction rolling by a width reduction device 9. The slab 20 is then subjected to a plate thickness press process in a rough processing facility 2 and roughing-rolled by a roughing mill 7 to be made into a sheet bar 20A. The long sheet bar 20A is subjected to temperature adjustment by a warmer 11 and a heater 12 and then led to a finishing mill 3 where the sheet bar 20A is subjected to finishing rolling until a target thickness is acquired. As a result, a steel plate is obtained. Further, the steel plate is finally wound by coilers 5*a* and 5*b* through a cutter 4.

The width reduction device 9 is constituted by a pair of horizontal edger rollers for rolling the slab 20 from the widthwise direction or a pair of horizontal sizing presses for pressing the slab 20 from the widthwise direction.

The rough processing facility 2 includes a plate thickness pressing device having a pair of vertical dies 6, a warmer 10, and a roughing mill 7. The elongated continuously cast slab 20 is press-forged by the dies 6 in the plate thickness direction and roughing-rolled by the roughing mill 7 while being held at a predetermined temperature by the warmer 10. It is to be noted that the press process in the plate thickness direction is repeatedly carried out while intermittently feeding the hot slab 20 by a predetermined feed amount f.

Figure 10:
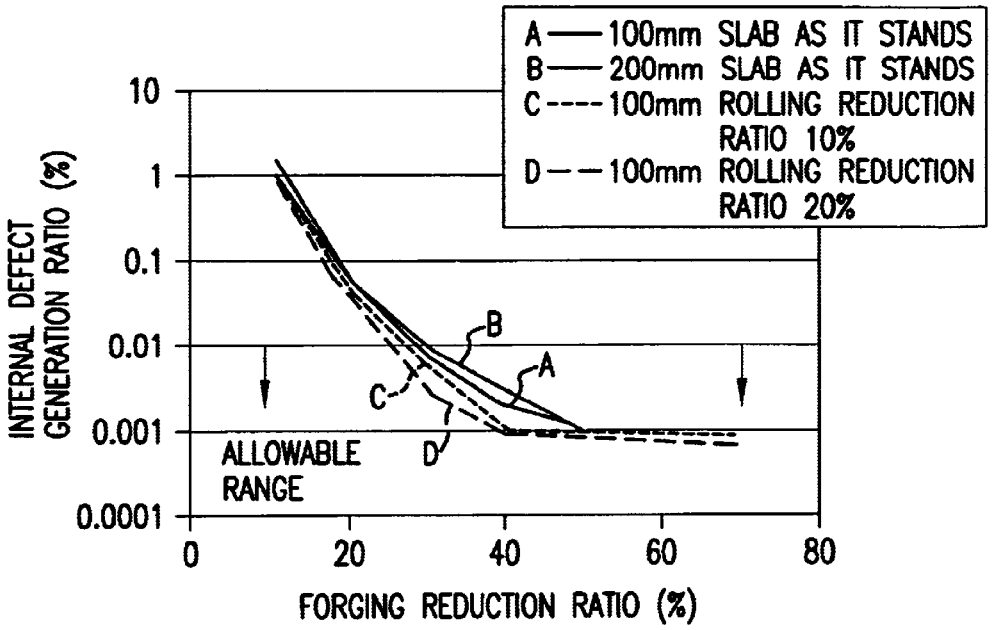
FIG. 10 is a characteristic diagram showing the correlation between a forging reduction ratio r (%) and an internal defect generation ratio (%)

FIG. 10 is a characteristic diagram in which a horizontal axis represents a forging reduction ratio (plate thickness press reduction ratio r) (%) and a vertical axis represents an internal defect generation ratio (%). FIG. 10 shows a result of examining the correlation between the both ratios under various conditions. As a material, continuously cast slabs having plate thicknesses of 100 mm and 200 mm were used. As the slab having the plate thickness of 100 mm, there were used a slab having a rolling reduction ratio of 10%, a slab having the rolling reduction ratio of 20%, and a slab which was just cast. A generation ratio of internal defects is obtained by the usual metallographic inspection (macro-galvanic method). In the drawing, a curve A indicates a result of the slab having the plate thickness of 100 mm which was just continuously cast; a curve B, a result of the slab having the plate thickness of 200 mm which was just continuously cast; a curve C, a result of the slab having the plate thickness of 100 mm which was rolled with the reduction ratio of 10%; and a curve D, a result of the slab having the plate thickness of 100 mm which was rolled with the reduction ratio of 20%. As apparent from the drawing, it was found that, in case of all the materials, the internal defect generation ratio becomes lower than 0.01% which is an allowable value when the reduction ratio is not less than 30%.

Figure 11:
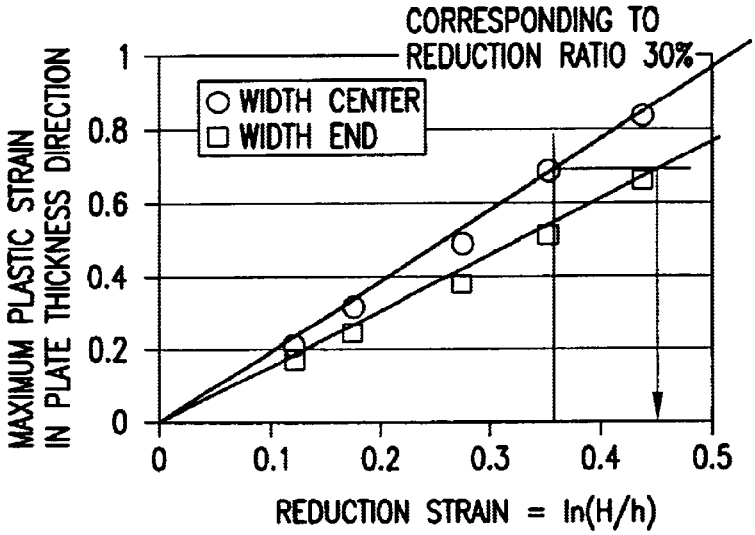
FIG. 11 is a characteristic diagram showing the correlation between a reduction strain (=1n(H/h)) of a material generated during a plate thickness pressing process and a maximum plastic strain in a plate thickness direction.

FIG. 11 is a characteristic diagram in which a horizontal axis represents a reduction strain (=1n(H/h)) of a material generated during plate thickness pressing and a vertical axis represents a maximum plastic strain in the plate thickness direction. FIG. 11 shows a result of examining the correlation of the both strains at a width central portion and an end portion in the widthwise direction of the elongated material. As apparent from the drawing, when the reduction ratio r of the press process in the plate thickness direction is 30%, a plate thickness central portion has a reduction strain (approximately 0.357) corresponding to the reduction ratio of 30% and a maximum strain in the plate thickness direction of approximately 0.68. However, the reduction strain of the end portion in the widthwise direction must be increased by 0.1 in order that the end portion in the widthwise direction has the equivalent maximum strain in the plate thickness direction.

Figures 12, 13:
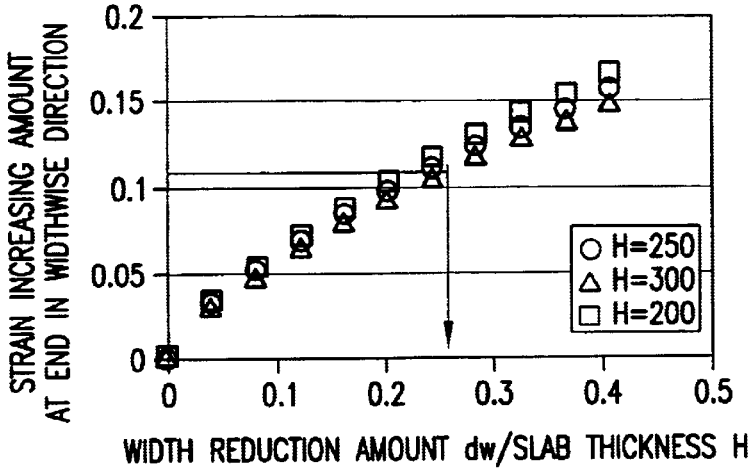
FIG. 12 is a characteristic view plotting a result of each increasing amount of a reduction strain at the time of plate thickness pressing by increasing a plate width of an end in a widthwise direction by width rolling.
FIG. 13 is a view showing an advantage of the present invention.

FIG. 12 shows a characteristic view in which a horizontal axis represents a value dw/H obtained by dividing a width reduction amount dw when subjecting the slab with the thickness H to width reduction rolling by the thickness H of the slab and a vertical axis represents a strain increasing amount of the end portion in the widthwise direction. FIG. 12 plots each increasing amount of the reduction strain at the time of the plate thickness press process. In the drawing, a white circle indicates a result of the slab having the thickness H of 250 mm; a white triangle, a result of the slab having the thickness H of 300 mm; and a white square, a result of the slab having the thickness H of 200 mm in the plot style. As apparent from the drawing, the reduction strain increasing amount is in substantially direct proportion to the width reduction amount. Based on such a relationship of the both amounts, the width reduction amount must be not less than ¼ of the slab thickness H in order to increase the reduction strain of the end portion in the widthwise direction by 0.1. It is to be noted that such a direct proportion relationship of the both amounts is the same in the sizing press.

On the other hand, if the reduction strain is 0.45 (corresponds to the reduction ratio of approximately 36%), the plate thickness pressing process can provide the plate thickness reduction strain which is sufficient for the internal quality improvement without adding the width reduction strain.

Therefore, the width reduction amount is determined by a function of r and H (i.e. width reduction amount=fn(r,H)). When the width reduction amount required for the plate thickness direction press reduction ratio r (where r>0.3) is going to be represented by a simplified formula, the following expression (3) can be obtained, for example:

$$\text{Width Reduction Amount}=\max\{(H/4)\times(0.36-r)/0.06,0\} \quad (3)$$

Incidentally, if a distance from the width reduction device 9 to the die 6 of the plate thickness pressing device is longer than the slab length and both the width reduction and the plate thickness pressing are not simultaneously conducted, it is desirable to apply width reduction rolling with a high processing speed in light of both the temperature drop of the material and the efficiency of manufacture.

In addition, when the width reduction and the plate thickness pressing are simultaneously carried out, the width reduction rolling may be used or the sizing pressing may be used.

FIG. 13 is a view showing a width rolling amount (mm), a plate thickness press process reduction ratio (%) in the slab width central portion, the evaluation of an internal defect in the slab width central portion, and the evaluation of an internal defect in the slab width direction end portion, respectively. FIG. 13 illustrates an advantage of the present invention by comparing various embodiments according to the present invention with comparative examples. After performing width reduction to the continuously cast slab having the thickness H of 250 mm by changing the width rolling amount in various ways within a range of 0 to 70 mm, the slab was then subjected to plate thickness pressing by changing the reduction ratio in many ways within a range of 20 to 36%. The internal defect generation ratio at each part of the thus obtained material was examined. The evaluation of the examination result is represented by symbols O and X. The symbol O represents acceptance because of no defect, while the symbol X represents rejection because of a defect. Both the width central portion and the widthwise direction end portion of sample numbers 3, 6, 7 and 8 (embodiments) were accepted. On the other hand, both the width central portion and the widthwise direction end portion of a sample number 1 (comparative example) were rejected. Further, the widthwise direction end portion of sample numbers 2, 4 and 5 (comparative examples) was rejected.

As described above, according to the present invention, by applying to the continuously cast slab a width reduction amount which equals to or above an amount obtained by using a function f (r, H) of the plate thickness press reduction ratio r and the slab thickness H before the plate thickness press process, the reduction strain at the plate end portion can be increased beyond that at the plate central portion, and it is possible to compensate a difference in the maximum reduction strain caused due to a difference in the strain state between the plate end portion and the plate central portion. Therefore, the generation ratio of internal defects in the overall widthwise direction can be decreased. In this manner, a long sheet bar can be obtained by press-processing in the plate thickness direction the slab whose internal defect generation ratio has been decreased and subsequently continuously rolling the slab without a need of joining the sheet bars or the slabs.

(Second Group of Embodiments)

Figure 14:
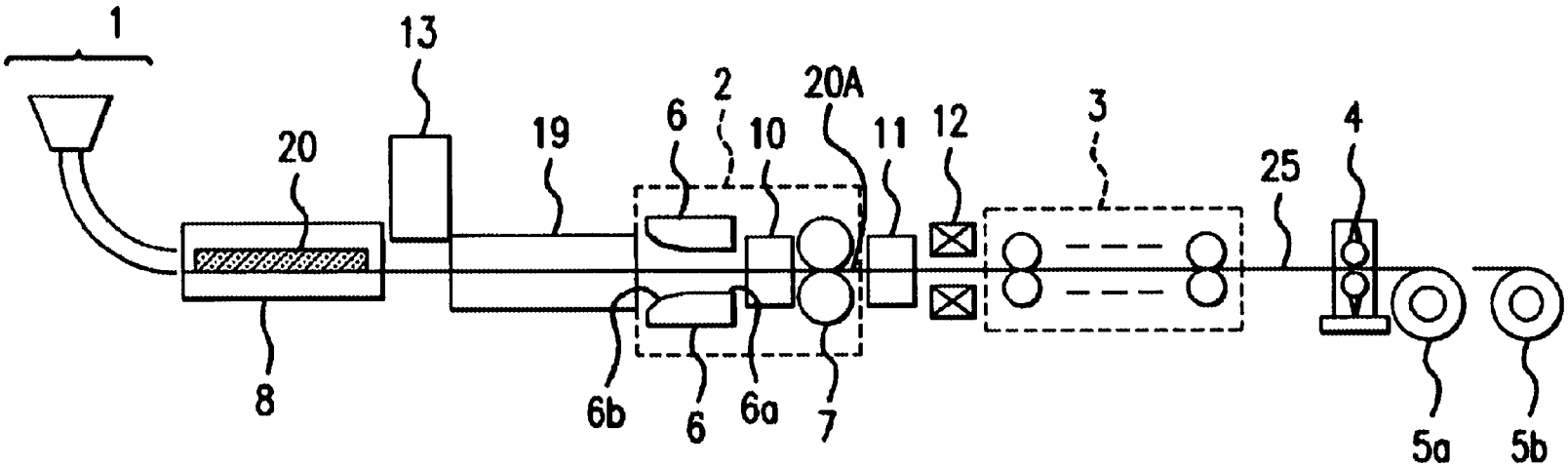
FIG. 14 is a view showing an outline of a facility for use in a method for manufacturing a hot-rolled steel plate by plate thickness pressing according to a first preferred method embodiment of the present invention.

FIG. 14 is a view showing an outline of a facility for use in a method for manufacturing a hot-rolled steel plate by plate thickness pressing according to a second embodiment of the present invention. A slab 20 continuously cast by a continuous casting machine 1 is heated in a target temperature zone by a heater 13 and subjected to a plate thickness press process in a rough processing facility 2 through a warmer 19. Further, the slab 20 is roughing-rolled by a roughing mill 7 to be turned into a sheet bar 20A. The sheet bar 20A is subjected to temperature adjustment by a warmer 11 and a heater 12 and then led to a finishing mill 3. Subsequently, the sheet bar 20A is finishing-rolled until a target thickness is obtained and turned into a steel plate. Moreover, the steel plate is finally wound by the coilers 5*a* and 5*b* through a cutter 4.

The rough processing facility 2 includes a plate thickness pressing device having a pair of vertical dies 6, a warmer 10, and a roughing mill 7. The elongated continuously cast slab 20 is press-forged by the dies 6 in the plate thickness direction and roughing-rolled by the roughing mill 7 while being held at a predetermined temperature by the warmer 9. It is to be noted that the press process in the plate thickness direction is repeatedly conducted while intermittently feeding the hot slab 20 by a predetermined feed amount f. Here, the slab feed amount f is determined based on the later-described conditions.

Further, as apparent from the above-described FIG. 10, it was found that the internal defect generation ratio becomes lower than 0.01% as an allowable value when all the materials have the reduction ratio of not less than 30%.

Figure 15:
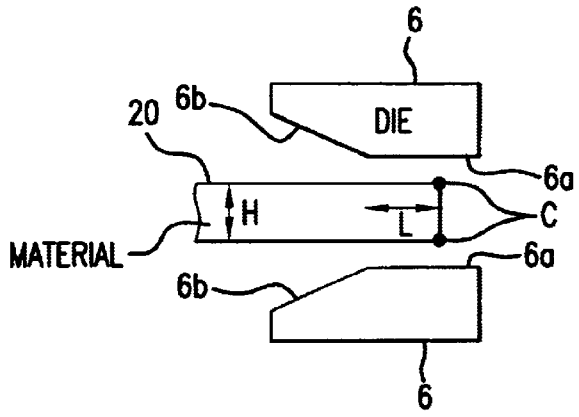
FIG. 15 is a schematic drawing for defining a contact length L along which a die comes into contact with a material (slab)

A length of a part where the material and the dies come into contact with each other (contact length L) will now be defined with reference to FIG. 15.

A front end portion of the slab 20 having the plate thickness H is inserted between a pair of vertical dies 6. Here, the feed amount f of the slab 20 is controlled in such a manner that the slab comes into contact with a die parallel portion 6*a* from a corner portion C of the slab front end portion by only the contact length L. The slab feed amount f is controlled by a non-illustrated controller. As a result, the slab front end portion is pressed by the die parallel portion 6*a* by only the contact length L. Further, generation of a lap 27 and a bulge 28 can be decreased, and lengths L1 and L2 of non-steady deformation portions become minimum.

Figure 16A:
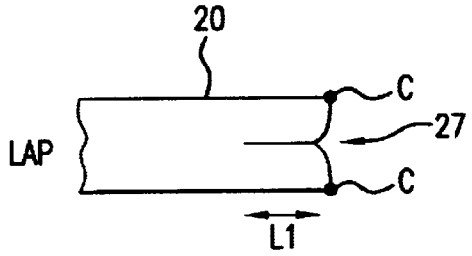
FIG. 16(*a*) is a schematic drawing showing a lap generated at an end of the slab by a press process, FIG. 16(*b*) is a schematic drawing showing a bulge generated at the end of the slab by the press process, and FIG. 16(*c*) is a schematic drawing showing a lap and a bulge compositively generated at the end of the slab by the press process.
Figure 16B:
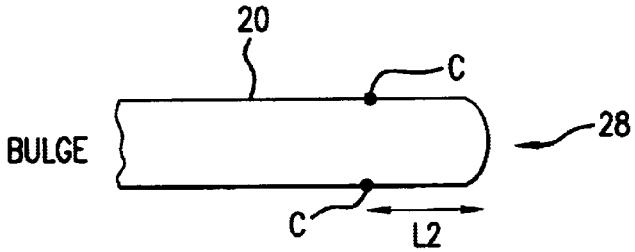
Figure 16C:
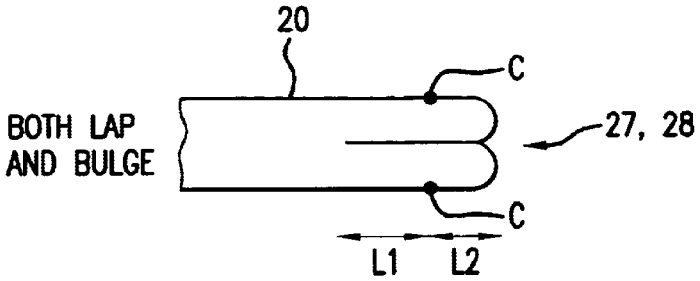
Figure 17:
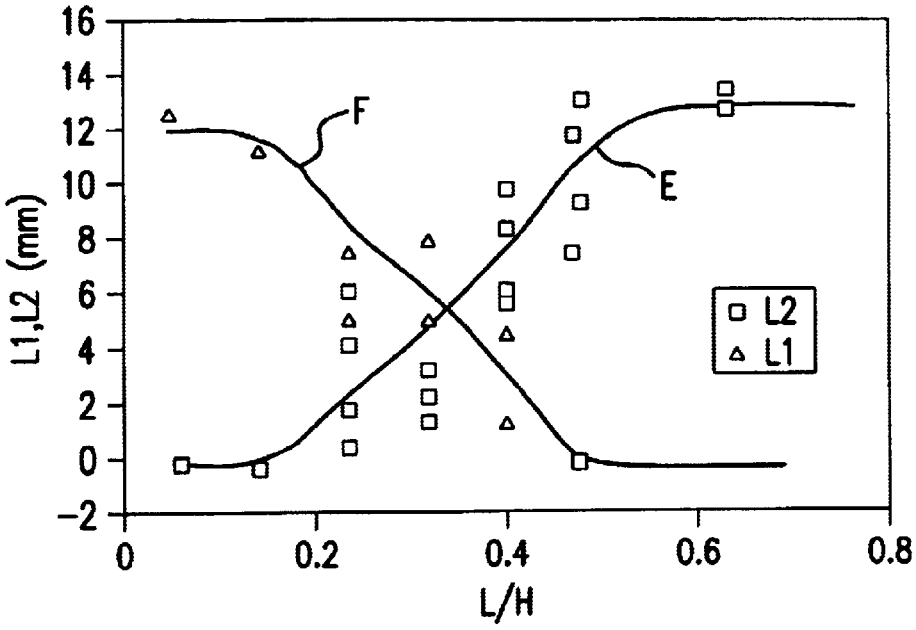
FIG. 17 is a characteristic diagram showing the correlation between a length of a front end of the slab coming into contact with a parallel portion of a die and a shape of the front end.

FIG. 16(*a*) is a schematic drawing showing a lap generated in the slab end portion by the press process; FIG. 16(*b*), a schematic drawing showing a bulge generated in the slab end portion by the press process; and FIG. 16(*c*) is a schematic drawing showing a lap and a bulge compositively generated in the slab end portion by the press process. When the lap 27 is generated, the corner portion C of the slab front end portion becomes a cutting edge as shown in FIG. 16(*a*). However, when the bulge 28 is generated and when both the lap 27 and the bulge 28 are generated, the slab front end portion extends toward the front of the pass line, and hence the corner portion C can not be a cutting edge.

Here, in order to quantitatively evaluate the shape of a cross section of the slab front end portion, dimensions of the lap 27 and the bulge 28 are defined. Here, measurement is carried out with the slab front end corner portion C as a start point in any case. In case of the lap 27, the length L1 of a portion overlapping toward the inner side of the slab 20 is measured. In case of the bulge 28 the length L2 of a portion protruding toward the outer side of the slab is measured. When both the lap 27 and the bulge 28 are generated the lengths L1 and L2 are measured.

When the corner portion C of the front end of the slab is overheated, the lap 27 is apt to be generated. The contact length L is, therefore, set longer to suppress generation of the lap 27 and minimize the lap size L1. On the other hand, when the surface temperature of the slab is lowered, the bulge 28 is apt to be generated. The contact length L is, therefore, set shorter to suppress generation of the bulge 28 and minimize the bulge size L2.

According to the above embodiment, the crop loss was greatly reduced, and the yield of the product was exponentially improved.

According to the above-described present invention, the continuously cast slab is press-processed in the plate thickness direction and subsequently continuously rolled to be turned into a sheet bar. Thus, the long sheet bar can be obtained without joining the sheet bars or the slabs. Since the press process can increase the reduction ratio as compared with rolling, reduction in the generation ratio of internal defects is possible.

In the plate thickness press process, since generation of defects of shape due to deformation at the slab front end can be decreased by appropriately setting the dimension of the contact portion between the die and the material, the yield of the crop cutting can be improved in the following stage of the sheet bar.

(Third Groups of Embodiments)

The above-described apparatus shown in FIG. 14 is a facility which utilizes a direct rolling technique for directly connecting the continuous casting facility with the hot rolling process. This facility continuously casts a slab whose length corresponds to several hot-rolled steel plate coils and to one charge of a steel converter at the most and enables direct rolling (however, a process other than rolling is partially carried out). The facility is constituted by a continuous casting facility for continuously casting a hot slab, a rough processing facility for subjecting the hot-slab continuously cast by the continuous casting facility to a thickness reduction process to obtain a sheet bar, a finishing mill group for rolling the sheet bar obtained by the rough processing facility to obtain a hot-rolled steel plate having a predetermined plate thickness, and a coiler for winding the hot-rolled steel plate therearound in the mentioned order.

In FIG. 14, reference numeral 1 denotes the continuous casting facility; 2, the rough processing facility; 3, the finishing mill group; 4, a rolling shear, and reference numerals 5*a* and 5*b*, coilers. Here, thickness reduction processing means in the rough processing facility 2 is constituted by a pair of dies 6 at the front stage and the roughing mill 7 at the rear stage. Each die 6 has an inclined portion on the input side and a flat portion on the output side and forms the slab into a tapered shape in the middle of pressing. Further, a warmer 8 is provided in the continuous casting facility in the vicinity of the output side; a warmer 19, between the continuous casting facility 1 and the rough processing facility 2; a warmer 10, between a pair of dies 6 and the roughing mill 7 in the rough processing facility 2; and a warmer 11, between the rough processing facility 2 and the finishing mill group 3, respectively. Further, a heater 12 capable of heating a plate end and/or the entire plate surface of the sheet bar is provided between the warmer 11 and the finishing mill 3.

In the continuous casting/hot-rolled steel plate manufacturing facility line having such an arrangement, the long continuously cast slab 20 is supplied to the rough processing facility 2 without being cut and forged by the parallel portion and the tapered portion 6*a* and 6*b* of each die 6 of the rough processing facility 2 so that the thickness of the slab is reduced to the thickness of the sheet bar (the slab is press-processed in the plate thickness direction). Thereafter, the slab is continuously rolled by the roughing mill 7 to be turned into a sheet bar. The obtained sheet bar is further rolled by the finishing mill group 3 until a predetermined product plate thickness is obtained, thereby manufacturing a hot-rolled steel plate 25. It is to be noted that the press process in the plate thickness direction is repeatedly carried out while moving the material (continuously cast slab 20) by a predetermined feed amount. Moreover, the predetermined feed amount is determined based on the later-described conditions. Subsequently, the hot-rolled steel plate 25 is first wound by the coiler 5*a*. When a predetermined take-up length is obtained as a product coil, the rolling shear 4 is used to cut the moving steel plate 25. The steel plate 25 following the cut portion is wound by the coiler 5*b*. Similarly, as to the coiler 5*b*, when a predetermined take-up length is obtained as a product coil, the rolling shear 4 is used to cut the steel plate 25. Further, the coiler for winding the steel plate 25 in the similar manner is changed from the coiler 5*b* to the coiler 5*a*.

As shown in FIG. 10, all the continuously cast slabs having the plate thickness of 100 mm and 200 mm have the internal defect generation ratio of 0.01% which falls within the allowable range with the reduction ratio of 0.3. In the present invention, the internal defect generation ratio is set to 0.001% which is one-digit smaller than the above value in order to assure the higher quality.

Figure 18:
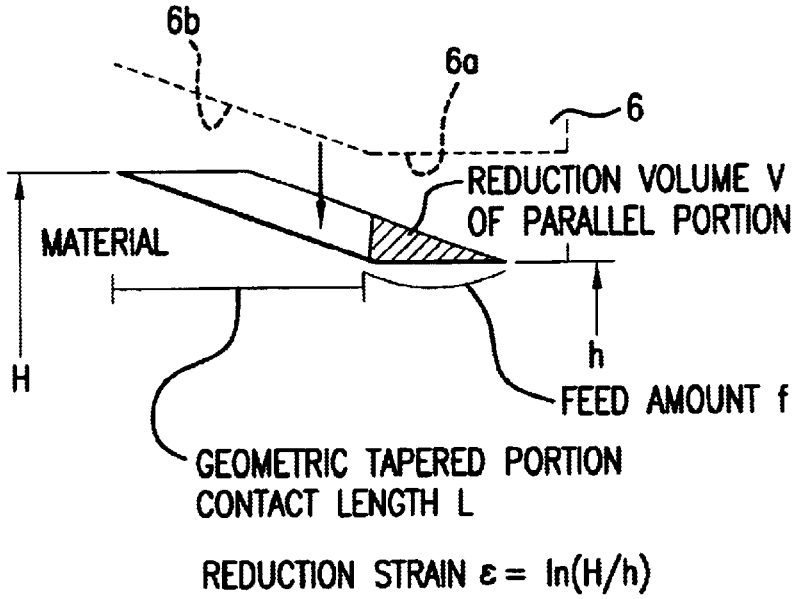
FIG. 18 is a view showing the definition of a dimension of a part where a material comes into contact with a die according to a third embodiment of the present invention.

FIG. 18 is a view for defining the dimension of a part where the material comes into contact with the die. The contact length L represents a length of the slab at the part where the slab comes into contact with the tapered portion 6*b* of the die 6 in the longitudinal direction. The feed amount f is an amount of movement after the immediate preceding press process. In the part of the slab 20 processed into the inclined surface, the part corresponding to the feed amount f is subjected to the press process by the parallel portion 6*a* of the die 6. A part indicated by diagonal lines indicates a portion which has been processed by the flat portion and has a volume V. Furthermore, reference character h denotes a plate thickness after the press process.

Figure 19A:
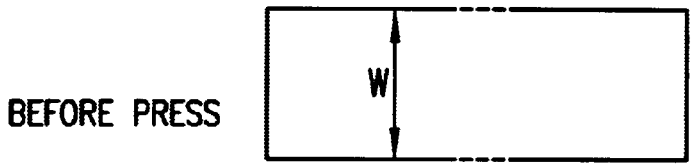
FIGS. 19(A) and 19(B) are views showing the definition of symbols of a width change before and after pressing.
Figure 19B:
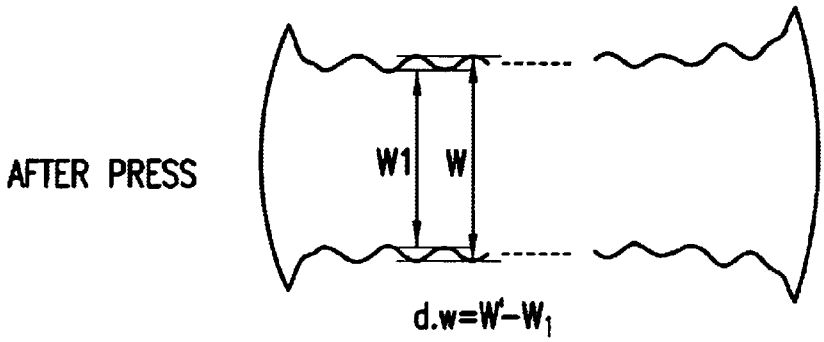

FIGS. 19(A) and 19(B) are views for illustrating a change in the plate width of the slab before and after pressing. FIG. 19(A) shows the state before pressing, whilst FIG. 19(B) shows the state after pressing. Incidentally, in FIG. 19, reference character W designates a plate width of the slab before pressing; $W_1$, a plate width between concave portions of the slab after pressing; W', a plate width between protruding portions of the slab after pressing; dw, a difference between W' and $W_1$.

Figure 20:
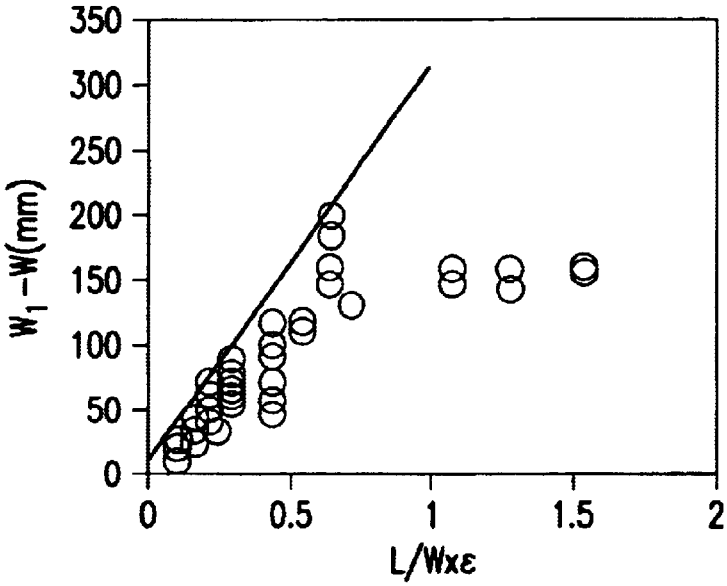
FIG. 20 is a view showing the relationship between a press processing condition and a plate width increasing amount.

FIG. 20 is a view showing the relationship between press process conditions and a plate width increasing amount. A horizontal axis indicates a product $\epsilon L/W$ of the reduction strain $\epsilon$ and a ratio of the contact length L in the longitudinal direction and the plate width W, and a vertical axis indicates a plate width increasing amount (the plate width $W_1$ after press processing−W). In FIG. 20, all the points are positioned in an area under an oblique straight line. The press process conditions required for setting the plate width increasing amount in a target value range can be found from FIG. 20. For example, if a target value of the plate width increasing amount is set to be not more than 100 mm, $\epsilon L/W$ can be not more than 0.3. Further, if a target value is set to be not more than 150 mm, $\epsilon L/W$ can be not more than 0.5.

Figure 21:
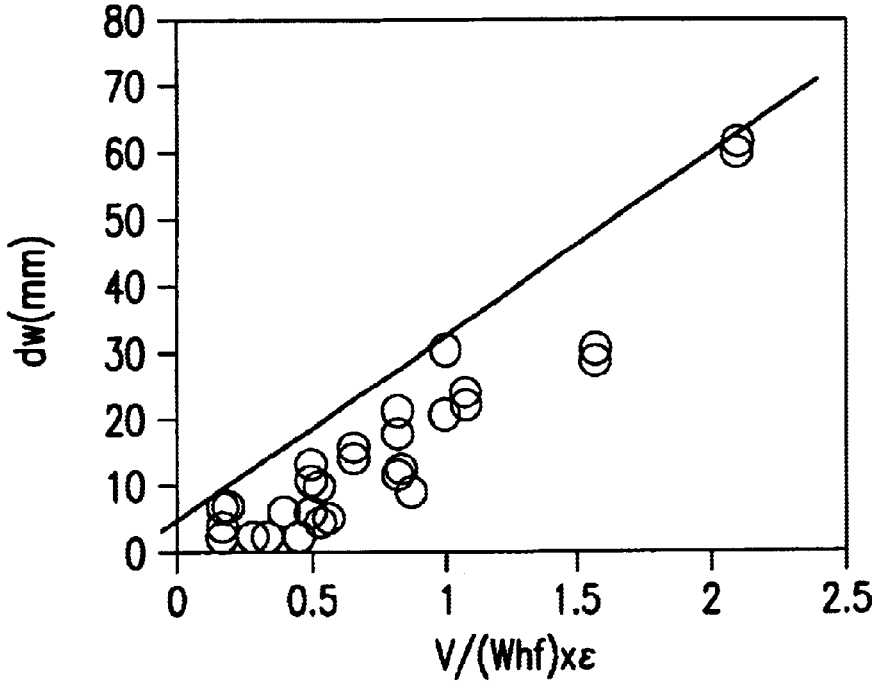
FIG. 21 is a view showing the relationship between a press processing condition and a plate width fluctuating amount.

FIG. 21 is a view showing the relationship between the press process conditions and the plate width fluctuation amount. A horizontal axis represents a product $V\epsilon/(Wfh)$ of a process amount V/(Wfh) obtained only by the flat portion and the entire reduction strain $\epsilon$, and a vertical axis represents a fluctuation amount dw of the plate width. In the drawing, all the points are positioned in an area under an oblique straight line. The press process conditions required for setting the plate width fluctuation amount in a target value range can be found from on FIG. 21. For example, if a target value of the plate width fluctuation amount is set to be not more than 20 mm, $V\epsilon/(Wfh)$ can be not more than 0.6.

According to the present invention, the sheet bar is obtained by press-processing and subsequently continuously rolling the continuously cast slab. Therefore, the long sheet bar can be manufactured without joining the sheet bars or the slabs. In the press process, the process strain can be increased as compared with that obtained by rolling, thereby reducing the internal defect generation ratio.

Moreover, in the press process, a pair of dies each of which has the inclined portion on the input side and the flat portion on the output side are used to apply the process in the plate thickness direction based on the press conditions according to characteristic values represented by, e.g., the dimension of the contact portion of the material relative to the die or the feed amount. Extension of the width of the material caused by the press process can be decreased within a predetermined value.

(Fourth Group of Embodiments)

Figure 22:
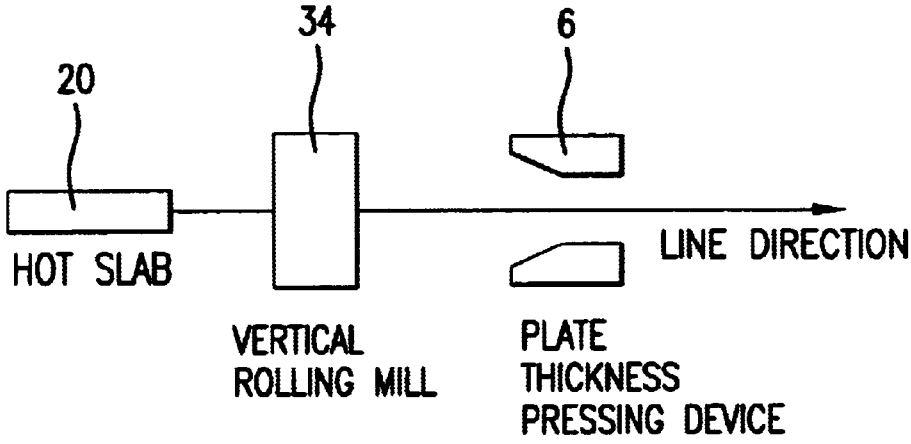
FIG. 22 is a schematic block diagram showing a second preferred apparatus embodiment of a plate thickness press manufacturing line.

FIG. 22 shows a plate thickness press line according to a preferred second apparatus embodiment used in the present invention.

In the line according to the second apparatus embodiment, a vertical rolling mill 34 is arranged on the upstream side of the plate thickness pressing device having the dies 6. The vertical rolling mill 34 is used to reduce the width of the hot slab 20 to W to W' starting from an initial width Wo. It is desirable that the vertical rolling mill 34 is of a type capable of changing a gap during rolling. Although any width changing type can be adopted, a hydraulic rolling reduction type is preferable. It is to be noted that the processing speed of the width reduction rolling by the vertical rolling mill 34 is faster than that of the plate thickness press and the productivity can be hence increased by performing plate thickness pressing after width reduction rolling. Also, reduction in temperature of the slab 20 can be effectively prevented. Moreover, width reduction rolling and plate thickness pressing can be simultaneously (tandem) performed.

(Fifth Group of Embodiments)

Figure 23:
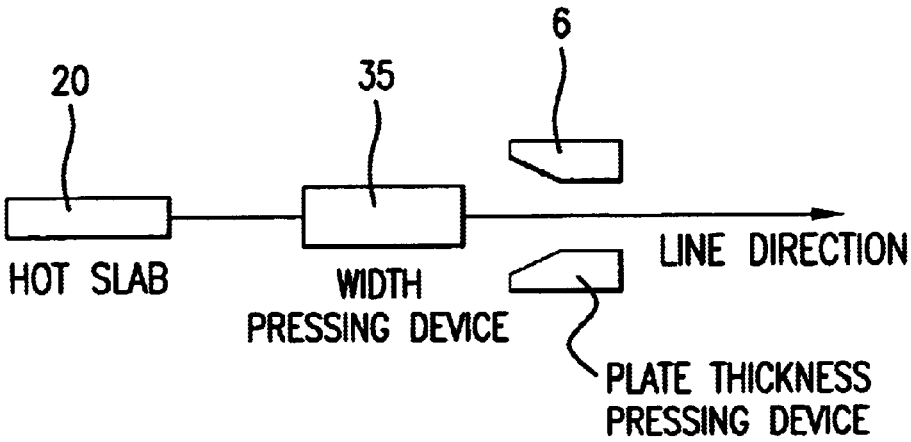
FIG. 23 is a schematic block diagram showing a third preferred apparatus embodiment of the plate thickness press manufacturing line.

FIG. 23 shows a plate thickness press line according to a preferred third apparatus embodiment used in the present invention.

In the line according to the third apparatus embodiment, a width pressing device 35 is arranged on the immediate upstream side of the plate thickness pressing device having the dies 6. The width pressing device 35 is used to reduce the width of the hot slab 20 to W to W' starting from an initial width Wo. The width pressing device 35 is of a type capable of changing a width reduction amount during rolling and situated at a position where it can be tandem with the plate thickness press. It is to be noted that the width press and the plate thickness press may be aligned and arranged in the same housing in the mentioned order. By performing width pressing and plate thickness pressing at the same time (tandem), the productivity can be improved and reduction in temperature of the slab can be effectively avoided.

The present inventors examined deformations observed in the slab end during plate thickness pressing by using the above-described plate thickness press line. It is to be noted that process conditions were changed in various ways with the plate thickness of 200 to 270 mm, the plate width of 600 to 2000 mm, the press reduction ratio of 15 to 80%, the taper angle $\theta$ of the die tapered portion 6*b* of 10° to 30°.

<Change in Width of Front and Rear Ends>

As a result, it was found that the flare shape of the front and rear ends of the material can be represented by the following expressions (4) to (7).

$$WH-W=(0.15 \text{ to } 0.45)\epsilon\times Ldt \quad (4)$$

$$LH=(0.12 \text{ to } 0.18)\times W/h\times Ldt \quad (5)$$

$$WT-W=(0.15 \text{ to } 0.45)\epsilon\times Ldt \quad (6)$$

$$LT=(0.06 \text{ to } 0.3)\times W/h\times Ldt \quad (7)$$

where, reference character H denotes a plate width of the material on the input side (mm); h, a plate width of the material on the output side (mm); ϵ, a reduction strain (mm); Ldt, a contact length of the material and the press die in the longitudinal direction (mm); and W, a plate width of the material (mm).

Figure 24:
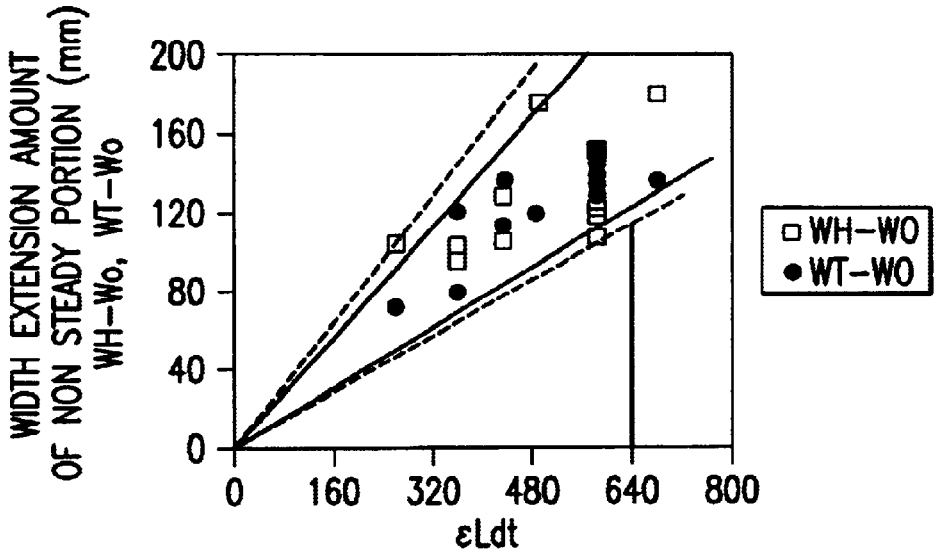
FIG. 24 is a characteristic diagram showing a distribution of a width extension amount of a non-steady portion.

FIG. 24 is a characteristic diagram showing a result of examining the distribution of the width extending amount (mm) in the non-steady portion. In FIG. 24, a horizontal axis represents a total deformation amount ϵLdt and a vertical axis represents a width extending amount WT−Wo (or WH−Wo) in the non-steady portion. In the drawing, a black circle indicates a width extending amount WT−Wo (mm) at the front end of the material, and a white square indicates a width extending amount WH−Wo (mm) at the rear end of the material. As apparent from the drawing, it was found that the width extending amounts in the non-steady portion WT−Wo and WH−Wo largely depend on the total deformation amount of the material ϵLdt and the both amounts appear in an area sandwiched by two solid lines in the drawing.

Figure 25:
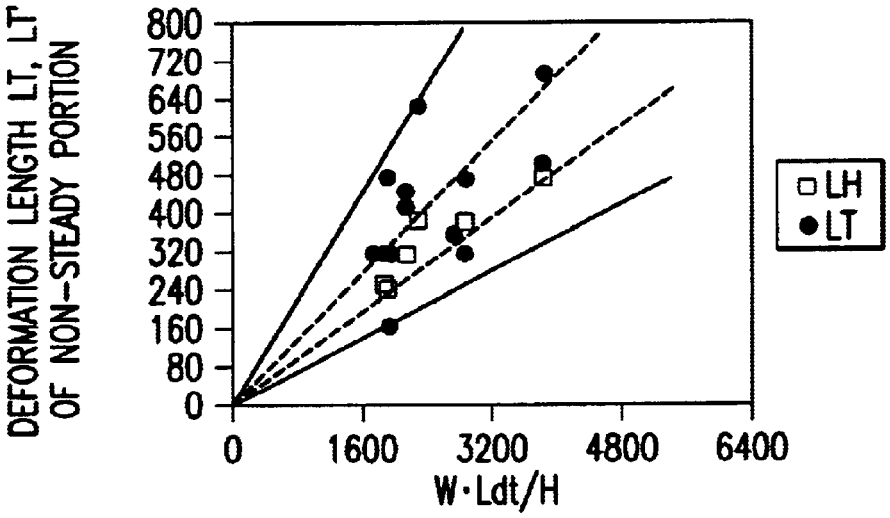
FIG. 25 is a characteristic diagram showing a distribution of a deformed length of the non-steady portion.
Figure 26A:
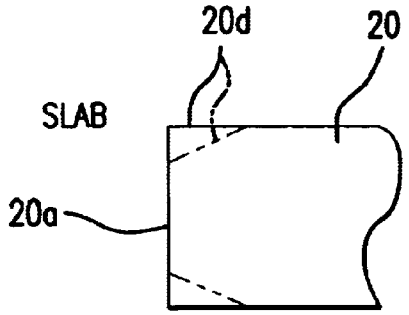
FIG. 26(*a*) is a plane view showing a front end of a slab before pre-forming, FIG. 26(*b*) is a plane view showing the front end of the slab after pre-forming, FIG. 26(*c*) is a plane view showing the front end of the slab with pre-forming used thereto after plate thickness pressing, and FIG. 26(*d*) is a plane view showing the front end of the slab without pre-forming used thereto after plate thickness pressing.
Figure 26B:
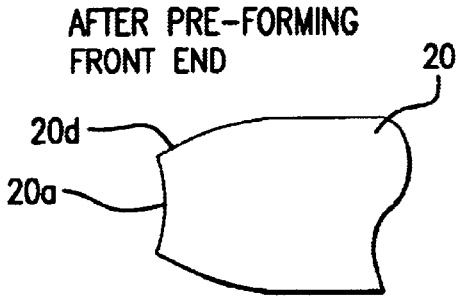
Figure 26C:
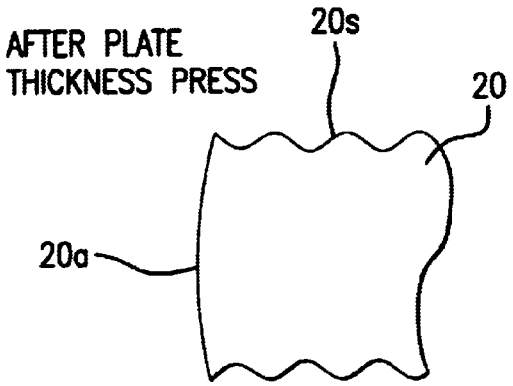
Figure 26D:
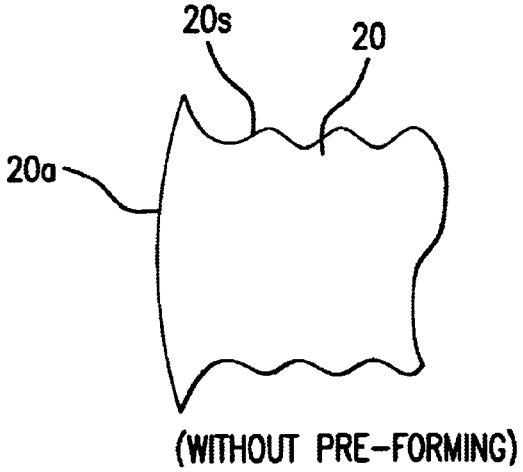

FIG. 25 is a characteristic diagram showing a result of examining the distribution of a deformation length (mm) in the non-steady portion. In FIG. 25, a horizontal axis represents a width extending amount index W Ldt/H and a vertical axis represents a deformation length LT (or LH) in the non-steady portion. In the drawing, a black circle indicates a deformation length LT (mm) at the front end of the material, and a white square indicates a deformation length LH (mm) at the rear end of the material. As apparent from this drawing, it was discovered that the deformation lengths LT and LH in the non-steady portion largely depend on the width extending amount index W Ldt/H and the both lengths appear in an area sandwiched by two solid lines (broken lines) in the drawing.

Based on this information, the present inventors unveiled that a pre-forming amount and a pre-forming length can be determined by using the above expressions (4) to (7) in order to perform pre-forming of the front and rear ends of the hot slab 20. For example, in case of the front end, a plate width pre-forming amount (WH−We) and a pre-forming length LH can suffice. Meanwhile, in case of the rear end, a plate width pre-forming amount (WT−We) and a pre-forming length LT can suffice. However, We is an arbitrary value determined while taking the width reduction amounts of the front and rear ends and the non-steady portion into consideration, and this value can be provided with the relationship of We≦W1.

However, the non-steady width change amount ΔW and a non-steady length ΔL generated in the front end and the rear end of the substantially rectangular material by the plate thickness pressing can be predicted by using expressions (4) to (7) and the following additional expressions so the front end of the substantially rectangular material is preformed based on this prediction:

$$\Delta WH=f1(W,\epsilon,Ldt),\ \Delta WT=f2(W,\epsilon,Ldt)$$

$$\Delta LH=g1(W,h,Ldt),\ \Delta LT=g2(W,H,Ldt)$$

where ΔWH is a predicted non-steady width change amount generated at the front end of the substantially rectangular material in a moving direction by plate thickness pressing; ΔWT, a predicted non-steady width change amount generated at the rear end of the substantially rectangular material in the moving direction by plate thickness pressing; ΔLH, a predicted non-steady length generated at the front end of the substantially rectangular material in the moving direction by plate thickness pressing; ΔLT, a predicted non-steady length generated at the rear end of the substantially rectangular material in the moving direction by plate thickness pressing; H, a plate thickness of the substantially rectangular material on a press input side; h, a plate thickness of the substantially rectangular material on a press output side; ϵ(=log(H/h)), a plate thickness strain; Ldt, a contact length of the material and the press die in a longitudinal direction; and W, a plate width of the substantially rectangular material.

Description will now be given as to a method for determining the pre-forming amounts and the pre-forming lengths of the front and rear ends with reference to FIGS. 26(*a*) to 26(*d*).

In the hot slab 20 shown in FIG. 26(*a*), both side portions of the material front end 20*a* are first pre-formed into a shape such as shown by broken lines in the drawing. Incidentally, although it is desirable that the pre-forming amount in a part from the pre-formed portion 20*d* of the front end to the steady portion changes in the parabolic form, it may be a linear form.

The pre-formed slab (FIG. 26(*b*)) is then pressed in the plate thickness direction. Although the flare is generated at the pre-formed front end after pressing, the shape of the front end becomes substantially rectangular after completion of pressing as shown in FIG. 26(*c*). On the other hand, the front end which has not been subjected to pre-forming has a flared shape as shown in FIG. 26(*d*).

It is to be noted that the above-described pre-forming determining procedure is similarly used to the rear end.

Figure 27:
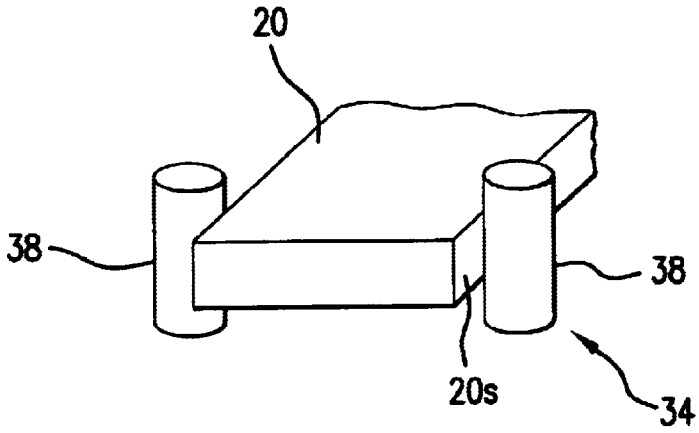
FIG. 27 is a perspective view showing a width reduction roll and a hot slab.
Figure 28:
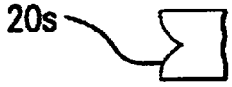
FIG. 28 is a view showing a profile of an end surface of the slab whose width has been reduced by the roll.

Incidentally, when the vertical rolling mill 34 having a flat roll 38 such as shown in FIG. 27 is used, a lap having an edge shape 20*s* such as shown in FIG. 28 is generated at the time of plate thickness pressing.

Figure 29:
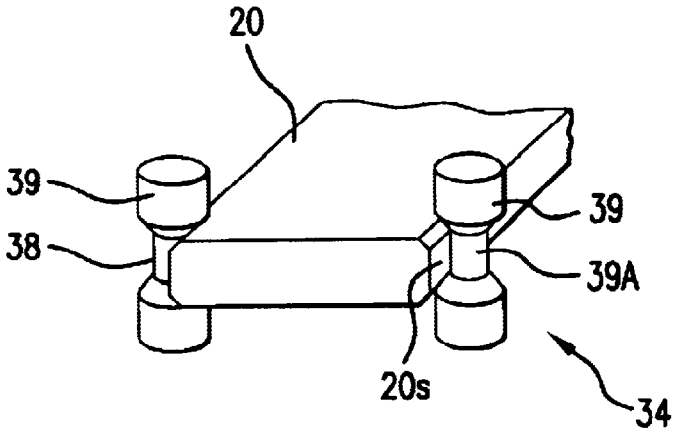
FIG. 29 is a perspective view showing another width reduction roll and the hot slab.
Figure 30:
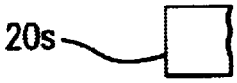
FIG. 30 is a view showing a profile of the end surface of the slab whose width has been reduced by the roll in FIG. 29.

Meanwhile, when the vertical rolling mill 34 having rolls 39 with calibers 39*a* such as shown in FIG. 29 is used, a substantially smooth end face 20*s* such as shown in FIG. 30 can be obtained after plate thickness pressing by previously applying reverse deformation to the lap which is generated at the width end portion of the front end at the time of plate thickness pressing.

Figure 31:
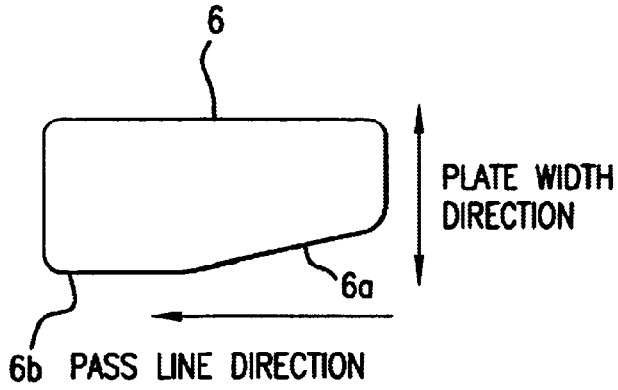
FIG. 31 is a view showing a die from a plate width direction.
Figure 32:
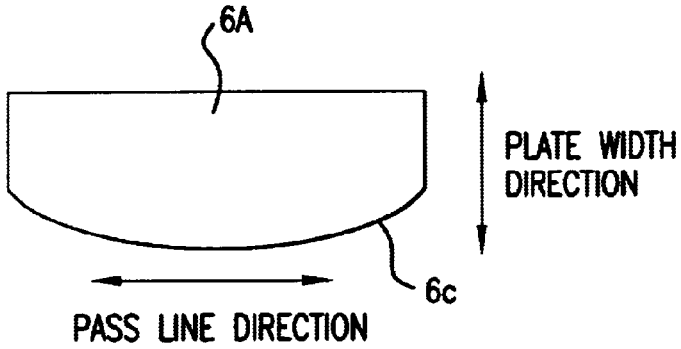
FIG. 32 is a view showing another die from a plate width direction.
Figure 33:
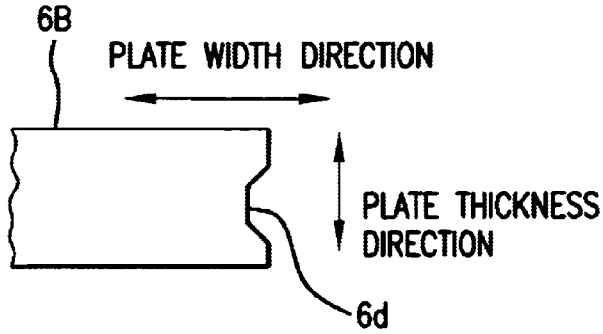
FIG. 33 is a view showing the die from a pass line direction.

Moreover, in case of using the width pressing device, pre-forming of the front and rear ends is possible by performing plate thickness pressing by using a die having a parallel portion 6*a* shown in FIG. 31 or a die 6A having an arc portion 6*c* shown in FIG. 32. In addition, as shown in FIG. 33, by forming a side surface portion 6*d* of a die 6B into a concave shape and previously applying reverse deformation to the front and rear ends by using this die 6B, it is possible to effectively prevent the lap from being generated at the width end portion of the front end at the time of plate thickness pressing.

<Width Distribution of Steady Portion>

Figure 34:
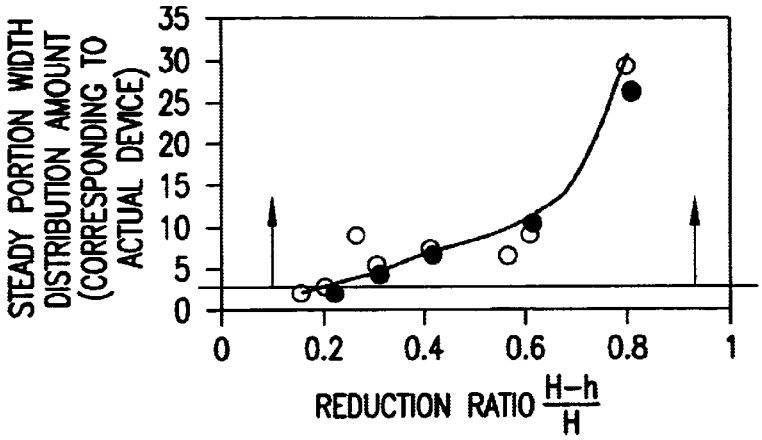
FIG. 34 is a characteristic diagram showing the correlation between a reduction ratio and a steady portion width distribution amount.
Figure 35A:
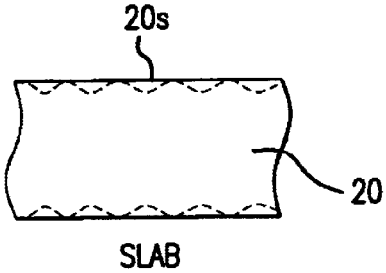
FIG. 35(*a*) is a plane view of the slab before width forming, FIG. 35(*b*) is a plane view of the slab after width forming, FIG. 35(*c*) is a plane view of the slab with width forming used thereto after plate thickness pressing, and FIG. 35(*d*) is a plane view showing the slab without width forming used thereto after plate thickness pressing.
Figure 35B:
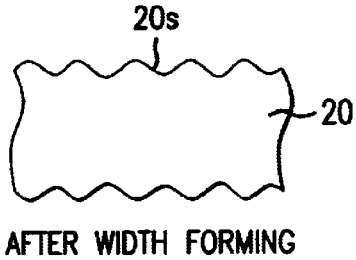
Figure 35C:
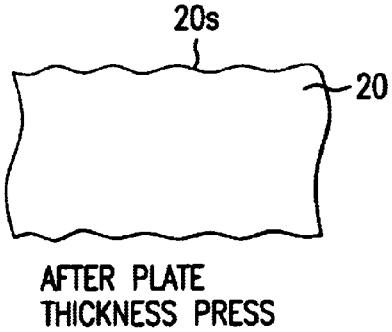
Figure 35D:
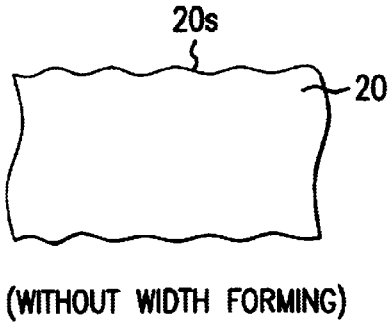

FIG. 34 is a characteristic diagram showing a result of examining a width distribution amount of the steady portion after plate thickness pressing, in which a horizontal axis represents a reduction ratio ((H−h)/H) and a vertical axis represents a width distribution amount of the steady portion (corresponding to an actual device). Here, a die having a taper angle of 12° was used, and the relationship between the press reduction ratio and the width distribution amount of the hot slab having the plate thickness of 250 mm and the width of 1200 mm was examined with the feed amount f of 250 mm. In the drawing, a black circle indicates a result obtained by performing 50 mm width reduction and then pressing the slab in the plate thickness direction in order to examine the influence of width rolling, and a white circle indicates a result obtained by performing only pressing in the plate thickness direction without carrying out width reduction. As apparent from the drawing, there is a tendency such that the width distribution of the steady portion after pressing increases as the press reduction ratio becomes high.

As shown in the drawing, there is almost no influence of the width rolling on the width distribution. Further, since the width distribution amount exceeds an allowable range when the press reduction ratio is not less than 30%, the width distribution must be formed in the steady portion of the material by vertical rolling in order to suppress the width fluctuation in the steady portion when performing pressing with the reduction ratio of at least not less than 30%.

Additionally, as a result of experiments conducted by the present inventors, it was discovered that the steady portion plate width distribution amount dW generated by plate thickness pressing and a pitch dL thereof are predicted by using the following general expressions: where, $dW=F(V, W, h, f, \epsilon)$; $dL=G(H, h, f)$; H: a plate thickness of said substantially rectangular material on a press input side; h: a plate thickness of said substantially rectangular material on a press output side; $\epsilon(=\log(H/h))$: a plate thickness strain; W: a plate width of said substantially rectangular material; f: a feed amount of said substantially rectangular material at the time of plate thickness pressing; and V: a reduction volume of said parallel portion of said die. More specifically, the present inventors discovered that the width distribution amount dW of the steady portion and its cycle dL can be represented by the following expressions (8) and (9).

$$dW=V/Whf\times\epsilon\text{:width distribution amount} \quad (8)$$

$$dL=B\times H/h\times f\text{:gap of the width distribution (after pressing)} \quad (9)$$

where, reference character f denotes a feed amount; V, a reduction volume of the die parallel portion; and h, a plate thickness on the output side of the press.

Figure 36:
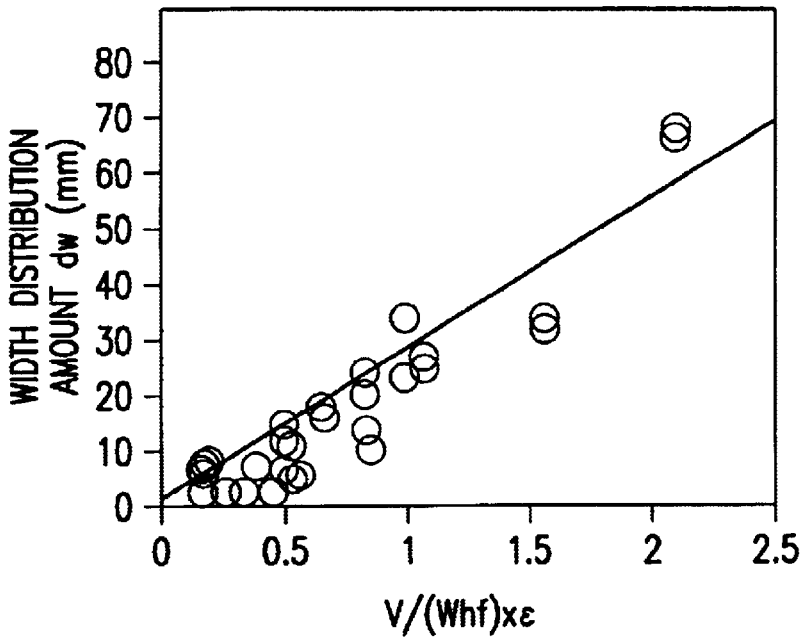
FIG. 36 is a characteristic diagram showing a result of measuring a width distribution amount of a hot slab after pressing.

FIG. 36 is a characteristic diagram having a horizontal axis representing a value of $V/(WHf)\times\epsilon$ and a vertical axis representing a width distribution amount dW (mm) and shows a result of examining the correlation between these values. As apparent from the drawing, the strong correlation of these values can be observed.

Therefore, by previously forming the steady portion by vertical rolling or width pressing, the excellent shape of the plane surface of the steady portion in the material can be obtained after pressing. For example, an inverted shape of the steady portion width distribution generated by plate thickness pressing can suffice. In this case, a necessary opening change amount can be predicted based on, e.g., the above expressions (8) and (9) representing the steady portion width distribution.

When the vertical rolling mill 34 provided with caliber rolls 39 is used, a gap change amount becomes small because of the large width reduction efficiency, which advantageously facilitates shaping. Further, in case of width pressing, a good result can be obtained by using a die 6A having an arc contact surface 6*d* such as shown in FIG. 32.

The method according to a preferred embodiment of the present invention will now be described with reference to FIGS. 35(*a*) to 35(*d*).

The steady portion of the hot slab 20 shown in FIG. 35(*a*) is first formed as indicated by broken lines in the drawing. Incidentally, although it is desirable to adopt a sine curve shape such as shown in FIG. 35(*b*), this may be a sawtooth-like shape.

The formed slab (FIG. 35(*b*)) will now be subjected to plate thickness pressing. The width distribution is generated in the pre-formed steady portion of the material by pressing, and this is canceled out by the shape obtained by the pre-forming. After pressing, the hot slab 20 has a flat shape with substantially no width distribution as shown in FIG. 35(*c*). It is to be noted that the slab which has not been subjected to pre-forming for the width distribution has a shape such as shown in FIG. 35(*d*).

Furthermore, by simultaneously performing pre-forming of the front and rear ends of the material and distributed width forming of the steady portion by the vertical rolling mill 34, both the flare at the front and rear ends and the width distribution of the steady portion are not formed in the material after completion of pressing.

According to the above-described embodiment, the shapes of the front and rear ends become excellent after termination of plate thickness pressing by carrying out pre-forming of the front and rear ends by width reduction, thereby improving the yield.

Moreover, since the width distribution of the steady portion becomes small after completion of plate thickness pressing by forming the width distribution in the steady portion by width reduction, which leads to improvement in the width accuracy of the material and in the product quality.

Additionally, the yield of the product and the product quality can be improved after termination of plate thickness pressing by effecting both pre-forming of the front and rear ends and formation of the width distribution of the steady portion.

Further, using a caliber edger in the vertical rolling mill can improve the productivity and prevent the lap from being generated at the front and rear ends in pre-forming of the front and rear ends, thereby enhancing the yield. Also, forming the width distribution of the steady portion can improve the width reduction efficiency to facilitate adjustment of the vertical rolling mill. As a result, the width accuracy can be further improved, thereby heightening the product quality.

Incidentally, effecting vertical rolling or width pressing before plate thickness pressing can enlarge a range of the plate width which can be produced from the same slab.

According to this preferred embodiment of the present invention, since the width accuracy at the front and rear ends of the hot slab can be improved, the yield can be greatly enhanced. Furthermore, since the lap can be prevented from being generated at the front and rear ends, a cut-off portion becomes small, thereby enhancing the yield. In addition, since the width accuracy in the steady portion can be improved, the product quality can be heightened.

(Sixth Group of Embodiments)

(One-stage Die)

The present inventors conducted a simulative test under the following conditions using a one-stage tapered die with a reduction amount being fixed (however, a reduction strain is not more than 0.5).

Conditions of Experiment

- Simulative material: hard lead (initial size: plate thickness H 32 mm×width W 150 mm×L)
- Plate thickness h after pressing: 12.5 mm
- Feed amount f: 10 to 40 mm
- Taper angle of a die: 12° to 30° (12°, 20° and 30° are mainly used)

Incidentally, in case of the taper angle of the die which is not less than 15°, a slip occurred at the beginning of pressing with the feed amount f with which the hot slab 20 contacts from the tapered portion 6*b*, and data about this is given for reference. As a result of a subsequent examination, it was unveiled that, in cases where the tapered portion of the die is brought into contact with the material, a slip is apt to be generated with the taper angle of not less than 15°.

Moreover, from a further examination about the simulative test results, the following facts (a) to (d) were found:

(a) the backward elongation amount BW can be substantially adjusted by removing the overall reduction volume V' with the plate thickness h and the plate width after pressing;

(b) the width distribution can be substantially adjusted with the reduction volume V of the parallel portion of the die;

(c) the width elongation can be substantially adjusted by the influence of the contact length ld of the die tapered portion and a certain feed amount; and (d) the load per unit width can be substantially adjusted by using the entire contact length ldt of the die and the material.

Figure 37:
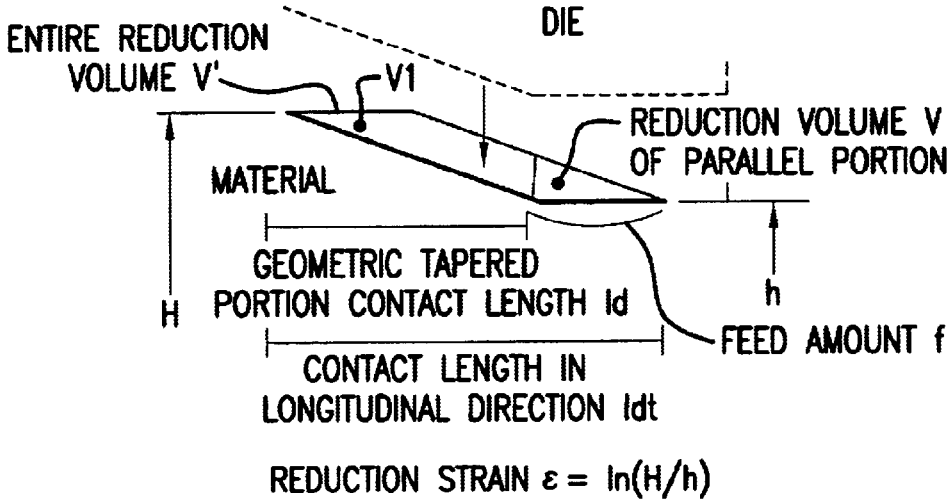
FIG. 37 is an enlarged schematic drawing for defining a contact length of a die for plate thickness pressing and a material.

The explanation of the above-described simulative test results will now be complemented with reference to FIG. 37. FIG. 37 is an enlarged schematic drawing showing the die and the material as a model in order to explain the contact length between the die used for plate thickness pressing and the material. The contact length ldt in the longitudinal direction is equal to addition of the feed amount f to a geometric tapered portion contact length ld (ldt=ld+f). The overall reduction volume V' is equal to addition of the reduction volume V of the parallel portion to the reduction volume V1 of the tapered portion (V'=V1+V). The reduction strain $\epsilon$ is given by the plate thickness H before pressing and the plate thickness h after pressing ($\epsilon$=1n(H/h)).

Figure 38:
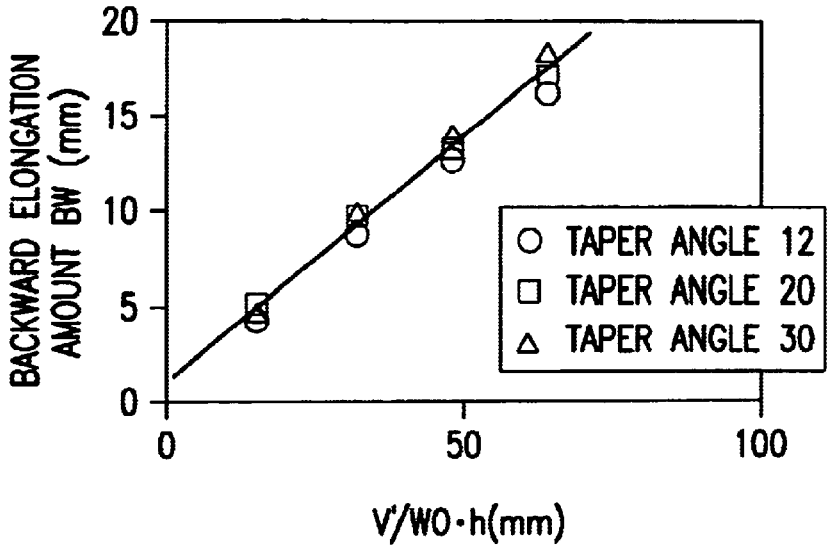
FIG. 38 is a characteristic diagram for illustrating results and advantages of the present invention.

FIG. 38 is a characteristic diagram having a horizontal axis representing V'/W0 h (mm) and a vertical axis representing the backward elongation amount BW (mm) and shows a result of examination about the correlation of these values. V'/W0 h of the horizontal axis is an amount corresponding to the length L1 obtained when the overall reduction volume V' is transformed into a rectangular solid having the plate thickness h, the plate width W0 and the length L. In the drawing, a white circle indicates a result obtained with the taper angle of 12°; a white square, a result obtained with the taper angle of 20°; and a white triangle, a result obtained with the taper angle of 30°. As apparent from the drawing, the backward elongation amount is in substantially direct proportion to V'/W0 h. The backward elongation amount increases as V'/W0 h becomes higher.

Figure 39:
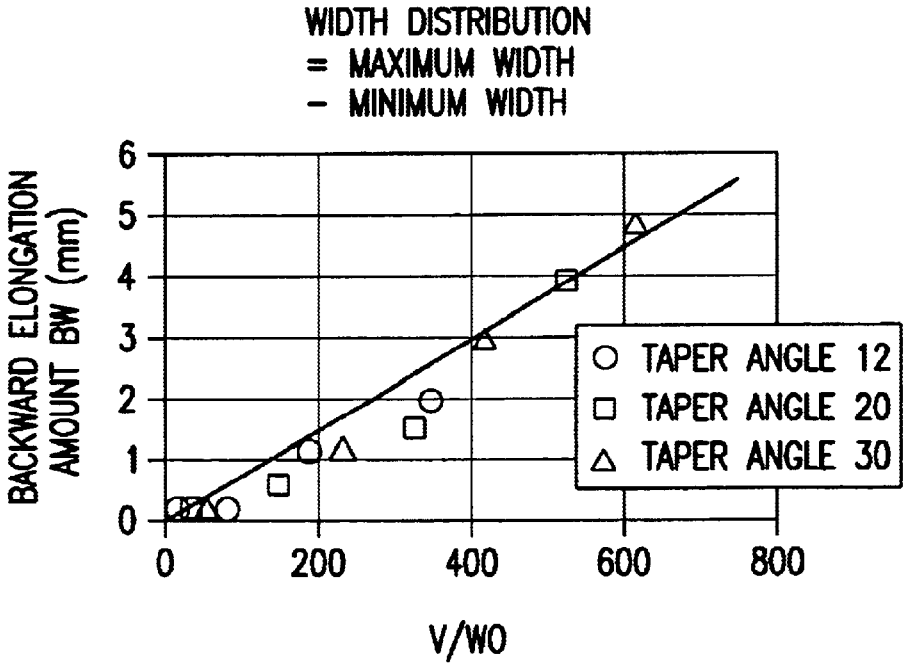
FIG. 39 is a characteristic diagram for illustrating results and advantages of the present invention.
Figure 43A:
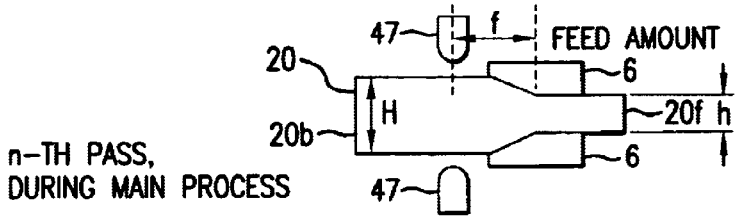
FIG. 43(*a*) is a view showing a slab and a die during a main process of an n-th pass, FIG. 43(*b*) is a view showing the slab and the die at the end of the main process of the n-th pass, FIG. 43(*c*) is a view showing the slab and the die during a sub process of the n-th pass, FIG. 43(*d*) is the slab and the die at the end of the sub process of the n-th pass, and FIG. 43(*e*) is the slab and the die before the main process of an (n+1)th pass.
Figure 43B:
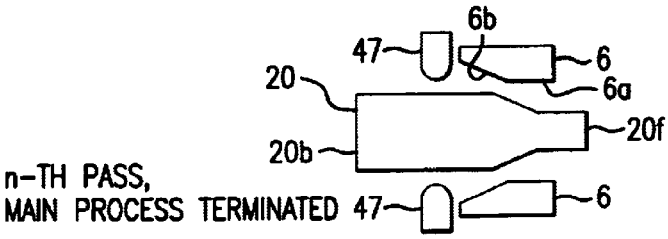
Figure 43C:
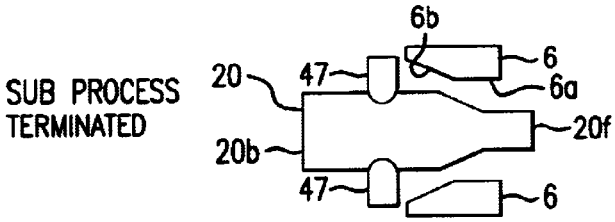
Figure 43D:
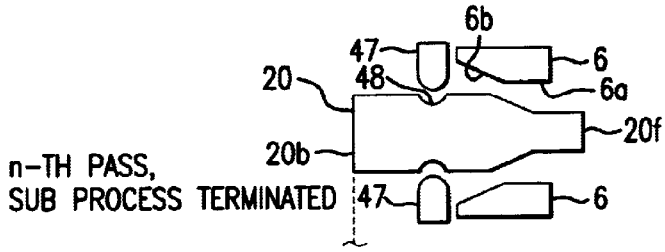
Figure 43E:
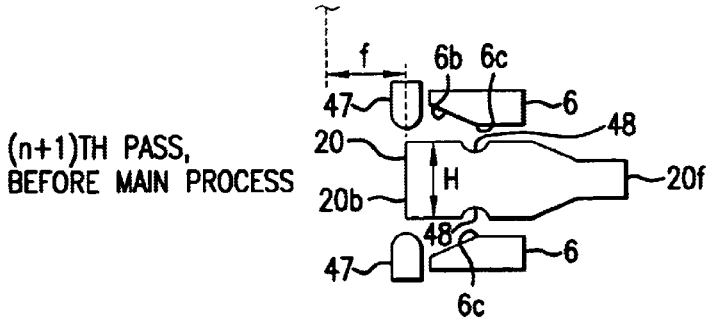

FIG. 39 is a characteristic diagram having a horizontal axis representing V/W0 and a vertical axis representing the width distribution dW and shows a result of examination about the correlation between these values. V/W0 of the horizontal axis corresponds to the reduction area of the parallel portion per unit width. The width distribution dW corresponds to a difference between the maximum width and the minimum width. In the drawing, a white circle indicates a result obtained with the taper angle of 12°; a white square, a result obtained with the taper angle of 20°; and a white triangle, a result obtained with the taper angle of 30°. As apparent from the drawing, the width distribution dW is in substantially direct proportion to V/W0. The width distribution dW increases as V/W0 becomes higher.

FIG. 40 is a characteristic diagram having a horizontal axis representing the tapered portion contact length ld (mm) and a vertical axis representing the width extension amount W1−W0 and shows a result of examining the correlation between these values. In the drawing, a white circle indicates a result obtained with the feed amount f of 10 mm; a white square, a result obtained with the feed amount f of 20 mm; and a white triangle, a result obtained with the feed amount f of 30 mm; a white lozenge, a result obtained with the feed amount f of 40 mm. As apparent from the drawing, the width extension amount (W1−W0) is in substantially direct proportion to the taper portion contact length ld and increases as the feed amount f becomes higher.

FIG. 41 is a characteristic diagram having a horizontal axis representing a geometric contact length ldt (mm) and a vertical axis representing a unit width load (ton/mm) and shows a result of examining the correlation of these values. In the drawing, a white circle indicates a result obtained with the taper angle of 12°; a white square, a result obtained with the taper angle of 20°; and a white triangle, a result obtained with the taper angle of 30°. As apparent from the drawing, the unit width load is in substantially direct proportion to the geometric contact length ldt. The unit width weight increases as ldt becomes higher.

Summing up the information obtained from FIGS. 38 to 41, the influence of the taper angle $\theta$ can be represented as shown in FIG. 42.

Since the tapered portion contact length ld and the geometric contact length ldt become small when the taper angle $\theta$ is large, the load reduction effect and the width extension reduction effect can be obtained, thereby reducing the size and the weight of the apparatus. Therefore, in terms of the load and the width extension, the larger taper angle $\theta$ is desirable. Incidentally, if the angle of the tapered portion 6*b* exceeds 30°, the material backward elongation amount BW at the time pressing increases, it is desirable to set the taper angle $\theta$ within a range of 15° to 30°. However, when the taper angle $\theta$ is increased, the reduction volume V of the parallel portion 6*a* becomes large, which leads to an adverse effect such as that the width distribution dW increases. For example, when the taper angle $\theta$ is changed from 12° to 20° with a fixed feed amount of 30 mm, the load is reduced to ⅔, and the width extension amount is substantially cut by half. In this case, however, the width distribution dW increases nearly three-fold.

In addition, when the feed amount f is similarly increased, the width extension amount rarely changes since it is determined by the tapered portion contact length ld. Further, the load becomes large by an amount corresponding to a small increase in the geometric contact length ldt, but the increasing amount of the load is small. Moreover, since a number of times of pressing is reduced, the plate thickness press process becomes efficient. However, since the reduction volume V of the parallel portion becomes large, the width distribution dW is disadvantageously increased. For example, when the feed amount f is increased from 20 mm to 40 mm with the taper angle of 12°, the width extension amount is increased approximately 20%, and the load accrues approximately 30%. However, the width distribution dw increases approximately five-hold, which greatly exceeds the allowable range.

In order to solve these problems, the present inventors analyzed the deformation behavior in the widthwise direction by plate thickness pressing in detail. The result will be described with reference to FIG. 7.

Figure 7A:
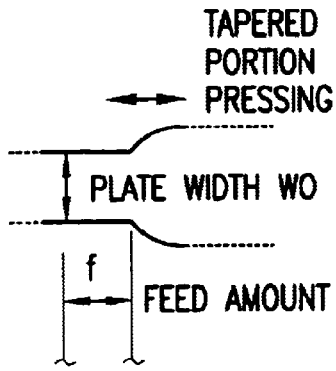
FIG. 7(*a*) is a view showing a profile of the slab which has been pressed in the n-th pass, and FIG. 7(*b*) is a view showing a profile of the slab which has been pressed in the (n+1)-th pass.
Figure 7B:
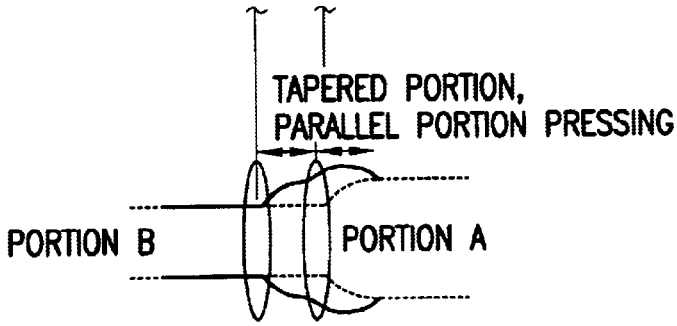

As shown in FIG. 7(*a*), the portion pressed by the die tapered portion 6*b* demonstrates large deformation in the widthwise direction at the time of pressing and is formed into a tapered shape. Thereafter, it is fed in the longitudinal direction and the width distribution dW is formed by the die parallel portion 6*a* by the next pressing operation. It was found that a position where the width distribution dW is minimum is a portion (portion A shown in FIG. 7(*b*)) pressed in the vicinity of the boundary between the tapered portion 6*b* and the parallel portion 6*a* of the die (the transition portion 6*c* and the vicinity thereof) and a position where the width distribution dW is maximum is a central pressing part of the parallel portion. Incidentally, a condition with which the width distribution dW becomes problems is one by which the feed amount f becomes larger than the taper portion contact length ld in connection with, for example, the large die taper angle θ or the large feed amount f. As a countermeasure, the present inventors considered application of light pressing as a sub process in particular in an interval of the main process using the dies.

It is preferable to perform the sub process at the portion A of the material, i.e., in an area where constriction of the width of the material occurs in the vicinity of a corner between the tapered portion 6*b* and the parallel portion 6*a* of the die in the main process of the (n+1)th pass. However, since this area is positioned directly below the die used for the main process, the sub process of this area is actually impossible. Thus, the present inventors examined about application of light pressing to the portion A and the neighboring portion in various ways. As a result, the present inventors discovered that it is good to previously apply light pressing to a portion which becomes the portion A in the (n+1)th pass while feeding the material in the longitudinal direction after completion of the n-th pass. A light pressing amount is much smaller than the reduction amount obtained by the tapered portion and the parallel portion of the die. Upon completion of pressing of the n-th pass, a portion B is positioned on the upstream side away from the portion A by a distance substantially corresponding to the feed amount f. The die for the sub process can be set at this portion.

The present inventors further examined about the portion for the sub process to which light pressing is to be applied and consequently obtained the following information (1) and (2):

(1) the effect of the sub process is lost by deformation caused due to the main process if the distance from the portion A is not more than 0.9 f; and (2) the effect of the sub process can not be observed if the distance from the portion A is not less than 1.1 f.

Based on the above information (1) and (2), it becomes apparent that an area where the sub process can effectively functions is a portion positioned on the upstream side away from a portion which is going to be the portion A in the next pass by a distance of (0.9 to 1.1)×f. Incidentally, in case of the one-stage die having only one tapered portion as in this embodiment, the sub process and the main process can be alternately performed.

In addition, if a position where the sub process is applied is identified based on the feed amount f of the material and the backward elongation amount BW at the time of pressing, application of the sub process on the further upstream side is enabled. At this time, the sub process application position can be given by the following expression (10). However, BW denotes the backward elongation amount at the time of pressing and n is a positive integer.

$$(0.9 \text{ to } 1.1)\times f+(f-BW)\times n \tag{10}$$

Figure 44:
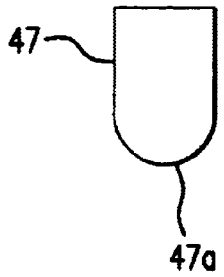
FIG. 44 is a view showing a profile of a die for a sub process.

Under the same conditions as the above-described experimental conditions with the feed amount f of 30 mm and the die tapered angle θ of 20°, such a sub die 47 as shown in FIG. 44 was used to apply the sub process around the part on the upstream side by only a distance 1.0×f from the transition portion 6*c* on the boundary between the tapered portion 6*b* and the parallel portion 6*a* of the die in an interval between the main process and that of the next pass.

A plate thickness pressing method involving the sub process will now be described with reference to FIGS. 43(*a*) to 43(*e*).

As shown in FIG. 43(*a*), when the main die 6 is performing the main process of the n-th pass, a sub mold 47 is in the standby mode. When the main process of the n-th pass is completed and the main die 6 is retracted as shown in FIG. 43(*b*), the sub die 47 is then used to apply light pressing (sub process) to a portion on the upstream side away from the portion subjected to the main process as shown in FIG. 43(*c*). In this case, the range in which the sub process is applied is a portion positioned on the upstream side by a distance (0.97 to 1.03)×f in the longitudinal direction. Also, the pressing amounts were determined as 0.1 mm (r=0.005), 0.5 mm (r=0.025), and 1.0 mm (r=0.050). Incidentally, assuming that the reduction amount of the main process is a reference value 1, a symbol r denotes an index indicating a ratio of a reduction amount of the sub process relative to this reference value. A shallow concave 48 is formed on the both upper and lower surfaces of the slab 20 at parts on the upstream side by the sub process.

Upon completion of the sub process of the n-th pass, the sub die 47 is retracted as shown in FIG. 43(*d*). Further, as shown in FIG. 43(*e*), the slab 20 is moved forward by only the feed amount f so that the concave 48 subjected to the sub process faces the transition portion 6*c* of the main die 6. Additionally, the area including the concave 48 is strongly pressed by the main die 6.

Description will now be given as to the sub process by using the sub/main reduction ratio r.

Figure 45:
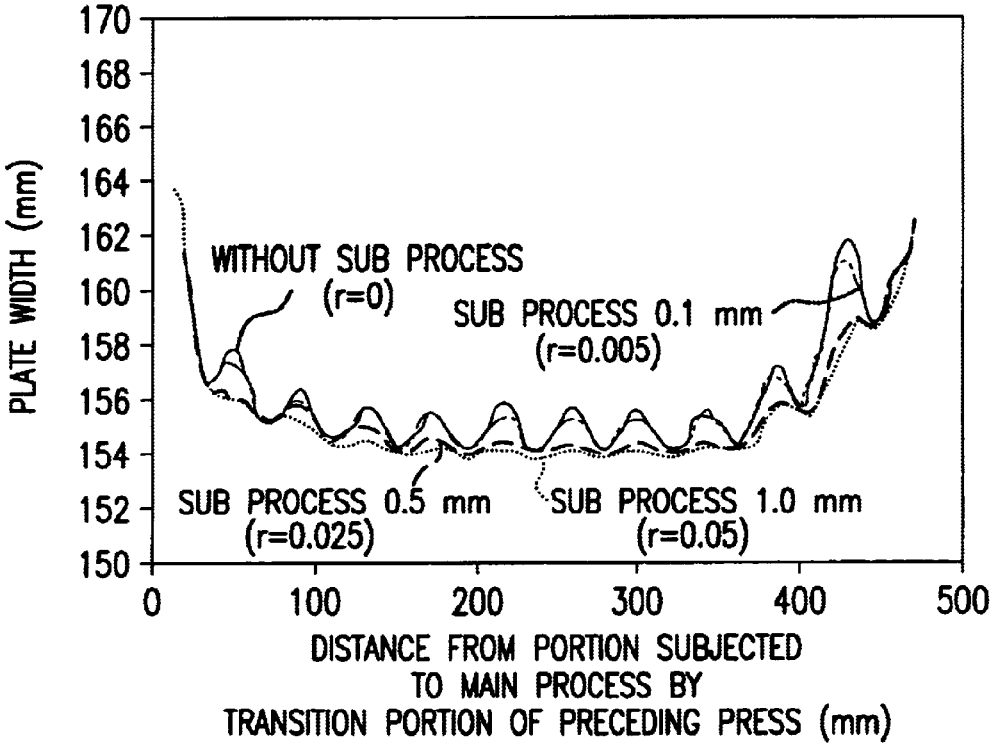
FIG. 45 is a characteristic diagram for illustrating results and advantages of the present invention.

FIG. 45 is a characteristic diagram having a horizontal axis representing a distance (mm) from the transition portion 6*c* of preceding pressing and a part subjected to the main process in the vicinity of the transition portion 6*c* and a vertical axis representing a plate width (mm) and shows a result of examining the correlation of these values when the sub/main reduction amount index r is changed in various ways within a range of 0 to 0.05. Examination was carried out by variously changing the reduction amount of the sub process in a range of 0 to 1.0 with the reduction amount of the main process being fixed to 20 mm. Consequently, as apparent from the drawing, the obvious effect was not observed with the sub/main reduction amount index r of 0.005 (reduction amount: 0.1 mm). However, when r was 0.025 (reduction amount: 0.5 mm) and 0.05 (reduction amount: 1.0 mm), the width distribution dW became small and the width extension was also somewhat reduced. It is to be noted that a significant difference was not recognized between r=0.025 and r=0.05. Although the similar sub process was carried out by using the die having a wedge shape, the same result as that shown in FIG. 45 was obtained.

Figure 46:
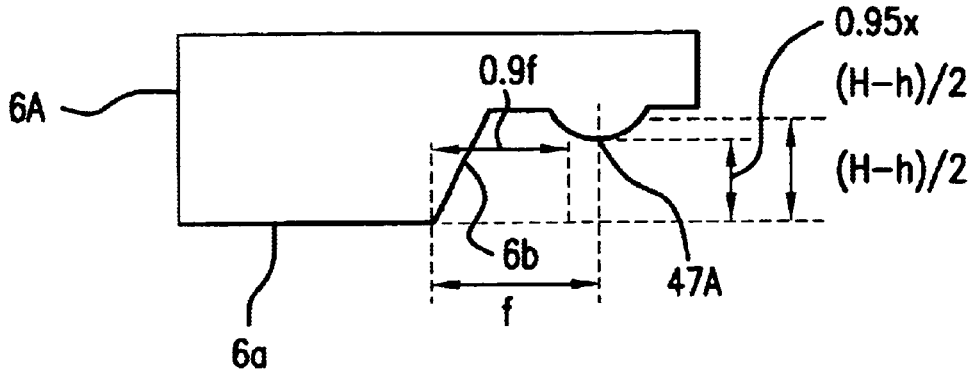
FIG. 46 is a schematic drawing showing with exaggeration a profile of a die (another embodiment) for simultaneously performing the main process and the sub process.

Here, as to the timing for starting the sub process, if the dies 47 for the sub process is different from the dies 6 for the main process, the dies may be brought into contact with each other depending on the shape of the used dies and the feeding amount f. Therefore, starting the sub process during the main process is not preferable. However, if a die 6A such as shown in FIG. 46 is used to simultaneously start the main process and the sub process so that the main process and the sub process can be terminated at the same time, such a problem can be eliminated. In other words, it is good enough to start the sub process when only (1−r) among the entire reduction amount (H−h) of the main process is completed and terminate the main process and the sub process at the same time.

As a die used herein, there is employed a die 6A shown in FIG. 46 which performs the main process by using a one-stage taper. The die 6A has a protrusion 47A for the sub process, which can be attached/detached on the input side of the tapered portion 6*b*. That is, the parallel portion 6*a* and the tapered portion 6*b* are used to apply the main process to the hot slab 20 and, at the same time, the protrusion 47A is used to apply the sub process. However, the material feed amount f must be larger than the die tapered portion contact length ld and the feed amount f must be substantially fixed as necessary conditions.

Figure 47:
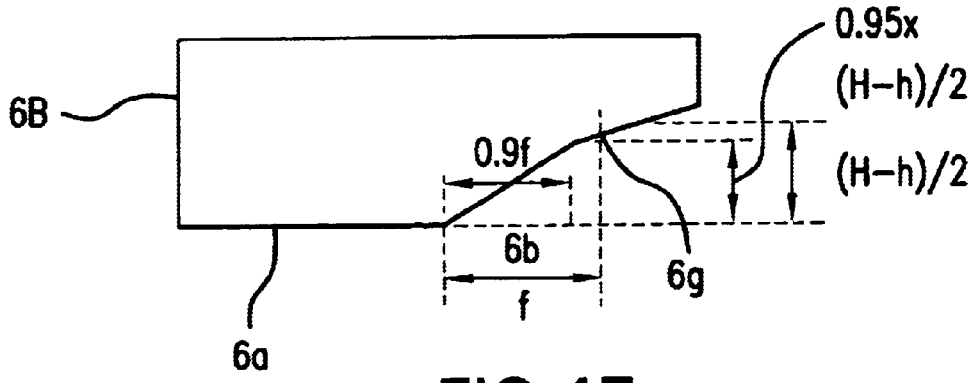
FIG. 47 is a schematic drawing showing with exaggeration a profile of a die for the main process, which has an angle change portion chamfered or R-processed.

Additionally, a die 6B shown in FIG. 47 can be also used. The die 6B has a surface 6*g* for the sub process on the input side of the tapered portion 6*b*. That is, the parallel portion 6*a* and the tapered portion 6*b* are used to apply the main process to the hot slab 20 and, at the same time, the surface 6*g* for the sub process is used to perform light pressing. However, the feed amount f must be slightly larger than the tapered portion main process surface 6*b* and the feed amount f must be substantially fixed as necessary conditions.

In case of the die 6B shown in FIG. 47, an appropriate chamfer or an R-processed surface 6*g* is formed at an angle change portion. The chamfer R type is most preferable in view of facilitation of the process of the die. Further, it is desirable to form the chamfer R larger on the boundary between the sub process portion and the main process portion of the die 6A.

By performing the sub process, there can be obtained the effect that the width distribution can be reduced in order to further enlarge the minimum width extension of the width distribution. Moreover, when pressing is hardly applied to the material in the vicinity of the portion A shown in FIG. 7(*b*), it is possible to obtain the effect for providing the binding force to the width extension due to pressing by the tapered portion of the (n+1)th pass in the vicinity of the portion A, thereby minimizing the width extension itself.

(Seventh Group of Embodiments)

(Multi-stage Die)

Various kinds of multi-stage die will now be described with reference to FIGS. 48 to 54.

It is difficult for the one-stage taper type die to satisfy restriction conditions for suppression of the width extension and for reduction in the load and suppression of the width distribution. A die having multiple tapered portions is, therefore, required. As a countermeasure, the present inventors examined the die having multiple tapered portions in order to provide a sub process function as similar to the above-described one-stage die.

As a result, when the taper portion which can be a main processing surface has two stages (tapers 1 and 2 from the parallel portion side) in particular, it is general that a sub processing surface (taper 3) is formed so as to follow the main processing surface and the contact length is shorted with taper angles θ1 and θ2 (θ1<θ2). It is, however, desirable to set an average angle of the tapered portions 1 to 3 to be not less than 15° in this example. Here, the average angle means an angle formed at a point where the angle between the parallel portion and the tapered angle and the tapered portion come into contact with the surface of the material under a pressure having a specified quantity.

As to the contact lengths L1, L2 and L3 of the respective tapered angle and the material in the longitudinal direction, if the contact length of the tapered portion is long, increase in the load or in the width extension may occur. The contact length L3 on the sub processing surface should be shorter as much as possible, and it is desirable that the these lengths have the relationship for satisfying the following inequality (11) in reality:

$$L3/(L1+L2+L3)<0.1 \quad (11)$$

Further, if the taper angle θ is large, a slip may occur at the beginning of contact. Thus, the angle θ1 of the tapered portion 1 must be set to a value less than 15° as an angle hardly causing a slip.

In addition, the slip of the material rarely occurs when the processing surface used for the sub process is brought into contact with the taper 1 of the next pass. This condition satisfies the relationship of the following expression (12) when the feed amount of the material or the die in the longitudinal direction is determined as f:

$$(L1+L2)=(0.9 \text{ to } 1)\times f \quad (12)$$

The lower limit value is determined by a fact that the contact length L3 is small. Moreover, when a difference between θ1 and θ3 is large, a slip occurs. Therefore, |θ1−θ3|<5° must be satisfied.

Figure 48:
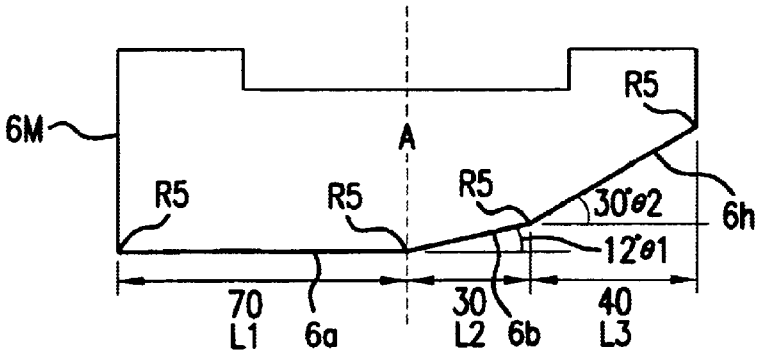
FIG. 48 is a view showing a profile of a die (A type; two-stage tapered type) as a comparative example.
Figure 49:
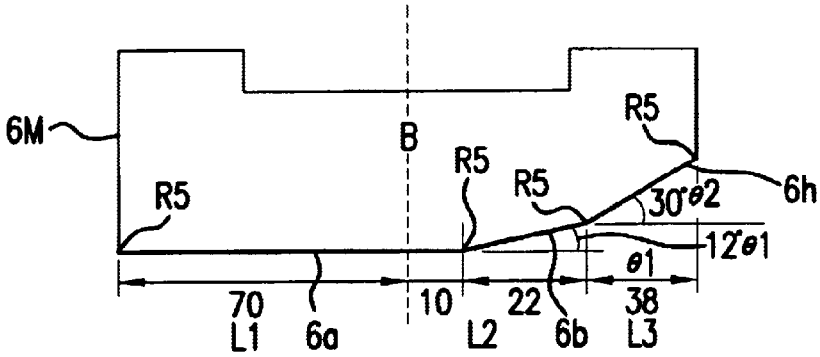
FIG. 49 is a view showing a profile of a die (B type; two-stage tapered type) as a comparative example.
Figure 50:
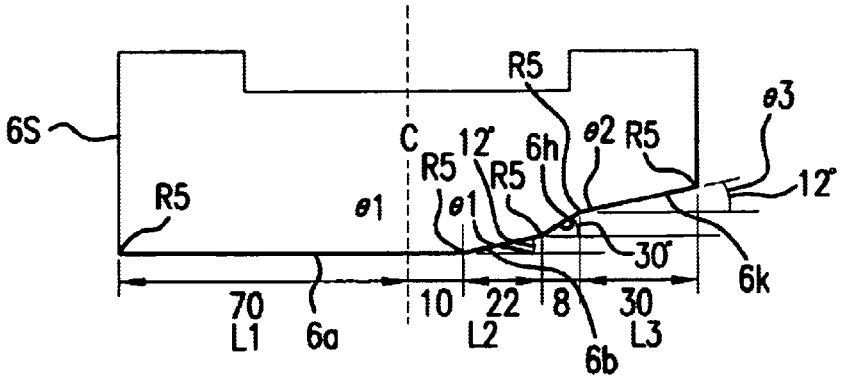
FIG. 50 is a view showing a profile of a die (C type; two-stage tapered type) as a comparative example.

The present inventors performed a simulative test by using multi-stage dies 6M (type A), 6N (type B) and 6S (type C) shown in FIGS. 48 to 50 under the following conditions:

Conditions of Experiment

Simulative material: hard lead (initial size: plate thickness H 32 mm×width W 150 mm×L)

Plate thickness h after pressing: 12.5 mm

Feed amount f: 30 mm

Taper angle θ of die: respectively shown in FIGS. 48 to 50 and 54

L1, L2 and L3: respectively shown in FIGS. 48 to 50 and 54.

It is to be noted that the tapered portion contact length ld of the type B die 6N is substantially equal to the feed amount f.

Figure 51:
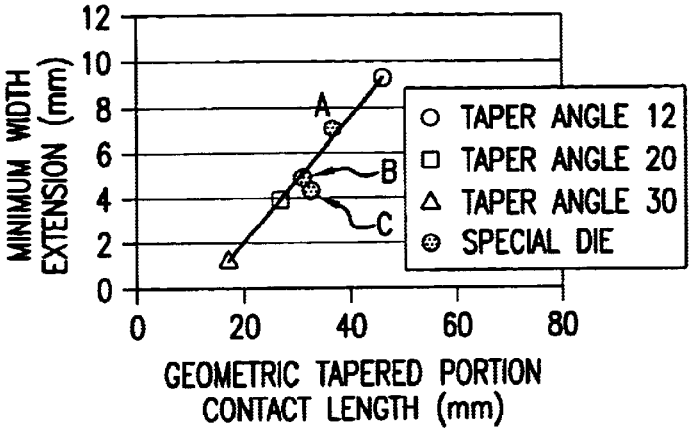
FIG. 51 is a characteristic diagram for illustrating results and advantages of the present invention.
Figure 52:
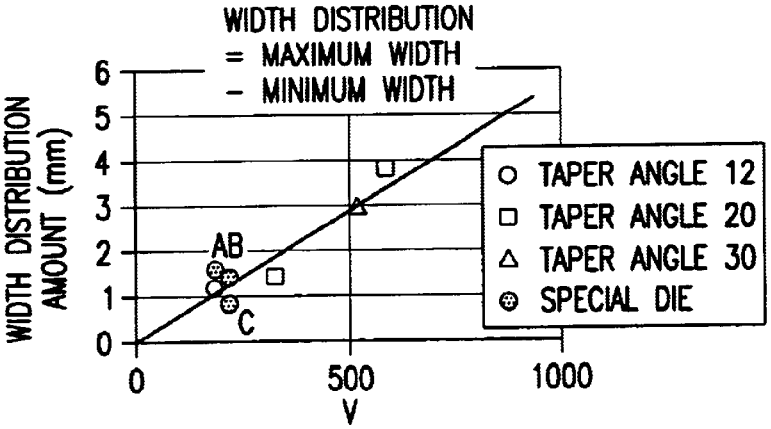
FIG. 52 is a characteristic diagram for illustrating results and advantages of the present invention.
Figure 53:
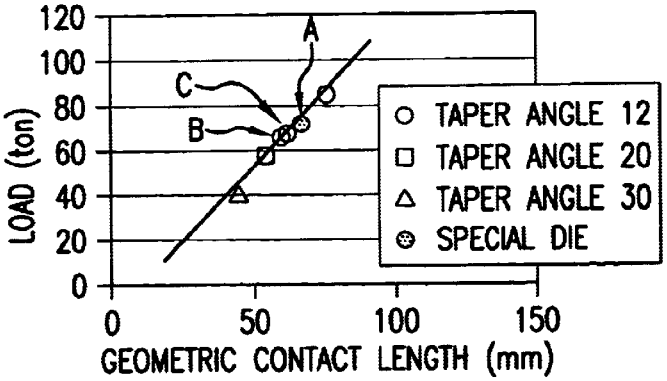
FIG. 53 is a characteristic diagram for illustrating results and advantages of the present invention.

FIGS. 51 to 53 show experimental results (including a result obtained with the type C die 6S according to the embodiment).

FIG. 51 is a characteristic diagram having a horizontal axis representing a geometric tapered portion contact length (mm) and a vertical axis representing a minimum extension (mm) and shows a result of examining the correlation of the both values. In the drawing, a white circle indicates a result obtained with the taper angle 12° a white square, a result obtained with the taper angle 20° a white triangle, a result obtained with the taper angle 30°; and a hatching circle, a result obtained with a special die 6S (type C).

FIG. 52 is a characteristic diagram having a horizontal axis representing a reduction volume V and a vertical axis representing a width distribution amount (mm) and shows a result of examining the correlation of the both values. In the drawing, a white circle indicates a result obtained with the taper angle 12°; a white square, a result obtained with the taper angle 20°; a white triangle, a result obtained with a taper angle 30°; and a hating circle, a result obtained with a special die 6S (type C).

FIG. 53 is a characteristic diagrams having a horizontal axis representing a geometric contact length (mm) and a vertical axis representing a load (ton) and shows a result of examining the correlation of the both values. In the drawing, a white circle indicates a result obtained with the taper angle 12; a white square, a result obtained with the taper angle 20°; a white triangle, a result obtained with a taper angle 30°; and a hating circle, a result obtained with a special die 6S (type C).

Based on the results shown in FIGS. 51, 52 and 53, it was found that setting the average taper angle of the die at 15° or above can obtain the effect for reducing the load or suppressing the width extension but the width distribution dW of the multi-stage dies becomes slightly larger than that of the one-stage tapered die if the bottom side taper angle is small and the upper side taper angle is large as in the type A die 6M and the type B die 6N in order to shorten the contact length ld. It can be considered that this is because pressing the material with large force in the state of a previous pass with the parallel portion pressing has an influence.

Further, it was found that a slip of the die and the material is generated and pressing becomes unstable under press conditions (feed and reduction amounts) such that the die bottom portion taper is brought into contact with the upper tapered portion on the material side which has been generated by pressing of the previous pass.

Thus, the present inventors completed the type C die 6S having a sub processing surface which performs reduction with an extremely small amount on the main processing surface in order to suppress the above-described width distribution and prevent a slip from being generated at the beginning of pressing.

Although the sub processing surface of the type C die 6S lightly presses a part near the surface layer of the material, the contact length and the average taper angle are almost the same as those of the type B die 6N because of a small reduction amount. Furthermore, in case of pressing of the next pass, since the main processing surface is brought into contact with the material on the inclined surface having an angle of 12° pressed by the sub processing surface, a slip of the material does not occur.

As a result of the experiment using the type C die 6S, the following effects were found. That is, lightly deforming a part near the surface of the material can widen a neck portion of the width distribution to suppress the width distribution and can also restrain the width extension. Moreover, setting the angle of the sub processing surface to ±5° with respect to the main processing surface can avoid generation of a slip. In addition, the obtained result about the load was substantially the same as that of the type B die 6N.

The similar examination was carried out relative to the die having a taper angle of the sub processing surface of 5° to 20° (any other shape is the same with that of the type C die 6S). Although no slip of the material occurred with the taper angle of 7° to 17°, a slip was generated when the taper angle exceeds that range.

Based on the above examination, the load can be reduced when the average oblique angle of the tapered portion of the main processing surface is not less than 15°. However, when a difference in angle between the upper taper and the bottom taper is not less than 5°, a slip of the material is apt to be generated. If the taper angle of the bottom portion is not less than 15° from the result of examination of the one-stage taper, however, the material may slip. Therefore, by causing the sub processing surface to have an angle of not more than ±5° relative to the inclined angle of the main processing surface and pressing the surface once processed by the sub processing die by the main process tapered portion 1 in the next pass, generation of a slip can be prevented and the width distribution and the width extension can be decreased. Incidentally, since the long contact length of the sub processing die leads to increase in the load or in the width extension, it is desirable that the length of the sub processing portion is not more than 10% of the entire contact length. Additionally, it is desirable that the length of the main processing tapered portion (L1+L2) is 0.9 to 1.0-fold of the feed amount in order to press the sub process die processing surface by the main process tapered portion in the next pass.

According to the present invention, it was able to suppress the width distribution and the width extension itself by adding the sub process to the main process of the hot slab. Further, by adding the sub processing surface to the die having the main processing surface with the multi-stage taper, it is possible to realize all of reduction in the load and suppression of the width extension, the width distribution and the slip.

(Eighth Group of Embodiments)

Figure 55A:
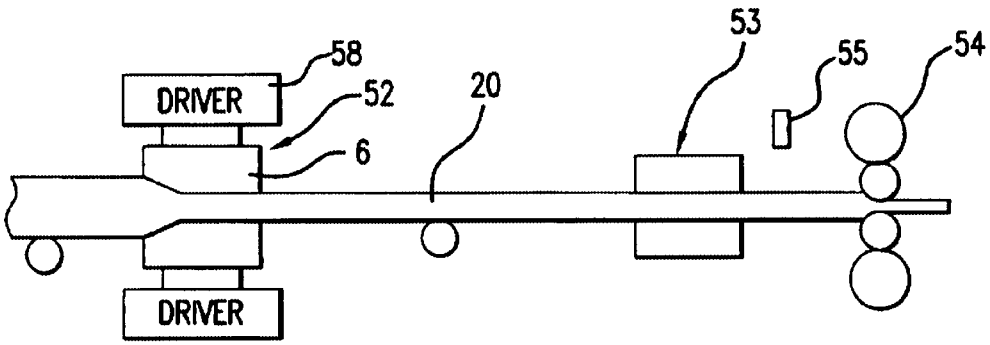
FIGS. 55A and 55(B) are block diagrams showing an eighth embodiment according to the present invention.
Figure 55B:
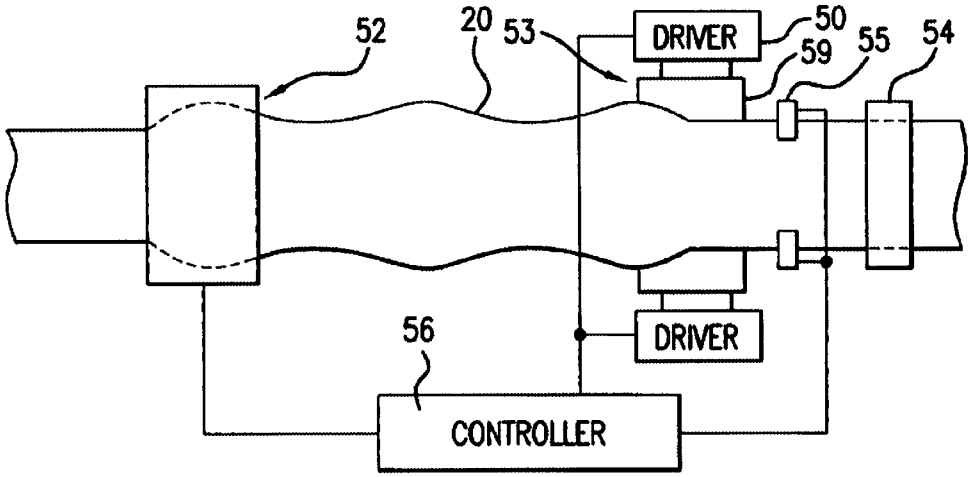

FIG. 55 show a structure of a slab forming apparatus according to an eighth embodiment of the present invention. FIG. 55(A) is a side elevation, and FIG. 55(B) is a plane view. The slab forming apparatus is constituted by a thickness reduction press 52 for reducing the thickness of the slab 20 and a width reduction press 53 provided on the downstream side of the press 52. It is to be noted that a rolling mill 54 is arranged on the downstream side of the width reduction press 53 to conduct rolling. A width measuring instrument 55 for measuring the width of the slab 20 subjected to width reduction by the width reduction press 53 is provided on the output side of the width reduction press 53. There is a controller 56 which inputs a measured value of the width measuring instrument 55 and controls the thickness reduction press 52 and the width reduction press 53.

The thickness reduction press 52 is composed of dies 6 vertically provided so as to sandwich the slab 20 and a driver 58 for vertically moving the dies 6. As the driver 58, there is used a mechanical device, vertically moving a rod by rotating an eccentric shaft and drives the dies 6 by the rod or a hydraulic device,in which hydraulic cylinder generates the vertical movement. As the die 6, there is employed a tapered die having the side coming into contact with the slab 20, the side being composed of a horizontal surface and a tapered surface.

The width reduction press 53 is constituted by dies 59 horizontally provided so as to sandwich the slab 20 in the widthwise direction and a driver 50 reciprocating the dies 59 in the widthwise direction. As the driver 50, there is used a hydraulic cylinder for adjusting a gap (opening) of the both dies 59 in the widthwise direction. As the die 59, there is employed a tapered die having a side coming into contact with the slab 20, the side being composed of a horizontal surface and a tapered surface, as similar to the thickness reduction press 52.

The operation will now be described.

The controller 56 controls the thickness reduction press 52 and the width reduction press 53 and alternately operates the thickness reduction press 52 and the width reduction press 53. Drive sources of the thickness reduction press 52 and the width reduction press 53 are electric motors, and a power supply capacity can be a capacity (in general, the thickness reduction press 52 requires more power than the width reduction press 53) required for operating the thickness reduction press 52 by alternately operating the presses.

Figure 56:
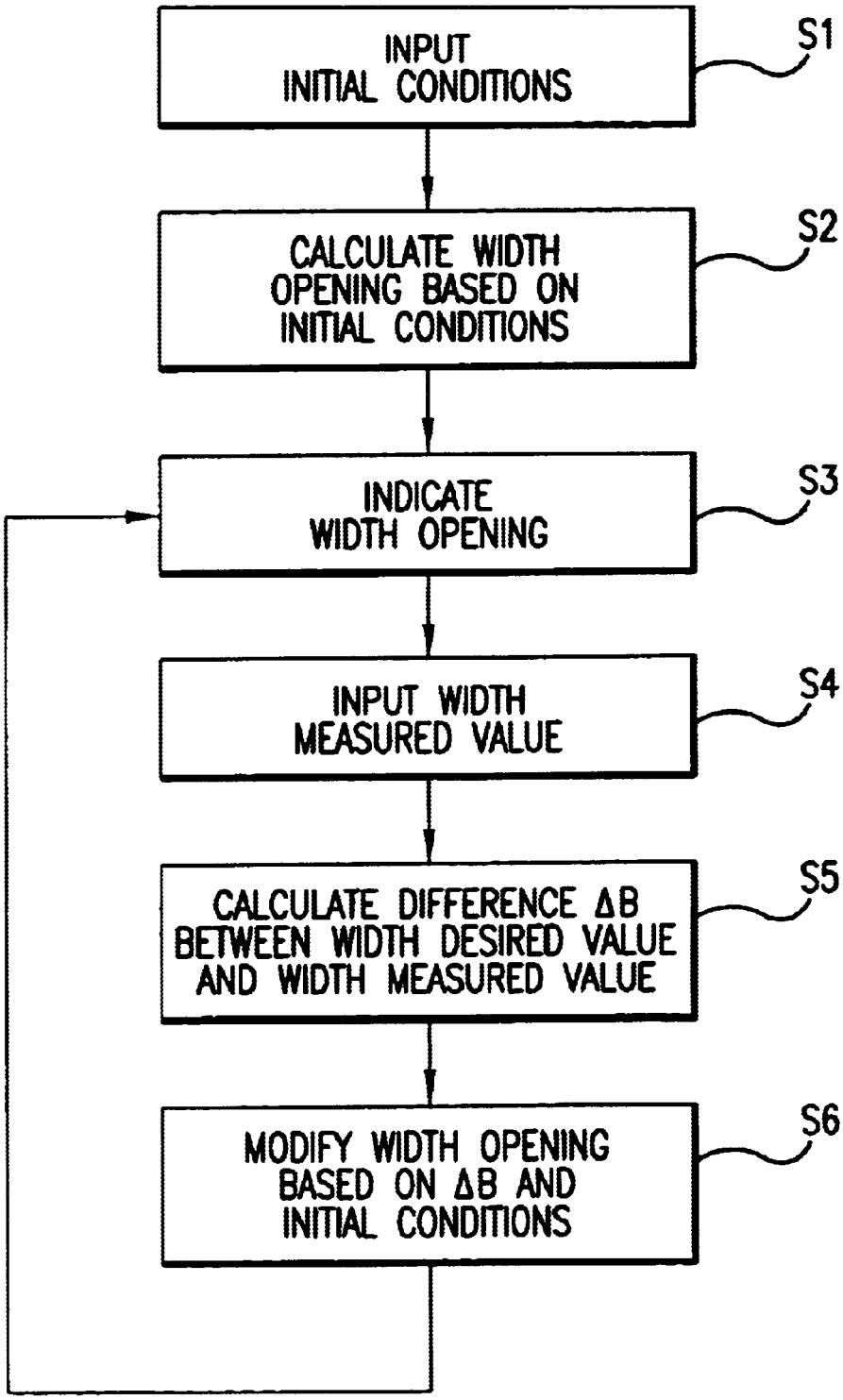
FIG. 56 is a flowchart showing an operation of a controller according to another preferred embodiment of the present invention.

The controller 56 also controls the opening of the width reduction press 53. FIG. 56 is a flowchart showing the control of an opening of the width reduction press 53, and the opening control will be described with reference to this drawing. When the thickness of the material is largely reduced by the thickness reduction press 52, a volume of the slab 20 flows in the four directions and further expands in the widthwise direction. The slab 20 expands in a corrugated form as typically shown in FIG. 55(B). The corrugated form is straightened and the width opening is set so as to obtain a desired plate width B. It is to be noted that the desired plate width B can not be obtained because of the return generated after pressing even if the width opening is set to the desired plate width B. A condition which has an influence on this return is referred to as initial conditions. The initial conditions include a substance of the slab 20, a temperature, a thickness reduction amount of the thickness reduction press 52, a thickness or a width of the slab 20 before thickness reduction, a feed speed and the like of the slab 20, and a desired plate width B.

The controller 56 inputs such initial conditions (step S1) and calculates the width opening based on the initial conditions (step S2). According to the method for calculating the width opening based on the initial conditions, the influence on the return of each condition is obtained from the conventional experiences or experiments and the width opening is then calculated based on this data. The thus calculated width opening is directed to the width reduction press 53 (step S3). The width reduction press 53 performs the width reduction of the slab 20 based on this width opening.

The width of the slab 20 subjected to the width reduction is measured by the width measuring instrument 55 and fed back to the controller 56 (step S4). The controller 56 calculates a difference ΔB between the desired plate width B and the width measured value (step S5). The width opening is modified by using the data of the influence on the return of each initial condition described above based on the difference ΔB and the initial conditions (step S6). The modified width opening is indicated to the width reduction press 53 in order to use this width opening in the next width reduction pressing (step S3). In this manner, the slab 20 having a desired plate width can be obtained by repeating the steps S3 to S6. It is to be noted that utilizing a learning function using the modification result in calculation of the next modification value can rapidly obtain the desired plate width.

Incidentally, although the thickness reduction press 52 and the width reduction press 53 are alternately operated by the controller 56 in the above embodiment, the both presses may be mechanically coupled with each other so that they can alternately operate.

As apparent from the above description, the present invention can assuredly modify the deformation of the slab in the widthwise direction by providing the width reduction press on the downstream side of the thickness reduction press. Further, alternately operating the both presses can reduce the capacity of the power supply. In addition, since the width opening of the press is corrected based on the measured value of the plate width obtained by width reduction pressing, a desired plate width can be rapidly obtained.

(Ninth Group of Embodiments)

Moreover, the present inventors examined generation of a slip of the material at the time of plate thickness pressing. As a result, it was found that the slip occurs at the beginning of contact of the die and the material (hot slab) and no slip occurs when reduction has proceeded to some degree. Here, in forging, a position where the die comes into contact with the material is a substantially parallel portion (in the present invention, the parallel portion of the die and a portion where an oblique angle is not more than 5 degrees in the transition area are referred to as a substantially parallel portion in all) or the tapered portion of the die depending on a reduction amount, a feed amount or a taper angle of the die.

Figure 57:
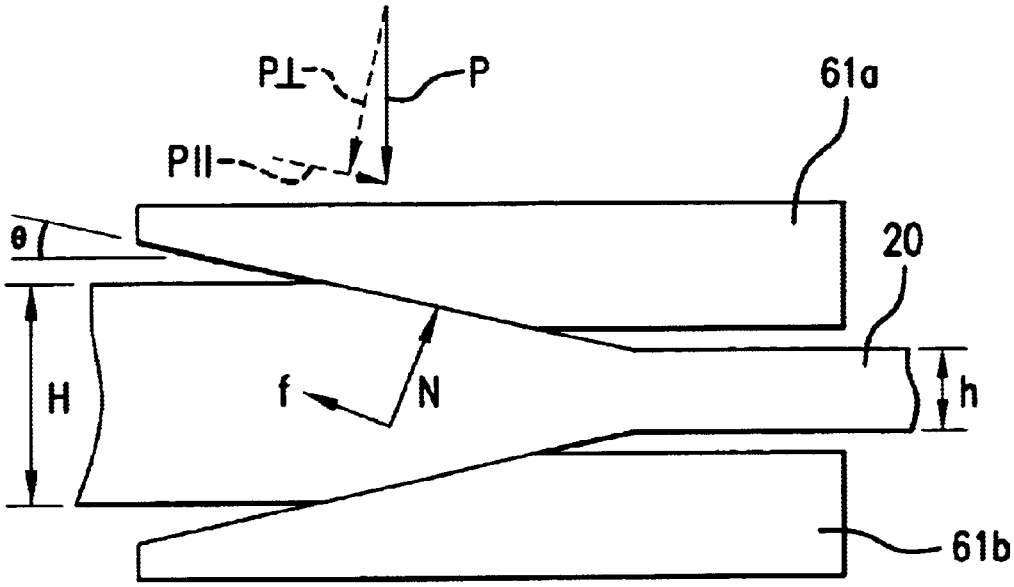
FIG. 57 is an explanatory view showing the state when a tapered portion of a die starts to contact with a material.

FIG. 57 typically shows force acting on the die at the beginning of contact when the contact starting surface of the die is the tapered portion. In FIG. 57, reference character P denotes external force for pushing the dies 61*a* and 61*b* against the hot slab 20; N, reactive force acting on the dies from the hot slab 20; and f, frictional force acting between the hot slab and the dies. In FIG. 57, in order to keep forging without causing slips of the dies 61*a* and 61*b*, the frictional force f in FIG. 57 must be equal to component force Py in the taper direction. When the component force Py exceeds the maximum static frictional force $\mu$N, the dies 61*a* and 61*b* and the hot slab 20 start to slip. Therefore, expressing the condition under which no slip occurs by using the friction coefficient $\mu$ and the angle θ between the hot slab 20 and the dies 61*a* and 61*b*, $\mu \geqq \tan\theta$ is obtained. It is to be noted that reference character H denotes a plate thickness of the hot slab 20 before pressing and h designate a plate thickness of the hot slab 20 after pressing in FIG. 57.

In hot forging, the contact state between the material and the die is bad because of a rough cast surface and generation of scale on the cast surface lowers the friction coefficient $\mu$ between the material and the die. Therefore, if the contact start surface is the tapered portion of the die, a generation frequency of slips becomes high.

In the meantime, if the angle of the tapered portion is not more than 15 degrees and a reduction amount is not large or a feed amount of the material is small, the surface of the material once forged by the tapered portion of the die is frequently brought into contact with the die from the tapered portion thereof in forging of the next cycle, thereby heightening the generation frequency of slips.

Moreover, in the experiment conducted by the inventors, no slip occurred when the oblique angle of the tapered portion of the die was approximately 5 degrees. It can be considered that no slip was generated because the component force of the pressing force in the input side direction was small. However, when the oblique angle of the tapered portion is not more than 5 degrees, the contact length of the material and the die in the longitudinal direction becomes extremely long, which may cause increase in the load or in the deformation along a direction (widthwise direction in the drawing) vertical to a forging direction. Therefore this is not practical.

Figure 58:
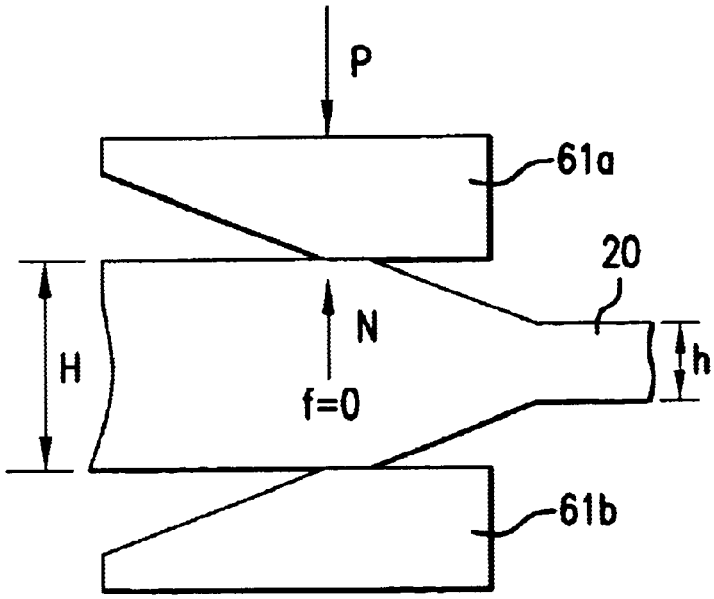
FIG. 58 is an explanatory view of a forging method according to another embodiment of the present invention.

On the other hand, as opposed to FIG. 57, when the contact start surface between the dies 61*a* and 61*b* and the hot slab 20 is the parallel portion 6*a* of the dies 61*a* and 61*b* as shown in FIG. 58, the component force of the reduction force does not act in the direction of the tapered portion. Thus, no slip occurs. Further, according to the result of the experiment conducted by the present inventors, no slip occurs even if the parallel portion 6*a* of the dies 61*a* and 61*b* has an oblique angle of approximately 5 degrees. Therefore, even if contact starts from a portion with an oblique angle of not more than 5 degrees in the transition area 6*c* from the parallel portion 6*a* to the tapered portion 6*b*, no slip occurs.

Incidentally, when the slab is brought into contact with the die from the parallel portion, no slip occurs even if the friction coefficient is decreased. It is, therefore, very effective to apply the lubricant on the main processing surface of the die to reduce the load.

(Concrete Example)

One preferred embodiment according to the present invention will now be described with reference to the drawings.

Figure 1A:
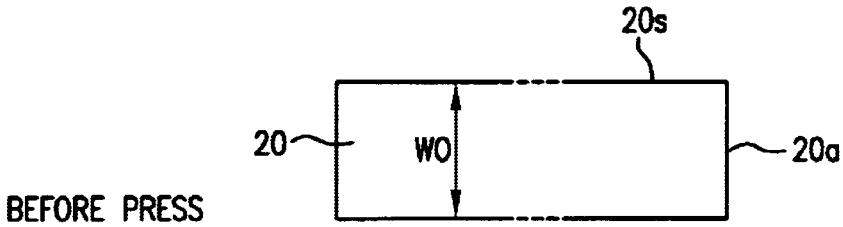
FIG.1A (PRIOR ART)
FIG. 1(*a*) is a plane view showing a hot slab before pressing, FIG. 1(*b*) is a plane view showing an outline of the hot slab after pressing, and FIG. 1(*c*) is an enlarged plane view showing an end of the hot slab after pressing.
Figure 1B:
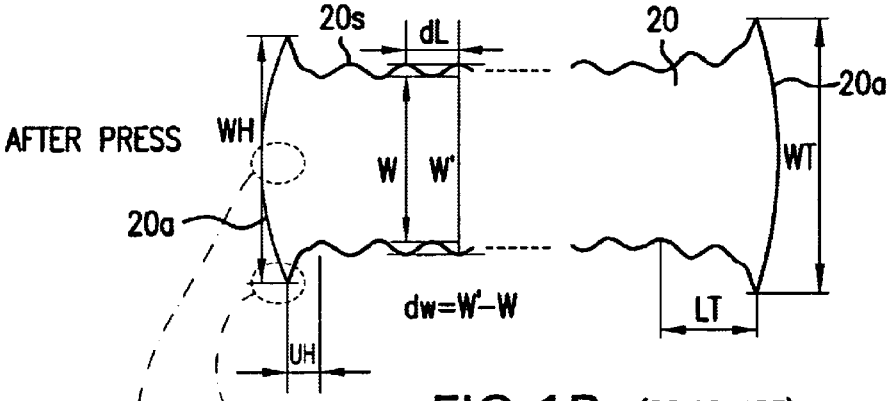
FIG.1B (PRIOR ART)
Figure 1C:
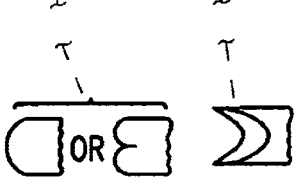
FIG.1C (PRIOR ART)
Figure 2A:
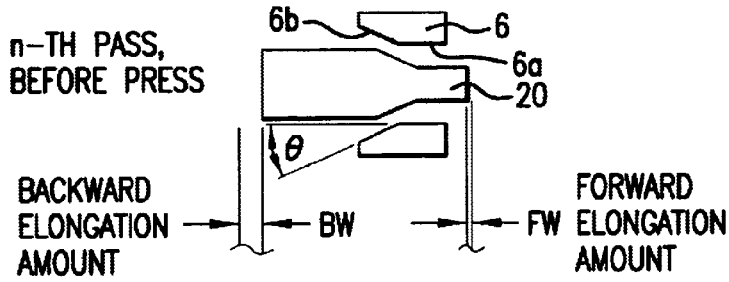
FIG.2A (PRIOR ART)
FIGS. 2(*a*) to 2(*d*) are views showing a slab and a die for illustrating a conventional plate thickness pressing method.
Figure 2B:
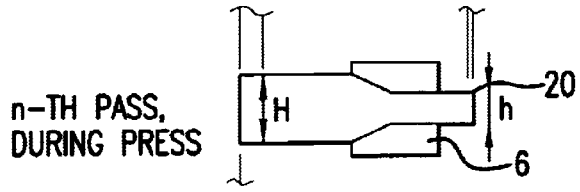
FIG.2B (PRIOR ART)
Figure 2C:
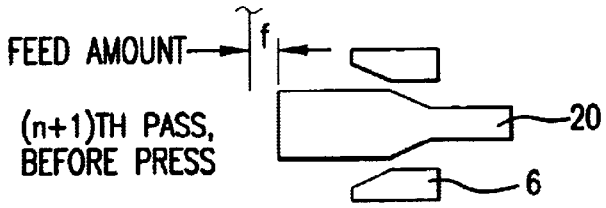
FIG.2C (PRIOR ART)
Figure 2D:
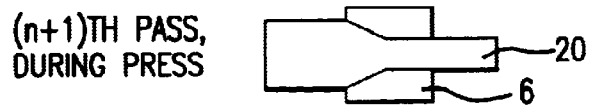
FIG.2D (PRIOR ART)
Figure 3:
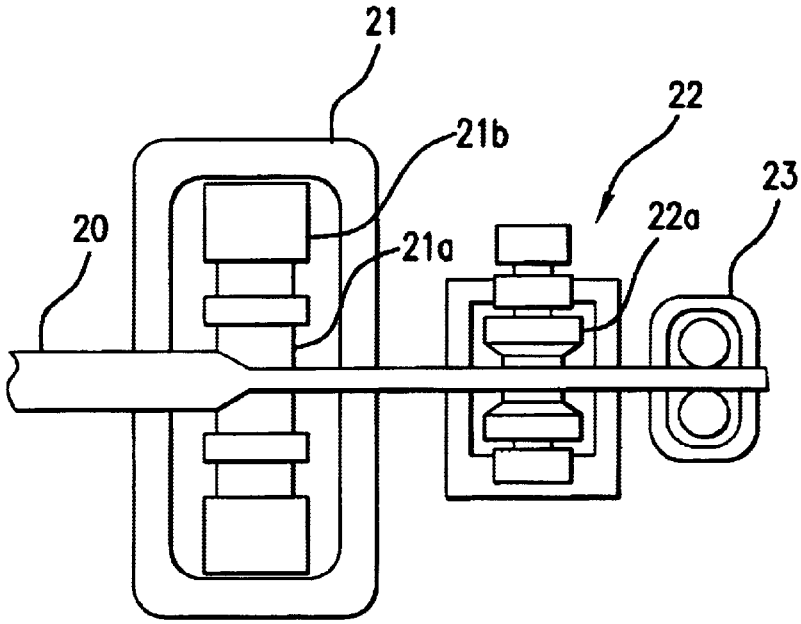
FIG.3 (PRIOR ART)
FIG. 3 is a view showing a structure of a conventional slab forming device.
Figure 4:
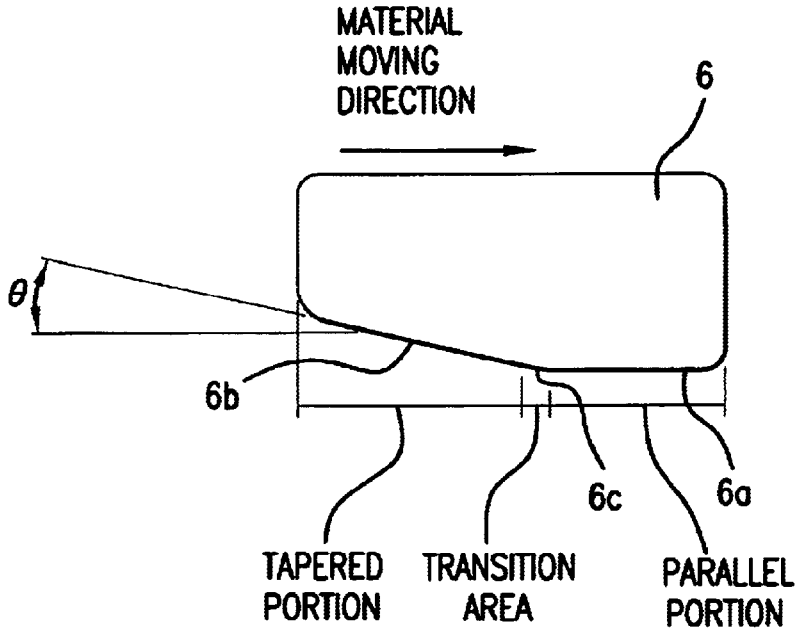
FIG.4 (PRIOR ART)
FIG. 4 is a plane view showing a shape of a general die used for forging the hot slab.
Figure 5A:
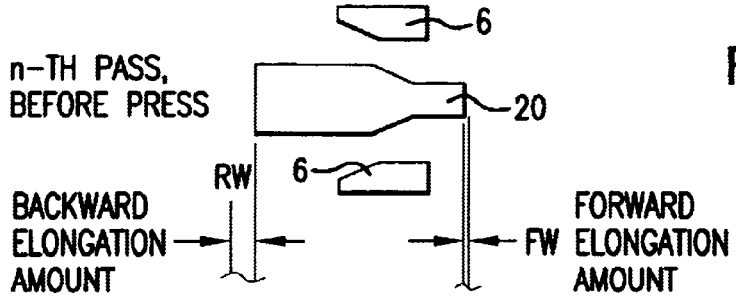
FIG.5A (PRIOR ART)
FIG. 5 are views showing a prior art forging method in the step order, in which FIG. 5(*a*) is a schematic drawing showing the die and the slab before pressing of the n-th pass, FIG. 5(*b*) is a schematic drawing showing the die and the slab during pressing of the n-th pass, and FIG. 5(*c*) is a schematic drawing showing the die and the slab before pressing of the (n+1)th pass.
Figure 5B:
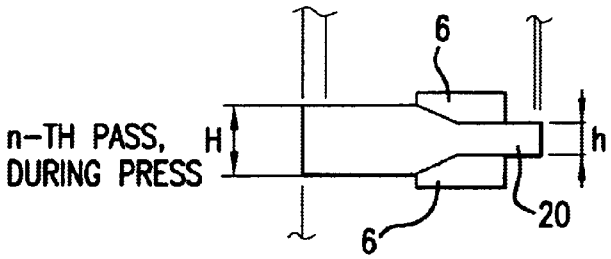
FIG.5B (PRIOR ART)
Figure 5C:
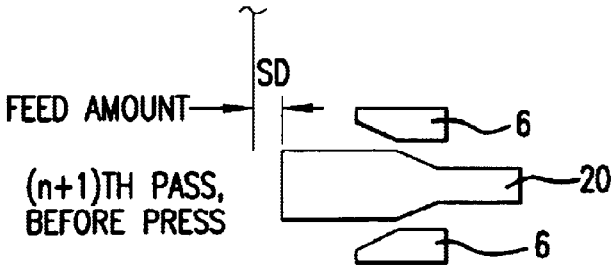
FIG.5C (PRIOR ART)
Figure 6A:
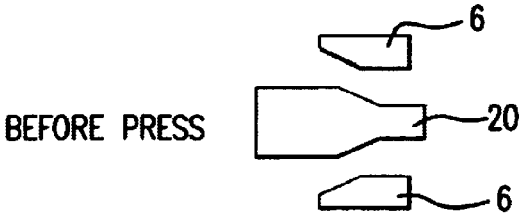
FIG.6A (PRIOR ART)
FIGS. 6(A) and 6(B) are explanatory views of generation of a slip in the conventional forging method.
Figure 6B:
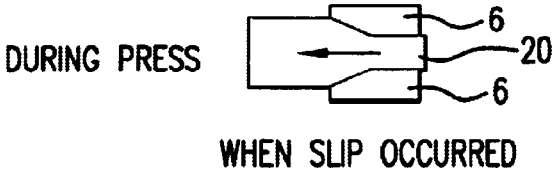
FIG.6B (PRIOR ART)
Figure 59:
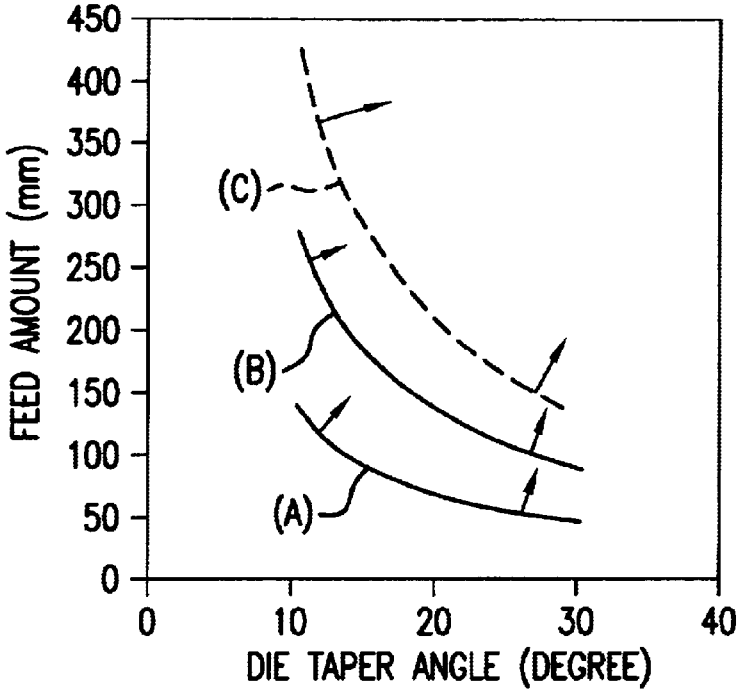
FIG. 59 is a characteristic view showing the relationship between a taper angle of a die, a feed amount and a reduction amount.

In this embodiment, there is used a die having a one-stage tapered portion on the input side as shown in FIG. 4. FIG. 59 shows the relationship between the taper angle, the feed amount and the reduction amount when the one-stage die is used. In FIG. 59, (A) shows the case of a reduction amount of 50 mm; (B), the case of a reduction of 100 mm; and (C), the case of a reduction amount of 150 mm. No slip occurs at the time of pressing in ranges indicated by arrows in FIG. 59 (ranges above the curved lines), and stable pressing is enabled. Considering the case where the feed amount and the reduction amount are fixed and only the taper angle of the die is changed, the press load is reduced as the taper angle of the die increases. Therefore, the press load can be effectively reduced by pressing in the ranges shown in FIG. 59.

In addition, the prevent inventors examined the effect of load reduction when the friction coefficient was reduced by applying the lubricant on the parallel portion, the tapered portion on the main processing surface of the die and the entire main processing surface under the press conditions within the ranges according to the present invention. The load reduction ratios in the parallel portion, the tapered portion and the entire main processing surface were 10%, 20% and 30%, respectively. At this time, no slip was generated, and the load can be reduced by using the lubricant while maintaining the stability of pressing.

Figure 8:
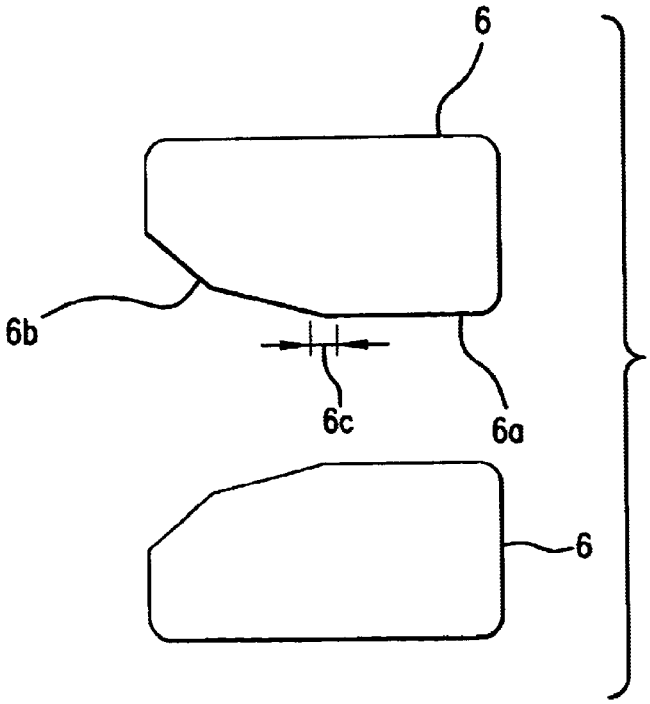
FIG. 8 is a plane view showing a two-stage tapered die.

Incidentally, although the above has described the die having the one-stage tapered portion on the input side in the foregoing embodiment, the present invention is not restricted thereto and can be applied to a die 6 having a multi-stage inclination, e.g., a die having a two-stage tapered portion on the input side as shown in FIG. 8.

As described above in detail, according to the method for forging the hot slab of the present invention, it is possible to avoid generation of a slip at the time of pressing by forging the contact start surface of the hot slab and the die as the transition area between the tapered portion and the parallel portion and a part of the parallel portion without performing any special die process. Accordingly, an operational problem caused due to generation of a slip can be prevented from occurring. Further, considering gradual increase in the taper angle of the die from the outside of the range according to the present invention with the same reduction amount and the same feed amount, the taper angle of the die tends to increase in the present invention, which results in reduction in the press load. Moreover, since any special process does not have to be applied to the surface of the die, the die processing cost can be decreased, and a complicated control required when a slip occurs does not have to be carried out.

Further, no slip occurs on all or a part of the main processing surface of the die even if the lubricant is applied to all or a part of the main processing surface of the die to reduce the entire friction coefficient. Therefore, the load can be reduced while maintaining the stability of pressing.

(Tenth Group of Embodiments)

Furthermore, the present inventors changed the friction coefficient in various ways by diversely varying portions to which the lubricant is supplied and experimentally examined the load reduction effect and change in the forward elongation amount FW. That is, the load and the forward elongation amount FW were measured in cases where the lubricant is supplied only to the die parallel portion 6*a*, where the lubricant is supplied only to the die tapered portion 6*b* and where the lubricant is supplied to all the surfaces 6*a*, 6*b* and 6*c* of the die, respectively. Table 1 shows its result. Incidentally, the forward elongation amount ratio is an index given by FW/(FW+RW) in Table 1. It is to be noted that the value (FW+RW) is substantially fixed under the same press conditions.

As apparent from Table 1, although the load reduction effect obtained by lubrication on the die tapered portion 6*b* is large, lubrication only to the parallel portion 6*a* is also effective. Further, it was found that the forward elongation amount FW is reduced when lubricating the die tapered portion 6*b* but this amount hardly changes by lubrication to the die parallel portion.

TABLE 1

Table 1: Reduction in Load and Change in Forward Elongation Amount by Lubrication

| Portion to be lubricated | None | Tapered portion only | Parallel portion only | All surfaces |
|---|---|---|---|---|
| Load reduction effect | 0% | 20% | 10% | 30% |
| Forward elongation amount ratio | 0.42 | 0.35 | 0.40 | 0.33 |

It can be considered that the forward elongation amount does not change because the pressure due to pressing is distributed in the longitudinal direction of the die contact surface. Thus, the pressure distribution in the longitudinal direction was obtained by the analysis using a slab method. FIGS. 61(*a*) to 61(*d*) respectively show its results.

FIG. 61(*a*) is a characteristic diagram in which the case where the lubricant is supplied only to the tapered portion of the die (method of a comparative example) is compared with the case of no lubrication to show the pressure distribution at the time of pressing. FIG. 61(*b*) is a characteristic diagram in which the case where the lubricant is supplied only to the parallel portion of the die (method according to the present invention) is compared with the case of no lubrication to show the pressure distribution at the time of pressing. FIG. 61(*c*) is a characteristic diagram in which the case where the lubricant is supplied on all the surfaces of the die (method of the prior art) is compared with the case of no lubrication to show the pressure distribution at the time of pressing. It is to be noted that the pressing pressure condition was determined to be approximately 8 kgf/mm$^2$ (pressure force) on the output side of the die. Further, an oblique angle θ of the tapered portion 6*b* relative to the parallel portion 6*a* was determined to be 12°. Further, a feed amount SD of the material was determined to be 400 mm.

As shown in FIGS. 61(*a*) to 61(*c*), the pressure increases at the tapered portion on the material input side. Then, the pressure becomes a maximum value at a point close to the tapered portion away from the center on the die parallel portion side. This point becomes a so-called neutral point where the material velocity coincides with the die velocity. The pressure gradually lowers on the material output side from the neutral point. The pressure smoothly increases at the tapered portion 6*b* but suddenly increases at the parallel portion 6*a*. In the both portions, the degree of increase becomes small as the friction coefficient is low. With a typical angle θ (10° to 15°), the contact length of the die tapered portion 6*b* becomes longer than that of the parallel portion 6*a*.

Since the contact length relative to the tapered portion 6*b* becomes longer than that relative to the parallel portion 6*a* in a typical die 6, an amount of change in the pressure becomes large when the friction coefficient is changed in the die tapered portion 6*b*. However, in this case, the neutral point moves toward the output side as shown in FIG. 61(*a*), and the forward elongation amount FW becomes small. On the other hand, it was found that the pressure distribution becomes slightly small and the position of the neutral point rarely change as shown in FIG. 61(*b*) when the friction coefficient of the die parallel portion 6*a* is reduced.

Subsequently, the present inventors examined about generation of slips of the material at the time of plate thickness pressing. As a result, they unveiled that the slip of the material occurs when the die 6 and the hot slab 20 start to contact with each other and the no slip occurs to the hot slab 20 when pressing proceeds partway.

In plate thickness pressing, by using the die parallel portion 6*a* in the subsequent steps to press the surface pressed by the die tapered portion 6*b*, that surface is cast so as to be substantially parallel with the material moving direction. As a result, a position where the die 6 and the material 20 start to contact with each other variously changes in accordance with a reduction amount (H−h), a feed amount SD or a die taper angle θ.

Figure 60:
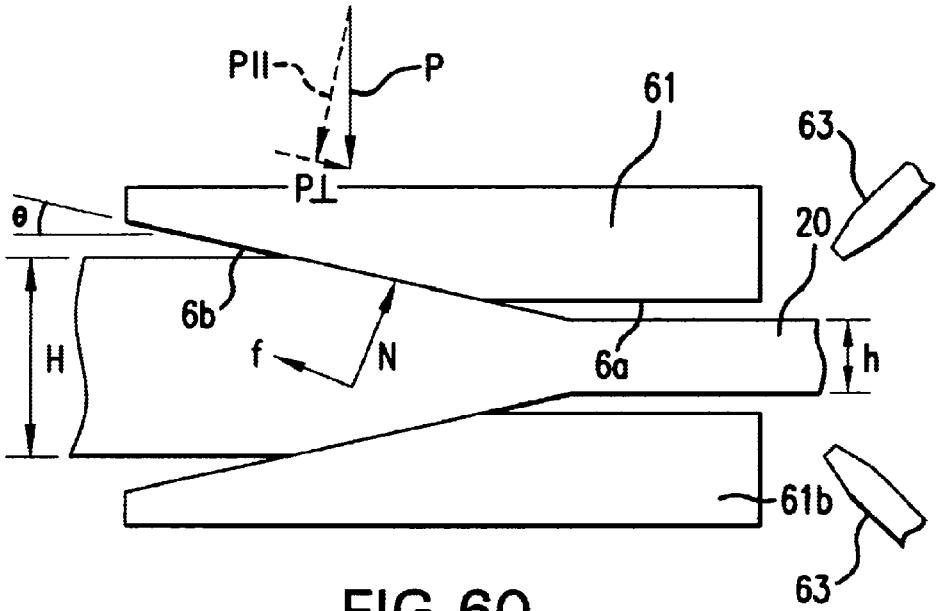
FIG. 60 is a schematic block diagram typically showing the relationship between a rolled material, a die and a lubricant supply nozzle for explaining a plate thickness pressing method according to another preferred embodiment of the present invention.
Figure 61A:
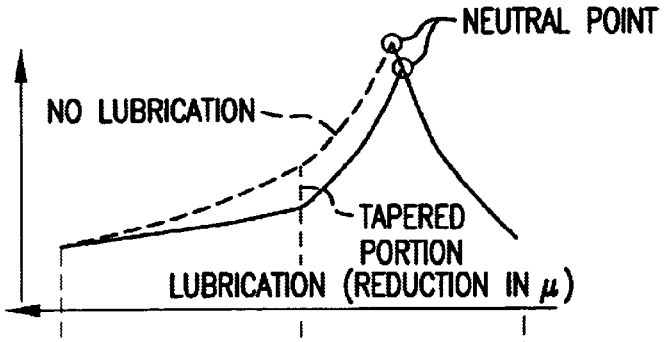
FIG. 61(*a*) is a characteristic diagram showing a pressure distribution at the time of pressing in cases where a lubricant is supplied only to the tapered portion of the die (method of the comparative example) and that in cases where no lubricant is supplied for comparison, FIG. 61(*b*) is a characteristic diagram showing a pressure distribution at the time of pressing in cases where the lubricant is supplied only to the parallel portion of the die (another preferred method according to the present invention) and that in cases where no lubricant is supplied for comparison, FIG. 61(*c*) is a characteristic diagram showing a pressure distribution at the time of pressing in cases where a lubricant is supplied to the entire surface of the die (conventional method) and that in cases where no lubricant is supplied, and FIG. 61(*d*) is a view typically showing a profile of the die.
Figure 61B:
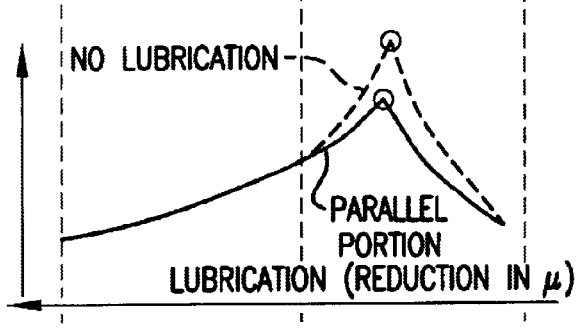
Figure 61C:
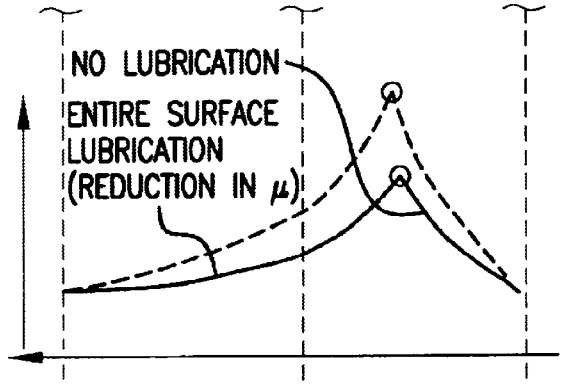
Figure 61D:
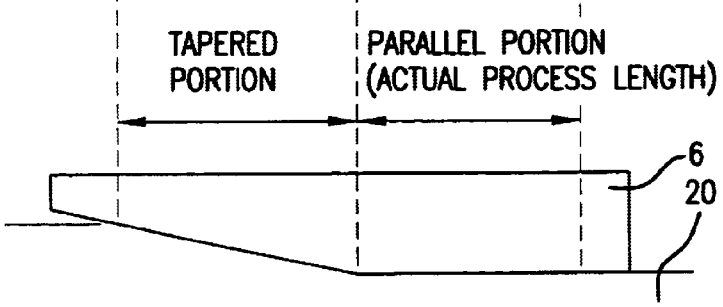

FIG. 60 is a schematic drawing showing various kinds of force acting on the die 61 when the contact starts if the contact start surface is the tapered portion 6*b*. In the drawing, reference character P denotes pressing force for pressing the die 61 against the hot slab 20; N, reactive force acting on the die 61 from the material (slab) 20; f, frictional force generated between the hot slab 20 and the die 61. The frictional force f must be equal to the component force Py in the taper direction of the pressing force P in order that the die 61 continues press forging without causing a slip of the hot slab 20. In this case, when the component force Py in the taper direction exceeds the maximum static frictional force $\mu$N, the hot slab 20 starts to slip with respect to the die 61. Here, when the condition under which the hot slab 20 does not slip is expressed by using the friction coefficient $\mu$ between the material and the die and the taper angle θ, the relationship represented by the following expression (13) can be achieved:

$$\mu \geqq \tan\theta \tag{13}$$

In hot forging, the contact state between the hot slab 20 and the die 61 is bad because of the rough forging surface, and scale is produced on the forging surface. Therefore, the friction coefficient $\mu$ between the hot slab 20 and the die 61 is low. Accordingly, if the contact start surface is the die tapered portion 6*b*, there is a possibility that the slip may occur.

If the taper angle θ is not more than 15° and the reduction amount (H−h) is large or the feed amount SD of the hot slab 20 is small, it is often the case that the material surface forged by the die tapered portion 6*b* is brought into contact with the die from the tapered portion 6*b* in press forging of the next step, and there is a possibility of generation of a slip. However, even if the friction coefficient at the die parallel portion which is not the contact start surface is lowered, the slip generation frequency does not change.

On the other hand, if the contact start surface between the die 61 and the hot slab 20 is the die parallel portion 6*a*, the component force in the input side direction (component force Py in the taper direction) of the pressing force does not act. It is, therefore, no slip occurs even if the die parallel portion 6*a* is lubricated. It is to be noted that the die tapered portion 6*b* which is not the contact start surface may be lubricated in this case.

Additionally, in the experiment conducted by the present inventors, no slip occurred when an oblique angle of the die tapered portion 6*b* was approximately 5° (it can be considered this is because the component force in the input side direction of the pressing force is small). Therefore, the transition area 6*c* of the die may be lubricated if the taper angle θ is not more than 5°.

It is to be noted that the present invention is not restricted to plate thickness pressing. The present invention can be generally used in forging (for example, sizing press) a hot material by using a die consisting of at least an input side tapered portion and a parallel portion.

Incidentally, any lubricant may be used for forging the hot slab only if it has a property for reducing the friction coefficient between the die and the slab at the time of pressing. For example, there is used a mixture obtained by mixing a mineral oil (grease) with a solid lubricant such as black lead, molybdenum disulfide or graphite. It is to be noted that application of the surface treatment for forming, e.g., a groove on the die surface in order to adjust the friction coefficient is not desirable because it may cause a scratch on the surface of the slab.

In regard to a method for applying the lubricant to the die, there can be considered various methods such as a method for spraying the lubricant to a gap between the material and the die during pressing or a method for applying the lubricant at idling from a slab to a subsequent slab. However, any method can be used as long as the lubricant which can sufficiently reduce the friction coefficient of the parallel portion between the die and the material can be applied.

According to the foregoing preferred embodiment, as shown in Table 1, even if only the parallel portion 6*a* is lubricated, the material 2 does not slip. Further, the load can be reduced approximately 10% and, on the other hand, the hot slab can be efficiently subjected to plate thickness pressing because the forward elongation amount FW rarely changes.

According to the present invention, when forging the hot slab by using the die having the main processing surface consisting of at least the input side tapered portion and the parallel portion, the lubricant is supplied only to the parallel portion of the die to decrease the friction coefficient between the hot slab and the die. As a result, the press load can be reduced without increasing the hot slab slip generation frequency, and a desired forward elongation amount FW can be assured.

Although the present invention has been described based on the multiple preferred embodiments, it can be understood that the scope included in the present invention is not restricted to these embodiments. On the contrary, the scope of the present invention includes all alterations, modifications and equivalents contained in the appended claims.

What is claimed is:

1. An apparatus for manufacturing a hot-rolled steel plate by plate thickness pressing comprising: a rough processing facility for applying a thickness reduction process to a hot slab cast by a continuously casting facility to obtain a sheet bar; a finishing mill group for rolling said sheet bar obtained by said rough processing facility to obtain a hot-rolled steel plate having a predetermined plate thickness; and a coiler for winding said hot-rolled steel plate, said rough processing facility, said finishing mill group and said coiler being arranged therein in the mentioned order, wherein said rough processing facility includes forging means using a pair of dies each of which has an inclined portion on an input side and a flat portion on an output side as at least a part of thickness reduction processing means and said apparatus for manufacturing a hot-rolled steel plate further comprises width reducing means provided on the upstream side of said thickness reduction forging means and said thickness reduction forging means comprises a caliber roll.

2. A method for manufacturing a hot-rolled steel plate by plate thickness pressing, comprising the steps of:

performing a thickness reduction process to a continuously cast slab having a plate thickness H to obtain a sheet bar in a roughing processing step;

rolling said sheet bar to obtain a hot-rolled steel plate having a predetermined plate thickness in a finishing rolling processing step; and winding said hot-rolled steel plate after cooling in a winding step, wherein said roughing processing step at least partially includes processing said cast slab in a plate thickness press processing step using a pair of dies each of which has an inclined portion on an input side and a flat portion on an output side with a reduction ratio r in a plate thickness direction being not less than 30%, and a width reduction whose width reduction amount is equal to or above a width reduction amount determined by a function fn (r, H) applied to a material before said plate thickness press processing so that

*Width reduction amount=fn(r, H)*.

3. A method for manufacturing a hot-rolled steel plate by plate thickness pressing, comprising the steps of:

processing a continuously cast slab by a plate thickness press process wherein when said plate thickness press process has a reduction ratio in a plate thickness direction of not less than 30% when applied to said continuously cast slab by using a pair of dies, each die having an inclined portion on an input side and a parallel portion on an output side, a contact length L of said parallel portion of each die in a longitudinal direction is set within a range of 0.2 to 0.4-fold of a plate thickness of said slab on said input side; and applying continuous roughing rolling and subsequent finishing rolling to a front end of said slab after said plate thickness press process to obtain a hot-rolled steel plate.

4. A manufacturing method for a hot-rolled steel plate by plate thickness pressing, comprising the steps of:

processing a continuously cast slab by a plate thickness press process, wherein said press process has a reduction ratio in a plate thickness direction of not less than 0.5 and is applied to said continuously cast slab by using a pair of dies, each die having an inclined portion on an input side and a flat portion on an output side, and press process conditions are set within a range capable of satisfying the following inequalities represented by a contact length L of said inclined portion of each die and a material in a longitudinal direction, a feed amount f, a plate width W before processing, a volume V processed by said parallel portion of each die, a plate thickness h on said output side and a reduction strain $\epsilon$; and applying continuous roughing rolling and subsequent finishing rolling to said slab after said press process to obtain a hot-rolled steel plate:

$$\epsilon L/W<A$$

$$V\epsilon/(Wfh)<B$$

where A and B are constants and A is not more than 0.6 and B is not more than 0.5.

5. A plate thickness pressing method for pressing a substantially rectangular material, comprising the steps of:

pressing a substantially rectangular material in a widthwise direction to perform width adjustment, wherein at least one of a front end and a rear end of said substantially rectangular material is preformed and wherein said width adjustment is carried out by a vertical rolling mill capable of changing an opening during processing; and subsequently applying plate thickness pressing in a plate thickness direction of said substantially rectangular material by using a die having a main processing surface consisting of at least an inclined portion on an input side and a parallel portion following said inclined portion with respect to said substantially rectangular material.

6. A plate thickness pressing method for pressing a substantially rectangular material, comprising the steps of:

pressing a substantially rectangular material in a widthwise direction to perform width adjustment; and subsequently applying plate thickness pressing in a plate thickness direction to said substantially rectangular material by using a die having a main processing surface consisting of at least an inclined portion on an input side and a parallel portion following said inclined portion with respect to said substantially rectangular material, wherein a non-steady width change amount $\Delta W$ and a non-steady length $\Delta L$ generated in at least one of a front end and a rear end of said substantially rectangular material by said plate thickness pressing are predicted by using the following expressions and said front end of said substantially rectangular material is preformed based on this prediction:

$$\Delta WH=f1(W,\epsilon, Ldt),\ \Delta WT=F2(W,\epsilon, Ldt)$$

$$\Delta LH=g1(W, h, Ldt),\ \Delta LT=g2(W, H, Ldt)$$

where $\Delta WH$ is a predicted non-steady width change amount generated at said front end of said rectangular material in a moving direction by plate thickness pressing; $\Delta WT$, a predicted non-steady width change amount generated at said rear end of said rectangular material in said moving direction by plate thickness pressing; $\Delta LH$, a predicted non-steady length generated at said front end of said rectangular material in said moving direction by plate thickness pressing; $\Delta LT$, a predicted non-steady length generated at said rear end of said rectangular material in said moving direction by plate thickness pressing; H, a plate thickness of said substantially rectangular material on a press input side; h, a plate thickness of said substantially rectangular material on a press output side; $\epsilon(=\log(H/h))$, a plate thickness strain; Ldt, a contact length of said material and said press die in a longitudinal direction; and W, a plate width of said substantially rectangular material.

7. A plate thickness pressing method, comprising the steps of:

preforming a substantially rectangular material by pressing in a widthwise direction to effect width adjustment to provide a distribution to a plate width of a steady portion of said substantially rectangular material in a width adjustment direction of plate thickness pressing wherein said width adjustment is carried out by a vertical rolling mill capable of changing an opening during processing; and subsequently applying plate thickness pressing in a plate thickness direction to said substantially rectangular material by using a die having a main processing surface consisting of at least an inclined portion on an input side and a parallel portion following said inclined portion with respect to said substantially rectangular material.

8. A plate thickness pressing method for pressing a substantially rectangular material, comprising the steps of:

preforming a substantially rectangular material by pressing in a widthwise direction to effect width adjustment to provide a distribution to a plate width of a steady portion of said substantially rectangular material in a width adjustment direction of plate thickness pressing; and subsequently applying plate thickness pressing to said substantially rectangular material in a plate thickness direction by using a die having a main processing surface consisting of at least an inclined portion on an input side and a parallel portion following said inclined portion with respect to said substantially rectangular material, wherein a steady portion plate width distribution amount dW generated by said plate thickness pressing and a pitch dL thereof are predicted by using the following expressions and said preforming are carried out based on this prediction:

where, $dW=F(V, W, h, f, \epsilon)$ $dL=G(H, h, f)$

H: a plate thickness of said substantially rectangular material on a press input side h: a plate thickness of said substantially rectangular material on a press output side $\epsilon$(=log(H/h)): a plate thickness strain W: a plate width of said substantially rectangular material f: a feed amount of said substantially rectangular material at the time of plate thickness pressing V: a reduction volume of said parallel portion of said die.

9. A plate thickness pressing method for pressing a substantially rectangular material, comprising the steps of:

preforming a substantially rectangular material by pressing in a widthwise direction to effect width adjustment, wherein a front end and a rear end of said substantially rectangular material are preformed and said preforming provides a distribution of a plate width to a steady portion of said substantially rectangular material and wherein said width adjustment is carried out by a vertical rolling mill capable of changing an opening during processing; and subsequently applying plate thickness pressing to said substantially rectangular material in a plate thickness direction by using a die having a main processing surface consisting of at least an inclined portion on an input side and a parallel portion following said inclined portion with respect to said substantially rectangular material.

10. A plate thickness pressing method for pressing a substantially rectangular material, comprising the steps of:

preforming a substantially rectangular material by pressing in a widthwise direction to effect width adjustment; and subsequently applying plate thickness pressing to said substantially rectangular material in a plate thickness direction by using a die having a main processing surface consisting of at least an inclined portion on an input side and a parallel portion following said inclined portion with respect to said substantially rectangular material, wherein a non-steady width change amount $\Delta W$ and a non-steady length $\Delta L$ generated in at least one of a front end and a rear end of said substantially rectangular material by said plate thickness pressing and a width distribution dW of a steady portion and a pitch dL thereof are predicted by using the following expressions, said front end and said rear end of said substantially rectangular material are respectively preformed based on this prediction, and pre-forming for providing a plate width distribution of said steady portion of said substantially rectangular material is carried out:

where $\Delta WH=f1(W, \epsilon, Ldt)$, $\Delta WT=f2(W,\epsilon,Ldt)$ $\Delta LH=g1(W, h, Ldt)$, $\Delta LT=g2(W, H, Ldt)$ $dW=F(V, W, h, f,\epsilon)$ $dL=G(H, h, f)$ $\Delta$WH is a predicted non-steady width change amount generated at said front end of said rectangular material in a moving direction by plate thickness pressing; $\Delta$WT, a predicted non-steady width change amount generated at said rear end of said rectangular material in said moving direction by plate thickness pressing; $\Delta$LH, a predicted non-steady length generated at said front end of said rectangular material in said moving direction by plate thickness pressing; $\Delta$LT, a predicted non-steady length generated at said rear end of said rectangular material in said moving direction by plate thickness pressing; H, a plate thickness of said substantially rectangular material on a press input side; h, a plate thickness of said substantially rectangular material on a press output side; $\epsilon$(=log(H/h)), a plate thickness strain; W, a plate width of said substantially rectangular material; f, a feed amount of said substantially rectangular material at the time of plate thickness pressing; V, a reduction volume of said parallel portion of said die; Ldt, a contact length of said substantially rectangular material and said press die in a longitudinal direction.

11. The plate thickness pressing method according to any of claims 6, 8, or 10, wherein said width adjustment is carried out by a vertical rolling mill capable of changing an opening during processing.

12. The plate thickness pressing method according to any of claims 5 or 7 wherein a caliber roll is used as said vertical rolling mill.

13. The plate thickness pressing method according to any of claims 5 to 10, wherein said width adjustment is carried out by a widthwise direction pressing device which an be tandem with a plate thickness press.

14. The plate thickness pressing method according to claim 11 wherein a caliber roll is used as said vertical rolling mill.

15. A plate thickness press apparatus comprising: a pair of dies, each die having a main processing surface consisting of at least an inclined portion on an input side and a parallel portion following said inclined portion with respect to a substantially rectangular material; means for feeding said substantially rectangular material to said pair of dies; a plate thickness pressing device for driving said pair of dies to press said substantially rectangular material in a plate thickness direction; and a vertical rolling mill which is provided on the pass line upstream side of said plate thickness pressing device and which operates to make small a gap change amount during processing and to form a sheet bar.

16. A plate thickness press apparatus comprising: a pair of dies, each die having a main processing surface consisting of at least an inclined portion on an input side and a parallel portion following said inclined portion with respect to a substantially rectangular material; means for feeding said substantially rectangular material to said pair of dies; a plate thickness pressing device for driving said pair of dies to press said substantially rectangular material in a plate thickness direction; and a widthwise direction pressing device which is provided on the pass line upstream side of said plate thickness pressing device and arranged at a position in tandem with said plate thickness pressing device, wherein said widthwise direction pressing device consists of a vertical rolling mill capable of changing an opening during processing.

17. A plate thickness pressing method for forging to reduce a thickness of a substantially rectangular hot slab while feeding said hot slab in a longitudinal direction, comprising:

a main process step for reducing a plate thickness H of said hot slab before pressing to a plate thickness h after pressing by using a main die having a main processing surface consisting of at least an input side tapered portion and a parallel portion; and a sub process step for applying thickness reduction pressing in a plate thickness direction to a first portion of said hot slab which is to be pressed by a transition portion of said main die, said transition portion corresponding to a boundary between said tapered portion and said parallel portion of said main die having said main processing surface, and said first portion is moved forward in the vicinity of said transition portion before repeating said main process step, wherein said sub process step is performed by a sub die.

18. The plate thickness pressing method according to claim 17, wherein in said sub process step, wherein f is a feed amount of said material and BW is a material backward elongation amount at the time of pressing, a portion on the upstream side away from said portion to be pressed by said transition portion by only a distance determined by the following expression is pressed in a plate thickness direction:

$$(0.9 \text{ to } 1.1)\times f+(f-BW)\times n$$

where n is a positive integer.

19. The plate thickness pressing method according to claim 17, wherein f is a feed amount of said material, said portion subjected to thickness reduction press in said sub process step is a portion positioned on the upstream side away from said transition portion by only a distance of (0.9 to 1.1)×f, and said sub process step and said main process step are alternately carried out.

20. The plate thickness pressing method according to any of claims 17 to 19, wherein r is a ratio of a reduction amount of a sub process relative to a reduction amount of a main process, said reduction amount of said sub process is set to be not less than (H−h)×r, ($r \geqq 0.025$).

21. The plate thickness pressing method according to any of claims 17 to 19, wherein r is a ratio of a reduction amount of a sub process relative to a reduction ratio of a main process, said sub process starts when said reduction amount of said main process exceeds (H−h)×(1−r).

22. A hot rolled slab forming method, comprising the steps of:

providing a width reduction press on the downstream side of a thickness reduction press;

subjecting a continuously cast hot slab to thickness reduction by said thickness reduction press; and then subjecting said slab to width reduction by said width reduction press after releasing said thickness reduction press.

23. A plate thickness press apparatus comprising: a thickness reduction press for reducing a thickness of a continuously cast hot slab; a width reduction press which is provided on the downstream side of said thickness reduction press and reduces a width of said slab; and a controller for operating said width reduction press when said thickness reduction press is released.

24. The plate thickness press apparatus according to claim 23, wherein a width measuring instrument for measuring a slab width is provided on the downstream side of said width reduction press, and said controller adjusts an opening of said width reduction press in such a manner that a measured value of said width measuring instrument becomes a predetermined value.

25. A plate thickness pressing method for forging a hot slab, comprising the steps of:

providing a hot slab; and forging said hot slab by bringing said hot slab into contact with a die having a main processing surface consisting of a tapered portion inclined in an input side direction at a taper angle of 10 to 30 degrees relative to a moving direction of said hot slab and a parallel portion which follows said tapered portion and is parallel to said moving direction, wherein a contact start surface of said hot slab and said die is a transition area between said tapered portion and said parallel portion and a part of said parallel portion, and provides a reduction amount of 50 mm, 100 mm, and 150 mm when a feed amount for said hot slab respectively ranges between 50–145 mm, 100–275 mm, and 150–425 mm.

26. The plate thickness pressing method according to claim 25, further comprising the step of applying a lubricant onto at least a contact surface relative to said hot slab in said main processing surface of said die.

27. A plate thickness pressing method, comprising the steps of:

forging a hot slab by using a die having a main processing surface consisting of at least an input side tapered portion and a parallel portion; and supplying a lubricant only to said parallel portion of said die to reduce a friction coefficient between said hot slab and said die.

28. An apparatus for manufacturing a hot-rolled steel plate by plate thickness pressing comprising: a rough processing facility for applying a thickness reduction process to a hot slab cast by a continuously casting facility to obtain a sheet bar; a finishing mill group for rolling said sheet bar obtained by said rough processing facility to obtain a hot-rolled steel plate having a predetermined plate thickness; and a coiler for winding said hot-rolled steel plate, said rough processing facility, said finishing mill group and said coiler being arranged therein in the mentioned order, wherein said rough processing facility includes forging means using a pair of dies each of which has an inclined portion on an input side and a flat portion on an output side as at least a part of thickness reduction processing means and said apparatus for manufacturing a hot-rolled steel plate further comprises width reducing means provided on the upstream side of said thickness reduction forging means and a warmer and a heater between said thickness reduction forging means and said finishing mill group.

* * * * *